US011173540B2

(12) United States Patent
Larsen et al.

(10) Patent No.: US 11,173,540 B2
(45) Date of Patent: Nov. 16, 2021

(54) SAND MOULDING MACHINE AND METHOD OF PRODUCING SAND MOULD PARTS

(71) Applicant: DISA INDUSTRIES A/S, Taastrup (DK)

(72) Inventors: Per Larsen, Søborg (DK); Christoffer Bay, Præstø (DK); Jørn Johansen, Ølstykke (DK); Christian Dam, Kokkedal (DK); Flemming Floro Hagemann, Frederiksberg C (DK)

(73) Assignee: DISA INDUSTRIES A/S, Taastrup (DK)

( * ) Notice: Subject to any disclaimer, the term of this patent is extended or adjusted under 35 U.S.C. 154(b) by 0 days.

(21) Appl. No.: 17/148,290

(22) Filed: Jan. 13, 2021

(65) Prior Publication Data

US 2021/0129211 A1 May 6, 2021

Related U.S. Application Data

(62) Division of application No. 16/466,559, filed as application No. PCT/IB2017/057614 on Dec. 4, 2017, now Pat. No. 10,919,087.

(30) Foreign Application Priority Data

Dec. 5, 2016 (WO) ..... PCT/IB2016/057352

(51) Int. Cl.
*B22C 11/08* (2006.01)
*B22C 15/02* (2006.01)
(Continued)

(52) U.S. Cl.
CPC ..... *B22C 9/02* (2013.01); *B22C 11/08* (2013.01); *B22C 15/02* (2013.01); *B22C 19/04* (2013.01); *B22C 21/10* (2013.01)

(58) Field of Classification Search
CPC ..... B22C 11/08; B22C 11/10; B22C 15/02; B22C 19/04; B22C 21/10; B22C 25/00
See application file for complete search history.

(56) References Cited

U.S. PATENT DOCUMENTS 3,729,047 A 4/1973 Bohnlein et al.
4,724,886 A 2/1988 Sjodahl
(Continued)

FOREIGN PATENT DOCUMENTS

CN 102905817 A 1/2013
DE 2348277 A1 4/1975
(Continued)

*Primary Examiner* — Kevin E Yoon
(74) *Attorney, Agent, or Firm* — Birch, Stewart, Kolasch & Birch, LLP

(57) ABSTRACT

The moulding machine includes a moulding chamber having at least one chamber end wall provided with a pattern plate adapted to form a pattern in a mould part and associated with a reference pattern block positioned in fixed relationship to a pattern of said pattern plate and adapted to form a reference pattern in an external face of a mould part. A detection system detects the position of a pattern face of the reference pattern of the sand mould part. A transverse and/or a rotational compaction position of a pattern plate is adjustable by means of at least one actuator. Said actuators are controlled by means of a control system on the basis of successive position detections performed by the detection system of pattern faces of reference patterns of compacted sand mould parts traveling along said path of travel.

21 Claims, 21 Drawing Sheets

(51) Int. Cl.

| | |
|---|---|
| ***B22C 19/04*** | (2006.01) |
| ***B22C 21/10*** | (2006.01) |
| ***B22C 9/02*** | (2006.01) |

(56) References Cited

U.S. PATENT DOCUMENTS

| | | | |
|---|---|---|---|
| 4,724,894 | A | 2/1988 | Sjodahl |
| 4,774,751 | A | 10/1988 | Pryor |
| 5,697,424 | A | 12/1997 | Ferdinandsen et al. |
| 5,757,506 | A | 5/1998 | Tabatabaei |
| 6,015,007 | A | 1/2000 | Hunter |
| 2008/0135205 | A1 | 6/2008 | Jezwinski |

FOREIGN PATENT DOCUMENTS

| | | | |
|---|---|---|---|
| DE | 3134663 | A1 | 3/1983 |
| DE | 4202020 | A1 | 7/1993 |
| DE | 202009009978 | U1 | 9/2009 |
| JP | H04190964 | A | 7/1992 |
| JP | 07229712 | A | 8/1995 |
| JP | H09103840 | A | 4/1997 |
| JP | 10249487 | A | 9/1998 |
| WO | WO 95/34405 | | 12/1995 |
| WO | WO 01/72450 | A1 | 10/2001 |
| WO | WO 2011/089585 | A1 | 7/2011 |
| WO | WO 2016/166579 | A1 | 10/2016 |

SAND MOULDING MACHINE AND METHOD OF PRODUCING SAND MOULD PARTS

This application is a Divisional of co-pending U.S. patent application Ser. No. 16/466,559, filed on Jun. 4, 2019, which is a National Phase under 35 U.S.C. § 371 of PCT International Application No. PCT/IB2017/057614, filed on Dec. 4, 2017, which claims the benefit under 35 U.S.C. § 119(a) of Patent Application No. PCT/IB2016/057352 filed on Dec. 5, 2016. The entire contents of which are hereby incorporated by reference.

The present invention relates to a sand moulding machine for the production of sand mould parts including a moulding chamber formed by a chamber top wall, a chamber bottom wall, two opposed chamber side walls and two opposed chamber end walls, wherein a chamber wall is provided with at least one sand filling opening, wherein at least one of the chamber end walls is provided with a pattern plate having a pattern adapted to form a pattern in a sand mould part, wherein at least one of the chamber end walls is displaceable in a longitudinal direction of the moulding chamber in order to compact sand fed into the moulding chamber, wherein at least one of the pattern plates is associated with at least one reference pattern block positioned in fixed relationship to the pattern of said pattern plate and adapted to form a reference pattern in an external face of a sand mould part, and wherein a detection system is arranged adjacent a path of travel of the compacted sand mould parts and is adapted to detect a position of a pattern face of the reference patterns of the sand mould parts.

On automated moulding machines, two different types of machines or techniques are often used; the match plate technique such as employed by DISA MATCH (Registered Trademark) horizontal flaskless match plate machines and the vertical sand flaskless moulding technique such as the DISAMATIC (Registered Trademark) technique.

According to the match plate technique, a match plate having moulding patterns on both sides facing away from each other is being clamped between two moulding chambers. During the simultaneous moulding of a first and a second sand mould half part, the patterns of the match plate are extending into each respective moulding chamber. A slit-formed sand inlet opening extending across a wall is arranged at each moulding chamber.

Simultaneously sand is blown in through each slit-formed opening and into each moulding chamber. Thereafter, the sand is being squeezed by the movement of oppositely arranged press plates being displaced simultaneously in direction towards the match plate. After the squeezing, the moulding chambers are moved away from each other, the match plate is being removed and eventually cores are placed in the moulds. The moulds are then closed and pushed out of the chamber and are ready for pouring liquid metal therein in order to produce metal castings.

According to the vertical flaskless sand moulding technique such as the DISAMATIC (Registered Trademark) technique, a first and a second plate, each provided with a pattern plate, are arranged oppositely at either end of a moulding chamber. During the moulding of a single mould part the patterns of the pattern plates are extending into each respective end of the moulding chamber. A slit-formed sand inlet opening extending across a wall is arranged typically at the top of the moulding chamber.

Sand is blown in through the slit-formed opening and into the moulding chamber. Thereafter, by displacement of the first and/or the second plate, the plates move relatively in direction towards each other and squeeze the sand therebetween. After being removed from the moulding chamber, the sand mould part is placed adjacent the previously moulded sand mould part on a conveyer. Thereby, two neighbouring sand mould parts form a complete sand mould. The cavity formed by these two sand mould parts constitutes a cavity for the subsequent casting of the metal product.

U.S. Pat. No. 4,724,886 (Selective Electronic, Inc.) discloses an apparatus and method for detecting the misalignment of cooperating mould sections during operation of a mould making machine. The mould making machine includes a device for forming a rectangular reference mark on the exterior of the mould surface and a non-contact distance measuring device for detecting the misalignment of the internal mould cavities of the mould sections by detecting any misalignment as a step between two adjacent external reference marks. The distance measuring device initially detects a step increase in the measured distance as the reference mark passes into the field of view of the measuring device. If, during the time that the reference mark is within the field of view, this distance changes in a stepwise manner in an amount greater than a previously established threshold tolerance, this indicates an internal misalignment and the operator is signalled, through a display on the system control unit. The operator then has a choice of stopping the advancement of the mould sections and correcting the problem causing the misalignment, or the operator may wait and see if the misalignment was an isolated problem or a persistent problem by checking several subsequent mould sections for misalignment before stopping the production line. However, according to this method, the accuracy of the distance measurement is limited, and an indication of misalignment is only given if a distance change greater than a threshold tolerance is measured. A measure for the degree of misalignment is not indicated to the operator. Furthermore, although this arrangement may detect vertical, lateral and rotational mutual misalignment of adjacent mould sections, other parameters such as the width of a possible gap between adjacent mould sections, mould expansion and mould dimensions cannot be detected by this arrangement.

U.S. Pat. No. 5,697,424 (Dansk Industri Syndikat A/S) describes an automatically operating moulding and casting plant comprising a moulding station for producing moulds by compressing moulding sand, a pouring station and an extraction station. It may happen, without the operator immediately noticing it, that when the newly compacted mould part is released from the pattern or patterns, against which it has been formed by compressing moulding sand, some moulding sand adheres to the pattern, thereby producing an error in the form of a recess in the casting cavity formed. In order to detect such situations, a number of video cameras depicting one or a number of process steps and/or the results of the same transmit the corresponding image information to central control means, in which the image information is compared to "ideal" image information, e.g. image information previously read-in and based on a process step proceeding correctly. On the basis of the results of the comparison, the central control means controls the affected stations in such a manner that undesired operational states or defective castings are avoided. However, this method may not provide sufficiently accurate information about mutual misalignment of adjacent mould sections, such as for instance vertical, lateral and rotational mutual misalignment and the width of a possible gap between adjacent mould sections. Furthermore, mould expansion and mould dimensions cannot be detected very accurately by this arrangement.

JP4190964A discloses a flaskless casting line provided with a sand moulding machine. The boundary area between adjacent sand moulds conveyed on an intermittent conveyor in the sand mould line is picked up by TV cameras, and the video signals are processed. Thereby, the boundary line between the adjacent sand moulds is decided, and the length of the sand mould in the feeding direction is decided by a width between two boundary lines in the feeding direction. In this way, the position of an arbitrary sand mould in the sand mould line on the intermittent conveyor can be decided based on this sand mould length. However, although the thickness of sand moulds may be determined in this way, inaccuracies such as vertical, lateral and rotational mutual misalignment of adjacent mould parts, as well as other parameters such as the width of a possible gap between adjacent mould parts cannot be detected by this system.

U.S. Pat. No. 4,774,751 relates to foundry procedures, particularly in-process and post process inspection with electro-optical sensor units. Principally addressed are: inspection of moulds and cores to assure correctness and control procedures to abort pouring if the moulds are not correct, inspection of cores on the core line, inspection of patterns for sticking sand, inspection of finished castings for extraneous material in passages, excessive or inadequate stock, correct locator relationships, etc., and control of robotic flash grinders. Disclosed is a system to inspect moulds on a continuous mould line for any or all of the following: cores are complete (not missing pieces), cores are properly positioned in drag mould (alignment, height), sand in moulds is correct size and no damage, pins and pin holes in cope and drag mould are correct size and in good enough condition to allow proper mating. Both fixed and programmably moveable sensors are shown in the context of these embodiments. However, this system is not able to detect inaccuracies relating to the mutual positioning of two mould parts forming a complete mould, such as vertical, lateral and rotational mutual misalignment of adjacent mould parts, as well as other parameters such as the width of a possible gap between adjacent mould parts.

DE 42 02 020 A1 discloses a process for positioning the bottom pouring hole of a casting system above the sprue of a mould in a boxless mould making and converging system. The pouring hole position above the sprue is inspected and position errors are detected, as soon as a mould making and conveying operation is ended and the mould is at rest. The positioning equipment includes (i) a measuring system for determining the pouring hole position above the sprue; (ii) a positioning system for longitudinal and transverse adjustment of the casting system with respect to the conveyor system; and (iii) a measurement processing system for controlling the positioning system. The measuring system may have the form of video, laser, radar or ultrasonic camera and is provided with an attached measuring variable processing system. The process is useful in the casting of metal articles in boxless moulds as it allows casting to be carried out without delay and compensates for tolerances in the mould thickness and within the conveyor system for rapid and precise pouring hole positioning.

WO 01/72450 discloses a moulding machine using the match plate technique for producing flaskless moulds, said machine comprising two flasks and corresponding squeeze plates with associated mounting means allowing relative movement of the squeeze plates in an axial direction. Provision of tilting means provides a possibility of aligning the squeeze plates with possibly distorted mould surfaces, thereby preventing the produced mould parts from tilting during the push-out from the flasks, said tilting movement potentially leading to misalignment of the superposed mould parts (cope and drag).

DE 23 48 277 A1 discloses a pattern carrying plate for a match plate moulding machine with micrometer screw adjustment. A pattern carrier for a foundry moulding machine carries opposed upper and lower patterns. For fine adjustment of either the upper or the lower pattern there is provided, at the side of the carrier, a micrometer screw. The device is used in match plate moulding machines. Very accurate adjustment of the two patterns with regard to one another is possible. The patterns can be adjusted in two mutually perpendicular horizontal axes and can be rotated in a horizontal plane with the arrangement.

DE 31 34 663 A1 discloses a method and an apparatus for the accurate assembly of mould parts. In order to permit active accurate alignment of the mould cavities formed when assembling the mould box parts, centring marks are formed in the sand moulds with the aid of the patterns. These centring marks are sensed by means of a sensing device which actuates a control device for adjusting the relative position of the mould box parts.

However, according to prior art sand moulding techniques, mutual misalignment and misorientation of adjacent produced mould sections, such as for instance vertical, lateral and rotational mutual misalignment and the width of a possible gap between adjacent mould sections cannot be effectively detected and compensated for before the final metal castings produced in the sand moulds have cooled down and are removed from the sand moulds. As there may be a string of for instance 300 or more sand moulds located downstream, that is after, the melt pouring device, it may take a long time before any inaccuracies are detected by inspection of the cooled down castings at the end of such string. Therefore, in that case, more than 300 castings would have to be scrapped or reworked if there were only one casting in each mould. Often patterns for sand moulds with several casting cavities are used; meaning for instance a pattern with four cavities would result in 1200 defective castings having to be scrapped or reworked.

Furthermore, US 2008/135205 discloses a sand moulding machine in which a lateral squeeze head moving in a longitudinal direction may include a plurality of linear sensors that monitor the vertical and/or lateral location of the lateral squeeze head. This citation also discloses that a swingable squeeze head may include a plurality of sensors that allow the monitoring of the position of the swingable squeeze head so that its accurate placement within the mould chamber is achieved. The sensors and/or measuring devices for detection of misalignments are not located along the path of travel of compacted sand mould parts, i.e. are not located in the string of sand mould parts and thereby are not able to loop back from the actual alignment of the moulds, only the pattern plates.

According to the present invention, misalignment of the moulds can be generated down the line leading to a need for misalignment of the pattern plates in the moulding machine. This to secure perfect moulds down the line where pouring and solidification occurs.

The object of the present invention is to provide a sand moulding machine and a method of producing sand mould parts, whereby mutual misalignment and/or misorientation of patterns formed in adjacent produced sand mould parts may be reduced or eliminated effectively.

In view of this object, a transverse compaction position in which said at least one pattern plate is positioned during compaction of sand fed into the moulding chamber is adjustable by means of at least one actuator by means of which said at least one pattern plate is adjustable by displacement relative to a nominal position in at least one transverse direction of the longitudinal direction of the moulding chamber and/or a rotational compaction position in which said at least one pattern late is positioned during compaction of sand fed into the moulding chamber is adjustable by means of at least one actuator by means of which said at least one pattern plate is adjustable by rotation relative to a nominal rotational position about at least one axis of rotation, and said actuator or actuators is/are controlled by means of a control system on the basis of successive position detections performed by the detection system of pattern faces of reference patterns of compacted sand mould parts traveling along said path of travel in order to adaptively control the alignment of patterns formed in produced sand mould parts along the longitudinal direction of the moulding chamber and/or the rotational position of patterns formed in produced sand mould parts about corresponding axes of rotation.

In this way, by adaptively controlling the transverse and/or the rotational compaction position of the pattern plate on the basis of accurate position detections of reference patterns formed in an external face of already compacted sand mould parts, it is possible to effectively control the alignment and/or rotational position of patterns formed and located internally in subsequently produced and abutting sand mould parts.

In an embodiment, the control system is adapted to adaptively control said alignment and said rotational position of patterns formed in produced sand mould parts by, in a control cycle, firstly performing the following step:

controlling at least one actuator arranged to adjust a rotational compaction position by rotation of said at least one pattern plate about at least one axis of rotation extending transversely in relation to the longitudinal direction of the moulding chamber until a certain measure for the difference in rotational position of two opposed patterns formed in the same produced sand mould part about corresponding axes of rotation has been obtained, and secondly performing at least one of the following two steps:

controlling at least one actuator arranged to adjust a transverse compaction position by displacement of said at least one pattern plate in at least one transverse direction of the longitudinal direction of the moulding chamber until a certain measure for the alignment of the patterns formed in the produced sand mould parts along the longitudinal direction of the moulding chamber has been obtained, controlling at least one actuator arranged to adjust a rotational compaction position by rotation of said at least one pattern plate about the longitudinal direction of the moulding chamber until a certain measure for the rotational position of the patterns formed in the produced sand mould parts in relation to a corresponding nominal rotational position has been obtained.

Thereby, by firstly adjusting a rotational compaction position of the pattern plate or plates about an axis extending transversely of the longitudinal direction of the moulding chamber, the parallelism of opposed end faces of each compacted sand mould part may be adjusted before any transverse or rotational misalignment of the patterns formed in the produced sand mould parts is adjusted. Thereby, a more effective control procedure may be achieved, because an adjustment of the parallelism of opposed end faces may often result in further transverse or rotational misalignment of the patterns formed in the produced sand mould parts, and such misalignment must subsequently be compensated for by adjustment of a transverse compaction position of the pattern plate or plates and/or a rotational compaction position of the pattern plate or plates about the longitudinal direction of the moulding chamber. Said further transverse or rotational misalignment of the patterns may be the result of mutually abutting produced sand mould parts accumulating inaccuracies of parallelism and therefore arranging themselves in oblique configuration on a conveyor.

In an embodiment, the control system is adapted to initiate and complete said control cycle, in the case that during operation of the sand moulding machine it is detected that a maximum deviation for the alignment of the patterns formed in the produced sand mould parts along the longitudinal direction of the moulding chamber is exceeded, and/or in the case that during operation of the sand moulding machine it is detected that a maximum deviation for the difference in rotational position of two opposed patterns formed in the same produced sand mould part about said corresponding axes of rotation is exceeded. Thereby, the number of adjustment operations performed by the actuators may be reduced and a steadier control procedure may be achieved. By setting said maximum deviations for the alignment and for the difference in rotational position higher than the respective resolutions of the control system resulting from the combination of the resolution of the detection system and the resolution of the actuators, the control system may initiate and complete said control cycles in such a way that any inaccuracies of parallelism are always corrected before transverse or rotational misalignment of the patterns is corrected.

In an embodiment, a rotational compaction position in which said at least one pattern plate is positioned during compaction is adjustable by means of at least one actuator by means of which said at least one pattern plate is adjustable by rotation relative to a nominal rotational position about at least one axis of rotation extending transversely in relation to the longitudinal direction of the moulding chamber, and said actuator or actuators is/are controlled by means of a control system on the basis of successive position detections performed by the detection system of pattern faces of reference patterns of compacted sand mould parts traveling along said path of travel in order to adaptively control the rotational position of patterns formed in produced sand mould parts about an axis parallel to said at least one axis extending transversely in relation to the longitudinal direction of the moulding chamber. Thereby, inaccuracies of parallelism of opposed end faces and patterns of compacted sand mould parts may be adjusted or corrected.

In an embodiment, said at least one axis of rotation extending transversely in relation to the longitudinal direction of the moulding chamber includes a first axis and a second axis being different from the first axis. Thereby, any inaccuracies of parallelism of opposed end faces and patterns of compacted sand mould parts may be adjusted or corrected.

In an embodiment, said first axis is at least substantially at right angles to said second axis. Thereby, inaccuracies of parallelism of opposed end faces of compacted sand mould parts may be adjusted or corrected more effectively in that actuators may have to travel less and may control rotational compaction position more accurately.

In an embodiment, said first axis is at least substantially vertical and said second axis is at least substantially horizontal. This may facilitate integration of the actuators in existing designs of sand moulding machines.

In an embodiment, a rotational compaction position in which said at least one pattern plate is positioned during compaction is adjustable by means of at least one actuator by means of which said at least one pattern plate is adjustable by rotation relative to a nominal rotational position about an axis extending in the longitudinal direction of the moulding chamber, and said actuator or actuators is/are controlled by means of a control system on the basis of successive position detections performed by the detection system of pattern faces of reference patterns of compacted sand mould parts traveling along said path of travel in order to adaptively control the rotational position of patterns formed in produced sand mould parts about an axis extending in the longitudinal direction of the moulding chamber. Thereby, inaccuracies of rotational alignment of patterns formed in compacted sand mould parts about an axis extending in the longitudinal direction of the moulding chamber may be adjusted or corrected.

In an embodiment, a transverse compaction position in which said at least one pattern plate is positioned during compaction of sand fed into the moulding chamber is adjustable by displacement of said at least one pattern plate relative to a nominal position in a first transverse direction of the longitudinal direction of the moulding chamber and by displacement of said at least one pattern plate relative to a nominal position in a second transverse direction of the longitudinal direction of the moulding chamber, said second transverse direction being different from said first transverse direction. Thereby, any inaccuracies of alignment in transverse directions of patterns formed in produced and abutting sand mould parts may be adjusted or corrected. This transverse adjustment or correction in combination with the just above mentioned adjustment or correction of inaccuracies of rotational alignment of patterns formed in compacted sand mould parts about an axis extending in the longitudinal direction of the moulding chamber may typically alleviate the majority of any traverse or rotational misalignments occurring during operation of a sand moulding machine.

In an embodiment, each of the chamber end walls is provided with a respective pattern plate having a pattern adapted to form a pattern in a sand mould part, a transverse compaction position in which a first one of said pattern plates is positioned during compaction of sand fed into the moulding chamber is adjustable by displacement of said first pattern plate relative to a nominal position in a first transverse direction of the longitudinal direction of the moulding chamber, and a transverse compaction position in which a second one of said pattern plates is positioned during compaction of sand fed into the moulding chamber is adjustable by displacement of said second pattern plate relative to a nominal position in a second transverse direction of the longitudinal direction of the moulding chamber, said second transverse direction being different from said first transverse direction. Thereby, any inaccuracies of alignment in transverse directions of patterns formed in produced and abutting sand mould parts may be adjusted or corrected with a minimum of actuators.

In an embodiment, said first transverse direction is at least substantially at right angles to said second transverse direction. Thereby, inaccuracies of alignment in transverse directions of opposed end faces of compacted sand mould parts may be adjusted or corrected more effectively in that actuators may have to travel less and may control transverse compaction position more accurately.

In an embodiment, said first transverse direction is at least substantially vertical and said second transverse direction is at least substantially horizontal. This may facilitate integration of the actuators in existing designs of sand moulding machines.

In an embodiment, a transverse direction of the longitudinal direction of the moulding chamber is a direction at least substantially at right angles to the longitudinal direction of the moulding chamber. This may further facilitate integration of the actuators in existing designs of sand moulding machines.

In an embodiment, said at least one pattern plate is positioned relatively to the at least one of the chamber end walls by means of at least one guide pin engaging the at least one pattern plate and being arranged displaceably on said chamber end wall by means of at least one actuator. This may further facilitate integration of the actuators in existing designs of sand moulding machines.

In an embodiment, at least one of said guide pins is arranged displaceably on said chamber end wall by means of at least one actuator in a first direction, and at least one of said guide pins is arranged displaceably on said chamber end wall by means of at least one actuator in a second direction being different from the first direction. Thereby, inaccuracies of alignment in transverse directions and/or of rotational alignment of patterns formed in compacted sand mould parts may be adjusted or corrected.

In an embodiment, at least one of said guide pins is arranged displaceably on said chamber end wall by means of at least one actuator in at least one direction, and said at least one of said guide pins is arranged eccentrically on a disc driven rotationally by said at least one actuator so that the centre axis of the guide pin is parallel to, but displaced in relation to the central rotational axis of said disc. Thereby, by rotation of said disc by means of said at least one actuator, said guide pin may be displaced in at least one direction. If the angle of rotation is relatively small compared to the displacement between the centre axis of the guide pin and the central rotational axis of said disc, said guide pin may be displaced at least substantially along a straight line.

In an embodiment, said first direction is at least substantially at right angles to said second direction. Thereby, inaccuracies of alignment in transverse directions of opposed end faces of compacted sand mould parts may be adjusted or corrected more effectively in that actuators may have to travel less and may control transverse compaction position more accurately.

In an embodiment, said first direction is at least substantially vertical and said second direction is at least substantially horizontal. This may facilitate integration of the actuators in existing designs of sand moulding machines.

In an embodiment, the detection system includes at least a first distance measuring device arranged to measure a distance at least substantially in said first direction and at least a second distance measuring device arranged to measure a distance at least substantially in said second direction. Thereby, because the respective directions of distance measurements correspond to the respective directions of correction of compaction position of the pattern plate, accumulated inaccuracies in the control system due to measurements and operation of actuators may be reduced.

In an embodiment, the first and second distance measuring devices are non-contact distance measuring devices. Thereby, faster and more accurate distance measurements may be achieved, thereby resulting in faster and more accurate control.

In an embodiment, said at least one pattern plate is positioned relatively to the at least one of the chamber end walls by means of a first and a second guide pin each arranged in opposed side areas of said chamber end wall, the first guide pin is arranged displaceably on said chamber end wall by means of at least one first actuator in an at least substantially vertical direction, the second guide pin is arranged displaceably on said chamber end wall independently of the first guide pin by means of at least one second actuator in an at least substantially vertical direction, a transverse compaction position in which said at least one pattern plate is positioned during compaction of sand fed into the moulding chamber is adjustable by displacement of said at least one pattern plate in an at least substantially vertical direction by displacement of the first and the second guide pin in the same direction, and a rotational compaction position in which said at least one pattern plate is positioned during compaction is adjustable by means of said at least one first and second actuators by rotation of said at least one pattern plate about an axis extending in the longitudinal direction of the moulding chamber by a different displacement distance of the first and the second guide pin in the same direction or by displacement of the first and the second guide pin in opposed directions. Thereby, any inaccuracies of alignment in vertical direction of patterns formed in produced and abutting sand mould parts may be adjusted or corrected and at the same time, inaccuracies of rotational alignment of patterns formed in compacted sand mould parts about any axis extending in the longitudinal direction of the moulding chamber may be adjusted or corrected.

In an embodiment, at least one of said guide pins is arranged freely displaceably within a certain limit on said chamber end wall in an at least substantially horizontal direction. Thereby, said at least one guide pin being arranged freely displaceably may compensate for small variations in the distance between the guide pins that would otherwise occur when these are positioned at different vertical positions by different vertical displacement of the guide pins. This is advantageous in the case that the at least one pattern plate is positioned relatively to the at least one of the chamber end walls by means of engagement of the guide pins in corresponding holes in the pattern plate. Furthermore, said at least one guide pin being arranged freely displaceably may follow displacements of the pattern plate resulting from displacements of another one of said guide pins on said chamber end wall by means of an actuator in an at least substantially horizontal direction. Furthermore, said at least one guide pin being arranged freely displaceably may compensate for small variations in the distance between said corresponding holes in the pattern plate or in the distance between the guide pins, said variations in distance resulting from temperature expansions of the materials forming the pattern plate and/or the chamber end wall.

In an embodiment, said at least one pattern plate is positioned relatively to the at least one of the chamber end walls by means of two guide pins each arranged in opposed side areas of said chamber end wall, each of said guide pins is arranged displaceably on said chamber end wall by means of at least one actuator in an at least substantially vertical direction, a first one of said guide pins is arranged displaceably on said chamber end wall by means of at least one actuator in an at least substantially horizontal direction, and a second one of said guide pins is arranged freely displaceably within a certain limit on said chamber end wall in an at least substantially horizontal direction. Thereby, any inaccuracies of alignment in transverse directions of patterns formed in produced and abutting sand mould parts may be adjusted or corrected and at the same time, inaccuracies of rotational alignment of patterns formed in compacted sand mould parts about any axis extending in the longitudinal direction of the moulding chamber may be adjusted or corrected.

In a structurally particularly advantageous embodiment, said second one of said guide pins is arranged freely displaceably within a certain limit on said chamber end wall in an at least substantially horizontal direction by being mounted on a lower end of an at least substantially vertically arranged lever, and an upper end of the lever is pivotally arranged on said chamber end wall.

In a structurally further advantageous embodiment, the upper end of the lever is pivotally arranged on a slide which is arranged displaceably on said chamber end wall by means of at least one actuator in an at least substantially vertical direction.

In an embodiment, at least one of the chamber end walls is arranged swingable on a swing plate frame in relation to the moulding chamber about an at least substantially horizontal pivot axis extending at the upper part of said swingable chamber end wall, when said swingable chamber end wall is extending in an at least substantially vertical direction defining a rotational compaction position, a lower part of said swingable chamber end wall is adapted to abut at least one pressure pad engaging between said swingable chamber end wall and the swing plate frame, and the at least one pressure pad is arranged displaceably relative to said swingable chamber end wall or the swing plate frame by means of at least one actuator in order to adjust said rotational compaction position. Thereby, inaccuracies of parallelism of opposed end faces and patterns of compacted sand mould parts may be adjusted or corrected. This embodiment may facilitate integration of the actuators in existing designs of sand moulding machines.

In an embodiment, at least one of the chamber end walls is arranged swingable on a swing plate frame in relation to the moulding chamber about an at least substantially horizontal pivot axis extending at the upper part of said swingable chamber end wall by means of a left and a right bearing, at least one of said bearings is arranged displaceably at least substantially in the longitudinal direction of the moulding chamber relative to the swing plate frame or at least substantially in a direction at right angles to the plane of extension of the swingable chamber end wall relative to the swingable chamber end wall by means of at least one actuator, and, when said swingable chamber end wall is extending in an at least substantially vertical direction defining a rotational compaction position, a lower part of said swingable chamber end wall is adapted to abut at least one pressure pad arranged on the swing plate frame. Thereby, inaccuracies of parallelism of opposed end faces and patterns of compacted sand mould parts may be adjusted or corrected. This embodiment may facilitate integration of the actuators in existing designs of sand moulding machines.

In an embodiment, at least one of the chamber end walls is arranged swingable on a swing plate frame in relation to the moulding chamber about an at least substantially horizontal pivot axis extending at the upper part of said swingable chamber end wall by means of a left and a right bearing, at least one of said bearings is arranged displaceably in an at least substantially vertical direction relative to the swing plate frame or relative said swingable chamber end wall by means of at least one actuator. Thereby, any inaccuracies of alignment in vertical direction of patterns formed in produced and abutting sand mould parts may be adjusted or corrected. Furthermore, inaccuracies of rotational alignment of patterns formed in compacted sand mould parts about an axis extending in the longitudinal direction of the moulding chamber may be adjusted or corrected. This embodiment may facilitate integration of the actuators in existing designs of sand moulding machines.

In an embodiment, at least one of the chamber end walls is arranged swingable on a swing plate frame in relation to the moulding chamber about an at least substantially horizontal pivot axis extending at the upper part of said swingable chamber end wall by means of a left and a right bearing, and the relative position of said swingable chamber end wall in relation to the swing plate frame is adjustable at least substantially in the direction of said pivot axis by means of at least one actuator. Thereby, any inaccuracies of alignment in horizontal direction of patterns formed in produced and abutting sand mould parts may be adjusted or corrected. This embodiment may facilitate integration of the actuators in existing designs of sand moulding machines.

In an embodiment, a transverse and/or rotational compaction position in which said at least one pattern plate is positioned during compaction of sand fed into the moulding chamber and which is adjustable by means of at least one actuator is additionally adjustable independently of said actuator by means of a manual adjusting mechanism. Thereby, it may be possible to manually preadjust a transverse and/or rotational compaction position. For instance, the manual adjusting mechanism may allow a relatively larger adjustment interval in order to zero the adjustment, whereas it may be sufficient that the at least one actuator operates within a relatively smaller adjustment interval.

In an embodiment, the control system is adapted to receive from an input device instructions regarding at least one initial value for the transverse and/or rotational compaction position in which said at least one pattern plate is to be positioned by means of at least one actuator as a starting point for subsequent control of said actuator by means of the control system. Thereby, an operator may input a suitable initial value for the transverse and/or rotational compaction position for a specific pattern plate. Such a suitable initial value may for instance be based on experience and/or empirical data. For instance, a specific pattern plate may have a pattern that is rather asymmetric so that a relatively large impression is made in a first side of the sand mould part and so that a relatively small impression is made in a second side of the sand mould part. In such a case, experience and/or empirical data may indicate that an initial value in a certain range for the transverse and/or rotational compaction position may result in that the desired result is achieved in a relatively faster and/or a relatively simpler way, i.e. that one or more set points for a desired alignment of patterns formed in the produced sand mould parts along the longitudinal direction of the moulding chamber and/or one or more set points for a desired rotational position of patterns formed in produced sand mould parts about at least one axis of rotation is/are achieved in a relatively faster and/or relatively simpler way.

In an embodiment, the sand moulding machine includes a register of suitable initial values for transverse and/or rotational compaction positions of a number of different pattern plates, and the input device is adapted to receive identification corresponding to a specific pattern plate. Thereby, the control system may more or less automatically receive a suitable initial value for the transverse and/or rotational compaction position for a specific pattern late from the register. For instance, an operator may input a serial number of the pattern plate, or the sand moulding machine may be provided with for instance a bar code scanner in order to identify the specific pattern plate.

In an embodiment, the control system is adapted to receive from an input device instructions regarding one or more set points for a desired alignment of patterns formed in the produced sand mould parts along the longitudinal direction of the moulding chamber and/or one or more set points for a desired rotational position of patterns formed in produced sand mould parts about at least one axis of rotation. Thereby, an operator may input one or more set points which are suitable in a specific situation or which are suitable for a specific pattern plate. Such one or more suitable set points may for instance be based on inspection of the final castings or may be based on experience and/or empirical data relating to a specific pattern. For instance, if no particular relevant information is available in this regard, it may normally be assumed that the best set point for a transverse compaction position is zero which corresponds to a theoretically exact alignment of patterns formed and located internally in subsequently produced and abutting sand mould parts. However, although the achieved alignment of the produced and abutting sand mould parts may in fact be very exact, inspection of the final castings may nevertheless indicate a small misalignment of for instance 1/10 millimetre in a certain direction. This misalignment may occur during or after the pouring process as a result of the hot melted metal being poured into the sand moulds composed by sand mould parts. In such a case, a set point of 1/10 millimetre in the opposite direction of said certain direction may be set in order to compensate for the actual misalignment. However, it is also possible that a small misalignment is a result of tolerances of the pattern plate, the detection system, or something else. In the case that a small misalignment relates to a specific pattern plate, a register may be kept with suitable set points for specific pattern plates.

In an embodiment, the sand moulding machine includes a register of suitable set points for a desired alignment of patterns formed in produced sand mould parts and/or of suitable set points for a desired rotational position of patterns formed in produced sand mould parts corresponding to a number of different pattern plates, and the input device is adapted to receive identification corresponding to a specific pattern plate. Thereby, the control system may more or less automatically receive a suitable setpoint for a specific pattern late from the register. For instance, an operator may input a serial number of the pattern plate, or the sand moulding machine may be provided with for instance a bar code scanner in order to identify the specific pattern plate.

In an embodiment, the control system is adapted to monitor and record in a register relevant sets of corresponding control values such as detected values relating to alignment and rotational position of patterns formed in produced sand mould parts and/or controlled values relating to transverse and/or rotational compaction positions for said at least one pattern plate and/or a maximum deviation for the alignment of the patterns formed in the produced sand mould parts along the longitudinal direction of the moulding chamber and/or a maximum deviation for the difference in rotational position of two opposed patterns formed in the same produced sand mould part. Thereby, a register of data suitable for improvement of the control system and for the tracking of errors may be maintained. Some data may directly be used by the control system at a later stage. For instance, it is possible to register the position of guiding pins of chamber end walls, as illustrated in FIGS. 25-27.

In an embodiment, the control system is adapted to read from said register control values related to a specific pattern plate such as suitable initial values for transverse and/or rotational compaction positions and/or such as a maximum deviation for the alignment of the patterns formed in the produced sand mould parts along the longitudinal direction of the moulding chamber and/or such as a maximum deviation for the difference in rotational position of two opposed patterns formed in the same produced sand mould part. Thereby, suitable and useful data relating to specific pattern plates may be retrieved from said register by the control system in order to optimise the control procedure. Said suitable and useful data may have been recorded manually in the register or may have been recorded by the control system during a previous manufacturing process in which the same pattern plate or plates was or were used. For instance, it is possible to read where the position of the above guiding pins has been in the past, i.e. in previous manufacturing process and use the best set of data based on such previous manufacturing process to optimise the control procedure.

In an embodiment, the detection system is arranged at a certain distance in the longitudinal direction of the moulding chamber from a discharge end of the moulding chamber, the sand moulding machine is adapted to produce sand mould parts having a certain length, so that a maximum number of compacted sand mould parts may be arranged in aligned and mutually abutting configuration along the path of travel between the discharge end of the moulding chamber and the detection system, the control system is adapted to control said actuator or actuators in such a way that when a specific transverse compaction position or a specific rotational compaction position has been adjusted by means of an actuator, that specific transverse compaction position or that specific rotational compaction position is maintained until at least a number of compacted sand mould parts corresponding at least substantially to said maximum number have been produced, before that compaction position is adjusted again. Thereby, it may be ensured that a compaction position is not adjusted before relevant control data have been detected and thereby a more robust control may be ensured.

In an embodiment, the control system is adapted to calculate said maximum number of compacted sand mould parts on the basis of the position of the detection system and on the basis of detected data relating to the certain length of the produced sand mould parts.

In an embodiment, the at least one reference pattern block includes a face having a tangent varying in the longitudinal direction of the moulding chamber and being adapted to form a corresponding reference pattern including a pattern face having a tangent varying in a corresponding longitudinal direction of the sand mould part, the non-contact detection system is adapted to detect the position of a number of different points distributed over the pattern face of the reference pattern in the longitudinal direction of the sand mould part, and the tangent in the longitudinal direction of the sand mould part is different between at least two of said points. Thereby, based on the detection of the position of a number of different points distributed over the pattern face of the reference pattern, the position and orientation of a known curve representing the pattern face may be determined or estimated, and on the basis thereof, the position or positions of one or more reference points for said known curve may be determined or estimated. The position of such reference points may be compared to the ideal or theoretic position of the reference points. Thereby, mutual misalignment of adjacent sand mould parts may be detected very accurately. Furthermore, among other parameters, the width of a possible gap between adjacent sand mould parts, mould expansion and mould dimensions may be detected by this arrangement. It may thereby be assessed whether the actual situation is acceptable or not.

In an embodiment, the at least one reference pattern block includes a face having a tangent varying in a height direction of the moulding chamber and being adapted to form a corresponding reference pattern including a pattern face having a tangent varying in a corresponding height direction of the sand mould part, in that the non-contact detection system is adapted to detect the position of a number of different points distributed over the pattern face of the reference pattern in the height direction of the sand mould parts, and in that the tangent in the height direction of the sand mould parts is different between at least two of said points. Thereby, by means of a single reference pattern block, the actual three-dimensional position of a point in a corner of a sand mould part may be determined.

In an embodiment, the at least one reference pattern block includes a first face part having a first tangent at a first position in the longitudinal direction of the moulding chamber and a second face part having a second tangent at a second position in the longitudinal direction of the moulding chamber, the second tangent is different from the first tangent, the first and second face parts are adapted to form a corresponding reference pattern including a first pattern face part having a first pattern tangent at a first position in the longitudinal direction of the sand mould part and a second pattern face part having a second pattern tangent at a second position in the longitudinal direction of the sand mould part, the second pattern tangent is different from the first pattern tangent, and the non-contact detection system is adapted to detect the position of a number of different points distributed at least substantially evenly over both the first and the second pattern face part of the reference pattern in the longitudinal direction of the sand mould part.

In an embodiment, the at least one reference pattern block includes a third face part having a third tangent at a third position in the height direction of the moulding chamber and a fourth face part having a fourth tangent at a fourth position in the height direction of the moulding chamber, wherein the fourth tangent is different from the third tangent, wherein the third and fourth face parts are adapted to form a corresponding reference pattern including a third pattern face part having a third pattern tangent at a third position in the height direction of the sand mould part and a fourth pattern face part having a fourth pattern tangent at a fourth position in the height direction of the sand mould part, wherein the fourth pattern tangent is different from the third pattern tangent, and in that the non-contact detection system is adapted to detect the position of a number of different points distributed at least substantially evenly over both the third and the fourth pattern face part of the reference pattern in the height direction of the sand mould part.

In an embodiment, the at least one reference pattern block includes a spherically symmetric face. The centre of the corresponding spherically symmetric pattern face of the reference pattern may serve as a reference point for the reference pattern.

In an embodiment, the at least one reference pattern block includes a set of at least two flat faces following one after the other in the longitudinal direction of the moulding chamber and being adapted to form a corresponding reference pattern including a set of at least two flat surfaces following one after the other in the corresponding longitudinal direction of the sand mould part, wherein each flat face is arranged at an oblique angle to another one of the flat faces. Thereby, based on the measurement of the varying distance to the reference pattern, the position and orientation of straight lines representing each of the at least two flat surfaces may be determined, and on the basis thereof, the position or positions of one or more intersection points between such straight lines may be determined. The position of such intersection points may be compared to the ideal or theoretic position of the intersection points. Thereby, mutual misalignment of adjacent sand mould parts may be detected very accurately. Furthermore, among other parameters, the width of a possible gap between adjacent sand mould parts, mould expansion and mould dimensions may be detected by this arrangement.

In an embodiment, each of said at least two flat faces forms an oblique angle with the longitudinal direction of the moulding chamber. Thereby, the accuracy of the detected parameters may be improved, as the flat surfaces of the reference pattern may be better released from the reference pattern block and may therefore be formed more accurately in the sand mould part.

In an embodiment, the oblique angle between two flat faces measured externally of the reference pattern block is in the range from 95 to 175 degrees or in the range from 185 to 265 degrees. Thereby, the accuracy of the detected parameters may be further improved, as the flat surfaces of the reference pattern may be even better released from the reference pattern block and may therefore be formed more accurately in the sand mould part.

In an embodiment, the oblique angle between two flat surfaces measured externally of the sand mould part is in the range from 115 to 155 degrees or in the range from 205 to 245 degrees. Thereby, the accuracy of the detected parameters may be even further improved, as the flat surfaces of the reference pattern may be even better released from the reference pattern block and may therefore be formed more accurately in the sand mould part.

In an embodiment, the oblique angle between two flat surfaces measured externally of the sand mould part is in the range from 125 to 145 degrees or in the range from 215 to 235 degrees. Thereby, the accuracy of the detected parameters may be optimised, as the flat surfaces of the reference pattern may be even better released from the reference pattern block and may therefore be formed more accurately in the sand mould part.

In an embodiment, the non-contact detection system includes at least one electro-optical sensor unit.

In an embodiment, the non-contact detection system includes at least two electro-optical sensor units, and each electro-optical sensor unit is adapted to detect the position of a number of points located on a pattern face of a respective reference pattern on a compacted sand mould parts. Thereby, a higher accuracy may be obtained, because each electro-optical sensor unit may be dedicated to or focused on a specific reference pattern.

In an embodiment, the electro-optical sensor units are arranged in mutually fixed positions, preferably by means of a boom or frame. Thereby, an even higher accuracy may be obtained, because each electro-optical sensor unit may be accurately positioned in relation to the other electro-optical sensor units.

In an embodiment, the non-contact detection system includes at least one digital camera.

In an embodiment, the non-contact detection system includes at least one 3D scanner.

In an embodiment, the non-contact detection system includes a laser-based illumination system adapted to form an elongated light beam forming an illuminated line on the pattern face of the reference pattern. Thereby, by means of an electro-optical sensor unit, such as a camera, directed at the pattern face at a different angle than that of the elongated light beam, the position and distorted form of the illuminated line on the pattern face may be compared with a theoretic form. Thereby, the position and orientation of a known curve representing the pattern face may be determined or estimated, and on the basis thereof, the position or positions of one or more reference points for said known curve may be determined or estimated.

In an embodiment, the laser-based illumination system is adapted to form the elongated light beam by means of a prism.

In an embodiment, the non-contact detection system includes a laser-based illumination system adapted to sweep a light beam along a line on the pattern face of the reference pattern. Thereby, the above-mentioned advantages of an elongated light beam forming an illuminated line on the pattern face of the reference pattern may be obtained without a prism.

In an embodiment, the non-contact detection system includes a first laser-based illumination system adapted to form a first elongated light beam forming a first illuminated line on the pattern face of the reference pattern, wherein the non-contact detection system includes a second laser-based illumination system adapted to form a second elongated light beam forming a second illuminated line on the pattern face of the reference pattern, said first and second lines extending in the longitudinal direction of the sand mould part, and wherein the second elongated light beam forms an angle of preferably 90 degrees with the first elongated light beam. Thereby, by means of a single reference pattern block, the actual three-dimensional position of a point in a corner of a sand mould part may be determined.

In an embodiment, the non-contact detection system includes a non-contact distance measuring device.

In an embodiment, the non-contact detection system includes a non-contact distance measuring device in the form of a laser-based distance sensor. Thereby, precise measurements may be obtained in an economic way.

In an embodiment, the non-contact distance measuring device is arranged rotatably and thereby is adapted to perform distance measurements to a number of points distributed along a line on the pattern face of the reference pattern when the sand mould part is arranged stationarily. Thereby, measurements may be performed without a linear displacement between the non-contact distance measuring device and the pattern face of the reference pattern.

In an embodiment, a computer system is adapted to receive the detected positions of a number of points located on a pattern face of the reference pattern of the sand mould part, the computer system is adapted to perform curve fitting on the basis of said received detected positions and thereby estimate the respective position of a curve in a coordinate system, the curve representing the pattern face of the reference pattern seen in cross-section, and wherein the computer system is adapted to calculate the position or positions of one or more reference points related to the curve. Thereby, the position or positions of one or more reference points related to the curve may be automatically determined. The position of such reference points may be automatically compared to the ideal or theoretic position of the reference points.

In an embodiment, the non-contact distance measuring device is adapted to measure a varying distance to the reference patterns of the sand mould parts during a relative displacement in a displacement direction between the compacted sand mould parts and the non-contact distance measuring device, and said displacement direction corresponds to the longitudinal direction of the sand mould part.

In an embodiment, the non-contact distance measuring device is arranged to measure a distance in a direction at right angles to the displacement direction. Thereby, calculations in an associated computer system may be simplified.

In an embodiment, at least one of the reference pattern blocks is arranged to form a reference pattern in a corner of a sand mould part, said reference pattern includes a first set of at least two flat surfaces following one after the other in the longitudinal direction of the moulding chamber and being arranged at right angles to the chamber top wall, each flat surface of the first set is arranged at an oblique angle to another one of the flat surfaces of the first set, said reference pattern includes a second set of at least two flat surfaces following one after the other in the longitudinal direction of the moulding chamber and being arranged at right angles to the chamber side walls, each flat surface of the second set is arranged at an oblique angle to another one of the flat surfaces of the second set, a first non-contact distance measuring device is arranged to measure the varying distance to the reference pattern as a result of the at least two flat surfaces of the first set passing relatively the non-contact distance measuring device in succession during the relative displacement in the displacement direction between the compacted sand mould parts and the non-contact distance measuring device, and a second non-contact distance measuring device is arranged to measure the varying distance to the reference pattern as a result of the at least two flat surfaces of the second set passing relatively the non-contact distance measuring device in succession during the relative displacement in the displacement direction between the compacted sand mould parts and the non-contact distance measuring device. Thereby, by means of a single reference pattern block, the actual three-dimensional position of a point in a corner of a sand mould part may be determined.

In an embodiment, the first non-contact distance measuring device is arranged to measure a distance in a first measuring direction, and the second non-contact distance measuring device is arranged to measure a distance in a second measuring direction being different from the first measuring direction. Thereby data may be available for positioning in the three-dimensional space.

In a structurally particularly advantageous embodiment, the reference pattern block has the form of a fourth of an element combined from at least two truncated square pyramids fitted on top of each other, the top of a lower positioned truncated square pyramid matches the base of a higher positioned truncated square pyramid, and said element has been parted along its centreline and through the symmetry lines of adjacent lateral surfaces of the truncated square pyramids in order to form said fourth.

In an embodiment, all faces of the reference pattern block intended to contact sand mould parts are formed with a draft angle in relation to the longitudinal direction of the moulding chamber. Thereby, the accuracy of the detected parameters may be improved, as all faces of the reference pattern may be better released from the reference pattern block and therefore the flat surfaces of the reference pattern may be formed more accurately in the sand mould part.

In an embodiment, a computer system is adapted to receive a number of distance measurements from the non-contact distance measuring device during the relative displacement in the displacement direction between the compacted sand mould parts and the non-contact distance measuring device, the computer system is adapted to perform curve fitting on the basis of said received distance measurements and thereby estimate the respective positions of a number of straight lines in a coordinate system, each straight line representing a respective one of the at least two flat surfaces of the reference pattern seen in cross-section, and wherein the computer system is adapted to calculate the position or positions of one or more intersection points between such straight lines. Thereby, the position or positions of one or more intersection points between such straight lines may be automatically determined. The position of such intersection points may be automatically compared to the ideal or theoretic position of the intersection points.

In an embodiment, the computer system is adapted to perform curve fitting and thereby estimate the respective positions of the number of straight lines based additionally on measurements of the relative position between the compacted sand mould parts and the non-contact distance measuring device during the relative displacement in the displacement direction between the compacted sand mould parts and the non-contact distance measuring device. Thereby, the respective positions of the number of straight lines may be estimated by curve fitting even if the speed of advancement in the conveying direction of the compacted sand mould parts is not constant.

In an embodiment, a position sensor is adapted to perform the measurements of the relative position between the compacted sand mould parts and the non-contact distance measuring device, and wherein the position sensor has the form of an absolute, non-contact position sensor working according to the magnetostrictive principle.

In a structurally particularly advantageous embodiment, a set including a number of non-contact distance measuring devices is mounted on a measuring boom at least partially surrounding the path of travel of the compacted sand mould parts, and the set includes at least a non-contact distance measuring device arranged to measure a distance in a first direction and a non-contact distance measuring device arranged to measure a distance in a second direction being different from the first direction.

In an embodiment, a conveyor is adapted to advance the compacted sand mould parts along the path of travel in order to achieve relative displacement in the displacement direction between the compacted sand mould parts and the non-contact distance measuring device. Thereby, said relative displacement necessary for the measurement of a distance by means of the non-contact distance measuring device may be achieved by means of a conveyor, which may anyway be necessary for transporting the compacted sand mould parts along the path of travel. Thereby, a separate device for displacing the non-contact distance measuring device may be avoided.

In an embodiment, the non-contact distance measuring device is arranged displaceably in order to achieve relative displacement in the displacement direction between the compacted sand mould parts and the non-contact distance measuring device. Thereby, said relative displacement necessary for the measurement of a distance by means of the non-contact distance measuring device may be achieved even if the compacted sand mould parts stand still and are not conveyed. Additionally, in the case of a sand moulding machine working according to the match plate technique, two sand mould parts may be positioned on top of each other to form a complete sand mould on a conveyor, and the non-contact distance measuring device may be displaced in the vertical direction in order to achieve said relative displacement. In this case, said relative displacement is in a direction, which is not a conveying direction of the sand mould parts.

In an embodiment, each of the chamber end walls is provided with a pattern plate having a pattern adapted to form a pattern in a sand mould part, and a conveyor is adapted to advance a number of compacted sand mould parts in aligned and mutually abutting configuration along a path of travel in a conveying direction corresponding to the longitudinal direction of the moulding chamber. Thereby, the sand moulding machine may work according to the vertical sand flaskless moulding technique such as the DISAMATIC (Registered Trademark).

In an embodiment, the non-contact distance measuring device is arranged stationarily, a position sensor is adapted to perform the measurements of the relative position between the compacted sand mould parts and the non-contact distance measuring device in the form of the position in the conveying direction of the compacted sand mould parts, and the position sensor is coupled to a so-called Automatic Mould Conveyor (AMC), a so-called Precision Mould Conveyor (PMC) or a so-called Synchronized Belt Conveyor (SBC).

In an embodiment, a set of non-contact distance measuring devices is arranged along the path of travel of the compacted sand mould parts, the set includes two non-contact distance measuring devices arranged to measure a distance in an at least substantially vertical direction and a distance in an at least substantially horizontal direction, respectively, to a reference pattern in an upper left corner of a sand mould part, two non-contact distance measuring devices arranged to measure a distance in an at least substantially vertical direction and a distance in an at least substantially horizontal direction, respectively, to a reference pattern in an upper right corner of a sand mould part, one non-contact distance measuring device arranged to measure a distance in an at least substantially horizontal direction to a reference pattern at or above a lower left corner of a sand mould part, and one non-contact distance measuring device arranged to measure a distance in an at least substantially horizontal direction to a reference pattern at or above a lower right corner of a sand mould part. Thereby, vertical, lateral and rotational mutual misalignment and the width of a possible gap between adjacent mould sections may be detected very accurately. Furthermore, among other parameters, the width of a possible gap between adjacent mould sections, mould expansion and mould dimensions may be detected by this arrangement. Nevertheless, by this arrangement a complicated arrangement of non-contact distance measuring devices beneath the path of travel of the compacted sand mould parts may be avoided.

In an embodiment, a further non-contact distance measuring device is arranged to measure a distance obliquely in an upward or downward direction to the reference pattern at or above a lower left corner of a sand mould part, and a further non-contact distance measuring device is arranged to measure a distance obliquely in an upward or downward direction to the reference pattern at or above a lower right corner of a sand mould part. Thereby, vertical, lateral and rotational mutual misalignment and the width of a possible gap between adjacent mould sections may be detected even more accurately. Nevertheless, also by this arrangement a complicated arrangement of non-contact distance measuring devices beneath the path of travel of the compacted sand mould parts may be avoided, because said further non-contact distance measuring devices may in oblique direction so to say see flat faces of the reference pattern facing in downwards or upwards direction.

In an embodiment, two moulding chambers are separated by means of a match plate, the sand moulding machine is adapted to simultaneously compress two sand mould parts in the respective two moulding chambers and subsequently remove the match plate and position said two sand mould parts on top of each other to form a complete sand mould, and the non-contact distance measuring device is arranged to measure the varying distance to the reference patterns of said two sand mould parts positioned on top of each other.

In an embodiment, the sand moulding machine is adapted to position said two sand mould parts on top of each other and subsequently press the upper one of said two sand mould parts out from its respective moulding chamber, and the non-contact distance measuring device is arranged to measure the varying distance to the reference patterns of said two sand mould parts subsequently to pressing the upper one of said two sand mould parts out from its respective moulding chamber, but before placing said two sand mould parts on a conveying surface of a conveyor. Thereby, the movement performed by the sand moulding machine of said two sand mould parts may be utilized for achieving the required relative displacement in a displacement direction between the compacted sand mould parts and the non-contact distance measuring device. Thereby, a separate device for displacing the non-contact distance measuring device may be avoided.

In an embodiment, the sand moulding machine includes a frame positioning device for positioning a holding frame around said two sand mould parts positioned on top of each other and positioned on a conveying surface of a conveyor, and the non-contact distance measuring device is arranged to measure the varying distance to the reference patterns of said two sand mould parts at a position along the path of travel of the compacted sand mould parts before and/or after the frame positioning device. It may be of interest detecting whether the action of positioning a holding frame around said two sand mould parts positioned on top of each other may displace the sand mould parts mutually.

In an embodiment, the sand moulding machine includes a frame positioning device for positioning a holding frame around said two sand mould parts positioned on top of each other and positioned on a conveying surface of a conveyor, the non-contact distance measuring device is arranged to measure the varying distance to the reference patterns of said two sand mould parts at a position along the path of travel of the compacted sand mould parts at or after the frame positioning device, and the holding frame has an opening through which the non-contact distance measuring device is adapted to measure the varying distance to the reference patterns of said two sand mould parts. Thereby, it may be possible to perform distance measurement during or after positioning the holding frame around said two sand mould parts. If the distance measurement is performed during said positioning the holding frame, the non-contact distance measuring device may even be mounted on and displaced by the frame positioning device.

The present invention further relates to a foundry production line including a sand moulding machine as described above, wherein a melt pouring device is adapted for automatic positioning along the path of travel in the conveying direction, and wherein a computer system is adapted to control the position of the melt pouring device on the basis of calculated positions of at least two intersection points between straight lines associated with a number of sand mould parts positioned between the sand moulding machine and the melt pouring device. Thereby, the melt-pouring device may be accurately positioned in relation to the pouring opening in a sand mould formed by two adjacent sand mould parts, even if the individual dimensions of the sand mould parts positioned between the sand moulding machine and the melt-pouring device vary throughout the process.

In an embodiment, a set including a number of non-contact distance measuring devices is arranged adjacent the path of travel of the compacted sand mould parts just after the sand moulding machine. Thereby, mutual misalignment of adjacent mould sections and other parameters as mentioned above resulting from the sand moulding process may be detected.

In an embodiment, a set including a number of non-contact distance measuring devices is arranged adjacent the path of travel of the compacted sand mould parts just before a melt pouring device. Thereby, mutual misalignment of adjacent mould sections and other parameters as mentioned above resulting from the sand moulding process and resulting from the conveying process may be detected. By comparing parameters detected by a set of non-contact distance measuring devices arranged just after the sand moulding machine with parameters detected by a set of non-contact distance measuring devices arranged just before a melt-pouring device, the parameters related to the conveying process may be detected.

In an embodiment, a set including a number of non-contact distance measuring devices is arranged adjacent the path of travel of the compacted sand mould parts after a melt pouring device. Thereby, mutual misalignment of adjacent mould sections and other parameters as mentioned above resulting from the sand moulding process, the conveying process and the melt pouring process may be detected. By comparing parameters detected by a set of non-contact distance measuring devices arranged after a melt pouring device with parameters detected by a set of non-contact distance measuring devices arranged just after the sand moulding machine and with parameters detected by a set of non-contact distance measuring devices arranged just before the melt pouring device, the parameters related to the melt pouring process may be detected.

In an embodiment, a computer system is adapted to control a melt pouring device to stop or prevent the pouring of melt in a single mould or a number of moulds on the basis of calculated positions of at least two intersection points between straight lines, and wherein said at least two intersection points are associated with two respective sand mould parts positioned in mutually abutting configuration. Thereby, it may be avoided that faulty castings are produced for instance as a result of mismatch between sand mould parts.

The present invention further relates to a method of producing sand mould parts, whereby a moulding chamber during a filling operation is filled with sand, and whereby the sand is subsequently compacted, the moulding chamber being formed by a chamber top wall, a chamber bottom wall, two opposed chamber side walls and two opposed chamber end walls, whereby the moulding chamber is filled with sand through at least one sand filling opening provided in a chamber wall, whereby a mould or mould part is provided with a pattern by means of at least one of the chamber end walls being provided with a pattern late having a pattern, and whereby sand is compacted inside the moulding chamber by displacing at least one of the chamber end walls in a longitudinal direction of the moulding chamber, whereby a reference pattern is formed in an external face of a sand mould part by means of at least one reference pattern block associated with and positioned in fixed relationship to at least one of the pattern plates, and whereby a position of a pattern face of the reference patterns of the sand mould parts is detected by means of a detection system arranged adjacent a path of travel of the compacted sand mould parts.

The method is characterised by that a transverse compaction position in which said at least one pattern plate is positioned during compaction of sand fed into the moulding chamber is adjusted by actuation of at least one actuator by means of which said at least one pattern plate is adjustable by displacement relative to a nominal position in at least one transverse direction of the longitudinal direction of the moulding chamber and/or in that a rotational compaction position in which said at least one pattern plate is positioned during compaction of sand fed into the moulding chamber is adjusted by actuation of at least one actuator by means of which said at least one pattern plate is adjustable by rotation relative to a nominal rotational position about at least one axis of rotation, and by controlling said actuator or actuators by means of a control system on the basis of successive position detections performed by the detection system of pattern faces of reference patterns of compacted sand mould parts traveling along said path of travel, thereby adaptively controlling the alignment of patterns formed in produced sand mould parts along the longitudinal direction of the moulding chamber and/or the rotational position of patterns formed in produced sand mould parts about corresponding axes of rotation.

In an embodiment, the control system adaptively controls said alignment and said rotational position of patterns formed in produced sand mould parts by, in a control cycle, firstly performing the following step:

controlling at least one actuator arranged to adjust a rotational compaction position by rotation of said at least one pattern plate about at least one axis of rotation extending transversely in relation to the longitudinal direction of the moulding chamber until a certain measure for the difference in rotational position of two opposed patterns formed in the same produced sand mould part about corresponding axes of rotation has been obtained, and secondly performing at least one of the following two steps:

controlling at least one actuator arranged to adjust a transverse compaction position by displacement of said at least one pattern plate in at least one transverse direction of the longitudinal direction of the moulding chamber until a certain measure for the alignment of the patterns formed in the produced sand mould parts along the longitudinal direction of the moulding chamber has been obtained, controlling at least one actuator arranged to adjust a rotational compaction position by rotation of said at least one pattern plate about the longitudinal direction of the moulding chamber until a certain measure for the rotational position of the patterns formed in the produced sand mould parts in relation to a corresponding nominal rotational position has been obtained.

Thereby, the above described features may be obtained.

In an embodiment, the control system initiates and completes said control cycle, in the case that during operation of the sand moulding machine it is detected that a maximum deviation for the alignment of the patterns formed in the produced sand mould parts along the longitudinal direction of the moulding chamber is exceeded, and/or in the case that during operation of the sand moulding machine it is detected that a maximum deviation for the difference in rotational position of two opposed patterns formed in the same produced sand mould part about said corresponding axes of rotation is exceeded. Thereby, the above described features may be obtained.

In an embodiment, a rotational compaction position in which said at least one pattern plate is positioned during compaction is adjusted by actuation of at least one actuator by means of which said at least one pattern plate is adjustable by rotation relative to a nominal rotational position about at least one axis of rotation extending transversely in relation to the longitudinal direction of the moulding chamber, and said actuator or actuators is/are controlled by means of a control system on the basis of successive position detections performed by the detection system of pattern faces of reference patterns of compacted sand mould parts traveling along said path of travel, thereby adaptively controlling the rotational position of patterns formed in produced sand mould parts about an axis parallel to said at least one axis extending transversely in relation to the longitudinal direction of the moulding chamber. Thereby, the above described features may be obtained.

In an embodiment, said at least one axis of rotation extending transversely in relation to the longitudinal direction of the moulding chamber includes a first axis and a second axis being different from the first axis. Thereby, the above described features may be obtained.

In an embodiment, said first axis is at least substantially at right angles to said second axis. Thereby, the above described features may be obtained.

In an embodiment, said first axis is at least substantially vertical and said second axis is at least substantially horizontal. Thereby, the above described features may be obtained.

In an embodiment, a rotational compaction position in which said at least one pattern plate is positioned during compaction is adjusted by actuation of at least one actuator by means of which said at least one pattern plate is adjustable by rotation relative to a nominal rotational position about an axis extending in the longitudinal direction of the moulding chamber, and said actuator or actuators is/are controlled by means of a control system on the basis of successive position detections performed by the detection system of pattern faces of reference patterns of compacted sand mould parts traveling along said path of travel, thereby adaptively controlling the rotational position of patterns formed in produced sand mould parts about an axis extending in the longitudinal direction of the moulding chamber. Thereby, the above described features may be obtained.

In an embodiment, a transverse compaction position in which said at least one pattern plate is positioned during compaction of sand fed into the moulding chamber is adjusted by displacement of said at least one pattern plate relative to a nominal position in a first transverse direction of the longitudinal direction of the moulding chamber and by displacement of said at least one pattern plate relative to a nominal position in a second transverse direction of the longitudinal direction of the moulding chamber, said second transverse direction being different from said first transverse direction. Thereby, the above described features may be obtained.

In an embodiment, each of the chamber end walls is provided with a respective pattern plate having a pattern adapted to form a pattern in a sand mould part, a transverse compaction position in which a first one of said pattern plates is positioned during compaction of sand fed into the moulding chamber is adjusted by displacement of said first pattern plate relative to a nominal position in a first transverse direction of the longitudinal direction of the moulding chamber, and a transverse compaction position in which a second one of said pattern plates is positioned during compaction of sand fed into the moulding chamber is adjusted by displacement of said second pattern plate relative to a nominal position in a second transverse direction of the longitudinal direction of the moulding chamber, said second transverse direction being different from said first transverse direction. Thereby, the above described features may be obtained.

In an embodiment, said first transverse direction is at least substantially at right angles to said second transverse direction. Thereby, the above described features may be obtained.

In an embodiment, said first transverse direction is at least substantially vertical and said second transverse direction is at least substantially horizontal. Thereby, the above described features may be obtained.

In an embodiment, a transverse direction of the longitudinal direction of the moulding chamber is a direction at least substantially at right angles to the longitudinal direction of the moulding chamber. Thereby, the above described features may be obtained.

In an embodiment, said at least one pattern plate is positioned relatively to the at least one of the chamber end walls by means of at least one guide pin engaging the at least one pattern plate and being displaced on said chamber end wall by means of at least one actuator. Thereby, the above described features may be obtained.

In an embodiment, at least one of said guide pins is displaced on said chamber end wall by means of at least one actuator in a first direction, and at least one of said guide pins is displaced on said chamber end wall by means of at least one actuator in a second direction being different from the first direction. Thereby, the above described features may be obtained.

In an embodiment, at least one of said guide pins is displaced on said chamber end wall by means of at least one actuator in at least one direction, and said at least one of said guide pins is arranged eccentrically on a disc driven rotationally by said at least one actuator so that the centre axis of the guide pin is parallel to, but displaced in relation to the central rotational axis of said disc. Thereby, the above described features may be obtained.

In an embodiment, said first direction is at least substantially at right angles to said second direction. Thereby, the above described features may be obtained.

In an embodiment, said first direction is at least substantially vertical and said second direction is at least substantially horizontal. Thereby, the above described features may be obtained.

In an embodiment, the detection system includes at least a first distance measuring device measuring a distance at least substantially in said first direction and at least a second distance measuring device measuring a distance at least substantially in said second direction. Thereby, the above described features may be obtained.

In an embodiment, the first and second distance measuring devices are non-contact distance measuring devices. Thereby, the above described features may be obtained.

In an embodiment, said at least one pattern plate is positioned relatively to the at least one of the chamber end walls by means of a first and a second guide pin each arranged in opposed side areas of said chamber end wall, the first guide pin is displaced on said chamber end wall by actuation of at least one first actuator in an at least substantially vertical direction, the second guide pin is displaced on said chamber end wall independently of the first guide pin by actuation of at least one second actuator in an at least substantially vertical direction, a transverse compaction position in which said at least one pattern plate is positioned during compaction of sand fed into the moulding chamber is adjusted by displacement of said at least one pattern plate in an at least substantially vertical direction by displacement of the first and the second guide pin in the same direction, and a rotational compaction position in which said at least one pattern plate is positioned during compaction is adjusted by actuation of said at least one first and second actuators by rotation of said at least one pattern plate about an axis extending in the longitudinal direction of the moulding chamber by a different displacement distance of the first and the second guide pin in the same direction or by displacement of the first and the second guide pin in opposed directions. Thereby, the above described features may be obtained.

In an embodiment, at least one of said guide pins is arranged freely displaceably within a certain limit on said chamber end wall in an at least substantially horizontal direction. Thereby, the above described features may be obtained.

In an embodiment, said at least one pattern plate is positioned relatively to the at least one of the chamber end walls by means of two guide pins each arranged in opposed side areas of said chamber end wall, each of said guide pins is displaced on said chamber end wall by actuation of at least one actuator in an at least substantially vertical direction, a first one of said guide pins is displaced on said chamber end wall by actuation of at least one actuator in an at least substantially horizontal direction, and a second one of said guide pins is arranged freely displaceably within a certain limit on said chamber end wall in an at least substantially horizontal direction. Thereby, the above described features may be obtained.

In an embodiment, said second one of said guide pins is arranged freely displaceably within a certain limit on said chamber end wall in an at least substantially horizontal direction by being mounted on a lower end of an at least substantially vertically arranged lever, and an upper end of the lever is pivotally arranged on said chamber end wall. Thereby, the above described features may be obtained.

In an embodiment, the upper end of the lever is pivotally arranged on a slide which is arranged displaceably on said chamber end wall by means of at least one actuator in an at least substantially vertical direction. Thereby, the above described features may be obtained.

In an embodiment, at least one of the chamber end walls is arranged swingable on a swing plate frame in relation to the moulding chamber about an at least substantially horizontal pivot axis extending at the upper part of said swingable chamber end wall, whereby, when said swingable chamber end wall is extending in an at least substantially vertical direction defining a rotational compaction position, a lower part of said swingable chamber end wall is abutting at least one pressure pad engaging between said swingable chamber end wall and the swing plate frame, and the at least one pressure pad is displaced relative to said swingable chamber end wall or the swing plate frame by actuation of at least one actuator in order to adjust said rotational compaction position. Thereby, the above described features may be obtained.

In an embodiment, at least one of the chamber end walls is arranged swingable on a swing plate frame in relation to the moulding chamber about an at least substantially horizontal pivot axis extending at the upper part of said swingable chamber end wall by means of a left and a right bearing, at least one of said bearings is displaced at least substantially in the longitudinal direction of the moulding chamber relative to the swing plate frame or at least substantially in a direction at right angles to the plane of extension of the swingable chamber end wall relative to the swingable chamber end wall by actuation of at least one actuator, and whereby, when said swingable chamber end wall is extending in an at least substantially vertical direction defining a rotational compaction position, a lower part of said swingable chamber end wall is abutting at least one pressure pad arranged on the swing plate frame. Thereby, the above described features may be obtained.

In an embodiment, at least one of the chamber end walls is arranged swingable on a swing plate frame in relation to the moulding chamber about an at least substantially horizontal pivot axis extending at the upper part of said swingable chamber end wall by means of a left and a right bearing, at least one of said bearings is displaced in an at least substantially vertical direction relative to the swing plate frame or relative said swingable chamber end wall by actuation of at least one actuator. Thereby, the above described features may be obtained.

In an embodiment, at least one of the chamber end walls is arranged swingable on a swing plate frame in relation to the moulding chamber about an at least substantially horizontal pivot axis extending at the upper part of said swingable chamber end wall by means of a left and a right bearing, and the relative position of said swingable chamber end wall in relation to the swing plate frame is adjusted at least substantially in the direction of said pivot axis by actuation of at least one actuator. Thereby, the above described features may be obtained.

In an embodiment, a transverse and/or rotational compaction position in which said at least one pattern plate is positioned during compaction of sand fed into the moulding chamber and which is adjustable by means of at least one actuator is additionally adjusted independently of said actuator by means of a manual adjusting mechanism. Thereby, the above described features may be obtained.

In an embodiment, the control system receives from an input device instructions regarding at least one initial value for the transverse and/or rotational compaction position in which said at least one pattern plate is to be positioned by means of at least one actuator as a starting point for subsequent control of said actuator by means of the control system. Thereby, the above described features may be obtained.

In an embodiment, the sand moulding machine includes a register of suitable initial values for transverse and/or rotational compaction positions of a number of different pattern plates, and the input device receives identification corresponding to a specific pattern plate. Thereby, the above described features may be obtained.

In an embodiment, the control system receives from an input device instructions regarding one or more set points for a desired alignment of patterns formed in the produced sand mould parts along the longitudinal direction of the moulding chamber and/or one or more set points for a desired rotational position of patterns formed in produced sand mould parts about at least one axis of rotation. Thereby, the above described features may be obtained.

In an embodiment, the sand moulding machine includes a register of suitable set points for a desired alignment of patterns formed in produced sand mould parts and/or of suitable set points for a desired rotational position of patterns formed in produced sand mould parts corresponding to a number of different pattern plates, and the input device receives identification corresponding to a specific pattern plate. Thereby, the above described features may be obtained.

In an embodiment, the control system monitors and records in a register relevant sets of corresponding control values such as detected values relating to alignment and rotational position of patterns formed in produced sand mould parts and/or controlled values relating to transverse and/or rotational compaction positions for said at least one pattern plate and/or a maximum deviation for the alignment of the patterns formed in the produced sand mould parts along the longitudinal direction of the moulding chamber and/or a maximum deviation for the difference in rotational position of two opposed patterns formed in the same produced sand mould part. Thereby, the above described features may be obtained.

In an embodiment, the control system reads from said register control values related to a specific pattern plate such as suitable initial values for transverse and/or rotational compaction positions and/or such as a maximum deviation for the alignment of the patterns formed in the produced sand mould parts along the longitudinal direction of the moulding chamber and/or such as a maximum deviation for the difference in rotational position of two opposed patterns formed in the same produced sand mould part. Thereby, the above described features may be obtained.

In an embodiment, the detection system is arranged at a certain distance in the longitudinal direction of the moulding chamber from a discharge end of the moulding chamber, the sand moulding machine is producing sand mould parts having a certain length, so that a maximum number of compacted sand mould parts are arranged in aligned and mutually abutting configuration along the path of travel between the discharge end of the moulding chamber and the detection system, the control system controls said actuator or actuators in such a way that when a specific transverse compaction position or a specific rotational compaction position has been adjusted by means of an actuator, that specific transverse compaction position or that specific rotational compaction position is maintained until at least a number of compacted sand mould parts corresponding at least substantially to said maximum number have been produced, before that compaction position is adjusted again. Thereby, the above described features may be obtained.

In an embodiment, the at least one reference pattern block forms a corresponding reference pattern including a pattern face having a tangent varying in a longitudinal direction of the sand mould part corresponding to the longitudinal direction of the moulding chamber, by that the non-contact detection system detects the position of a number of different points distributed over the pattern face of the reference pattern in the longitudinal direction of the sand mould part, and by that the tangent in the longitudinal direction of the sand mould part is different between at least two of said points. Thereby, the above described features may be obtained.

In an embodiment, the at least one reference pattern block forms a corresponding reference pattern including a pattern face having a tangent varying in a height direction of the sand mould part corresponding to a height direction of the moulding chamber, the non-contact detection system detects the position of a number of different points distributed over the pattern face of the reference pattern in the height direction of the sand mould parts, and by that the tangent in the height direction of the sand mould parts is different between at least two of said points. Thereby, the above described features may be obtained.

In an embodiment, the at least one reference pattern block forms a reference pattern including a first pattern face part having a first pattern tangent at a first position in the longitudinal direction of the sand mould part and a second pattern face part having a second pattern tangent at a second position in the longitudinal direction of the sand mould part, the second pattern tangent is different from the first pattern tangent, and the non-contact detection system detects the position of a number of different points distributed at least substantially evenly over both the first and the second pattern face part of the reference pattern in the longitudinal direction of the sand mould part. Thereby, the above described features may be obtained.

In an embodiment, the at least one reference pattern block forms a reference pattern including a third pattern face part having a third pattern tangent at a third position in a height direction of the sand mould part corresponding to a height direction of the moulding chamber and a fourth pattern face part having a fourth pattern tangent at a fourth position in the height direction of the sand mould part, whereby the fourth pattern tangent is different from the third pattern tangent, and whereby the non-contact detection system detects the position of a number of different points distributed at least substantially evenly over both the third and the fourth pattern face part of the reference pattern in the height direction of the sand mould part. Thereby, the above described features may be obtained.

In an embodiment, the at least one reference pattern block includes a spherically symmetric face. Thereby, the above described features may be obtained.

In an embodiment, the at least one reference pattern block forms a reference pattern including at least two flat surfaces following one after the other in the longitudinal direction of the moulding chamber, and whereby each flat surface is arranged at an oblique angle to another one of the flat surfaces. Thereby, the above described features may be obtained.

In an embodiment, each of said at least two flat faces forms an oblique angle with the longitudinal direction of the moulding chamber. Thereby, the above described features may be obtained.

In an embodiment, the oblique angle between two flat faces measured externally of the reference pattern block is in the range from 95 to 175 degrees or in the range from 185 to 265 degrees, preferably in the range from 115 to 155 degrees or in the range from 205 to 245 degrees, and most preferred in the range from 125 to 145 degrees or in the range from 215 to 235 degrees. Thereby, the above described features may be obtained.

In an embodiment, the non-contact detection system includes at least one electro-optical sensor unit. Thereby, the above described features may be obtained.

In an embodiment, the non-contact detection system includes at least two electro-optical sensor units, and whereby each electro-optical sensor unit detects the position of a number of points located on a pattern face of a respective reference pattern on a compacted sand mould parts. Thereby, the above described features may be obtained.

In an embodiment, the electro-optical sensor units are maintained in mutually fixed positions, preferably by means of a boom or frame. Thereby, the above described features may be obtained.

In an embodiment, the non-contact detection system includes at least one digital camera. Thereby, the above described features may be obtained.

In an embodiment, the non-contact detection system includes at least one 3D scanner. Thereby, the above described features may be obtained.

In an embodiment, the non-contact detection system includes a laser-based illumination system which forms an elongated light beam forming an illuminated line on the pattern face of the reference pattern. Thereby, the above described features may be obtained.

In an embodiment, the laser-based illumination system forms the elongated light beam by means of a prism. Thereby, the above described features may be obtained.

In an embodiment, the non-contact detection system includes a laser-based illumination system which sweeps a light beam along a line on the pattern face of the reference pattern. Thereby, the above described features may be obtained.

In an embodiment, the non-contact detection system includes a first laser-based illumination system which forms a first elongated light beam forming a first illuminated line on the pattern face of the reference pattern, whereby the non-contact detection system includes a second laser-based illumination system which forms a second elongated light beam forming a second illuminated line on the pattern face of the reference pattern, said first and second lines extending in the longitudinal direction of the sand mould part, and whereby the second elongated light beam forms an angle of preferably 90 degrees with the first elongated light beam. Thereby, the above described features may be obtained.

In an embodiment, the non-contact detection system includes a non-contact distance measuring device. Thereby, the above described features may be obtained.

In an embodiment, the non-contact detection system includes a non-contact distance measuring device in the form of a laser-based distance sensor. Thereby, the above described features may be obtained.

In an embodiment, the non-contact distance measuring device rotates and thereby performs distance measurements to a number of points distributed along a line on the pattern face of the reference pattern when the sand mould part is arranged stationarily. Thereby, the above described features may be obtained.

In an embodiment, a computer system receives the detected positions of a number of points located on a pattern face of the reference pattern of the sand mould part, whereby the computer system performs curve fitting on the basis of said received detected positions and thereby estimates the respective position of a curve in a coordinate system, the curve representing the pattern face of the reference pattern seen in cross-section, and whereby the computer system calculates the position or positions of one or more reference points related to the curve. Thereby, the above described features may be obtained.

In an embodiment, the non-contact distance measuring device measures a varying distance to the reference patterns of the sand mould parts during a relative displacement in a displacement direction between the compacted sand mould parts and the non-contact distance measuring device, and whereby said displacement direction corresponds to the longitudinal direction of the sand mould part. Thereby, the above described features may be obtained.

In an embodiment, the non-contact distance measuring device is measuring a distance in a direction at right angles to the displacement direction. Thereby, the above described features may be obtained.

In an embodiment, at least one of the reference pattern blocks forms a reference pattern in a corner of a sand mould part, whereby said reference pattern includes a first set of at least two flat surfaces following one after the other in the longitudinal direction of the moulding chamber and being arranged at right angles to the chamber top wall, each flat surface of the first set is arranged at an oblique angle to another one of the flat surfaces of the first set, whereby said reference pattern includes a second set of at least two flat surfaces following one after the other in the longitudinal direction of the moulding chamber and being arranged at right angles to the chamber side walls, each flat surface of the second set is arranged at an oblique angle to another one of the flat surfaces of the second set, whereby a first non-contact distance measuring device measures the varying distance to the reference pattern as a result of the at least two flat surfaces of the first set passing relatively the non-contact distance measuring device in succession during the relative displacement in the displacement direction between the compacted sand mould parts and the non-contact distance measuring device, and whereby a second non-contact distance measuring device measures the varying distance to the reference pattern as a result of the at least two flat surfaces of the second set passing relatively the non-contact distance measuring device in succession during the relative displacement in the displacement direction between the compacted sand mould parts and the non-contact distance measuring device. Thereby, the above described features may be obtained.

In an embodiment, the first non-contact distance measuring device is measuring a distance in a first measuring direction, and whereby the second non-contact distance measuring device is measuring a distance in a second measuring direction being different from the first measuring direction. Thereby, the above described features may be obtained.

In an embodiment, the reference pattern block has the form of a fourth of an element combined from at least two truncated square pyramids fitted on top of each other, the top of a lower positioned truncated square pyramid matches the base of a higher positioned truncated square pyramid, and said element has been parted along its centreline and through the symmetry lines of adjacent lateral surfaces of the truncated square pyramids in order to form said fourth. Thereby, the above described features may be obtained.

In an embodiment, all faces of the reference pattern block contacting sand mould parts are formed with a draft angle in relation to the longitudinal direction of the moulding chamber direction. Thereby, the above described features may be obtained.

In an embodiment, a computer system receives a number of distance measurements from the non-contact distance measuring device during the relative displacement in the displacement direction between the compacted sand mould parts and the non-contact distance measuring device, whereby the computer system performs curve fitting on the basis of said received distance measurements and thereby estimates the respective positions of a number of straight lines in a coordinate system, each straight line representing a respective one of the at least two flat surfaces of the reference pattern seen in cross-section, and whereby the computer system calculates the position or positions of one or more intersection points between such straight lines. Thereby, the above described features may be obtained.

In an embodiment, the relative position between the compacted sand mould parts and the non-contact distance measuring device is measured during the relative displacement in the displacement direction between the compacted sand mould parts and the non-contact distance measuring device, and whereby the computer system performs curve fitting and thereby estimates the respective positions of the number of straight lines based additionally on said measurements of the relative position between the compacted sand mould parts and the non-contact distance measuring device. Thereby, the above described features may be obtained.

In an embodiment, a position sensor performs the measurements of the relative position between the compacted sand mould parts and the non-contact distance measuring device, and the position sensor has the form of an absolute, non-contact position sensor working according to the magnetostrictive principle. Thereby, the above described features may be obtained.

In an embodiment, a set including a number of non-contact distance measuring devices is mounted on a measuring boom at least partially surrounding the path of travel of the compacted sand mould parts, and wherein the set includes at least a non-contact distance measuring device measuring a distance in a first direction and a non-contact distance measuring device measuring a distance in a second direction being different from the first direction. Thereby, the above described features may be obtained.

In an embodiment, a conveyor advances the compacted sand mould parts along the path of travel in order to achieve relative displacement in the displacement direction between the compacted sand mould parts and a non-contact distance measuring device. Thereby, the above described features may be obtained.

In an embodiment, a non-contact distance measuring device is displaced along the path of travel in order to achieve relative displacement in the displacement direction between the compacted sand mould parts and the non-contact distance measuring device. Thereby, the above described features may be obtained.

In an embodiment, each of the chamber end walls is provided with a pattern plate having a pattern adapted to form a pattern in a sand mould part, and wherein a conveyor advances a number of compacted sand mould parts in aligned and mutually abutting configuration along the path of travel in a conveying direction corresponding to the longitudinal direction of the moulding chamber. Thereby, the above described features may be obtained.

In an embodiment, a non-contact distance measuring device is arranged stationarily, a position sensor performs the measurements of the relative position between the compacted sand mould parts and the non-contact distance measuring device in the form of the position in the conveying direction of the compacted sand mould parts, and the position sensor is coupled to a so-called Automatic Mould Conveyor (AMC), a so-called Precision Mould Conveyor (PMC) or a so-called Synchronized Belt Conveyor (SBC). Thereby, the above described features may be obtained.

In an embodiment, a set of non-contact distance measuring devices is arranged along the path of travel of the compacted sand mould parts, whereby the set includes two non-contact distance measuring devices measuring a distance in an at least substantially vertical direction and a distance in an at least substantially horizontal direction, respectively, to a reference pattern in an upper left corner of a sand mould part, two non-contact distance measuring devices measuring a distance in an at least substantially vertical direction and a distance in an at least substantially horizontal direction, respectively, to a reference pattern in an upper right corner of a sand mould part one non-contact distance measuring device measuring a distance in an at least substantially horizontal direction to a reference pattern at or above a lower left corner of a sand mould part, and one non-contact distance measuring device measuring a distance in an at least substantially horizontal direction to a reference pattern at or above a lower right corner of a sand mould part. Thereby, the above described features may be obtained.

In an embodiment, a further non-contact distance measuring device measures a distance in an upward direction to the reference pattern at or above a lower left corner of a sand mould part, and a further non-contact distance measuring device measures a distance in an upward direction to the reference pattern at or above a lower right corner of a sand mould part. Thereby, the above described features may be obtained.

In an embodiment, two moulding chambers separated by means of a match plate during the filling operation are filled with sand, the sand moulding machine simultaneously compresses two sand mould parts in the respective two moulding chambers and subsequently removes the match plate and positions said two sand mould parts on top of each other thereby forming a complete sand mould, and the non-contact distance measuring device measures the varying distance to the reference patterns of said two sand mould parts positioned on top of each other. Thereby, the above described features may be obtained.

In an embodiment, the sand moulding machine performs the following steps in succession:

- positioning said two sand mould parts on top of each other.
- pressing the upper one of said two sand mould parts out from its respective moulding chamber,
- measuring by means of the non-contact distance measuring device the varying distance to the reference patterns of said two sand mould parts, and
- placing said two sand mould parts on a conveying surface of a conveyor.

Thereby, the above described features may be obtained.

In an embodiment, the sand moulding machine by means of a frame positioning device positions a holding frame around said two sand mould parts positioned on top of each other on a conveying surface of a conveyor, and whereby the non-contact distance measuring device measures the varying distance to the reference patterns of said two sand mould parts at a position along the path of travel of the compacted sand mould parts before and/or after positioning of the holding frame around said two sand mould parts. Thereby, the above described features may be obtained.

In an embodiment, the sand moulding machine by means of a frame positioning device positions a holding frame around said two sand mould parts positioned on top of each other on a conveying surface of a conveyor, whereby the non-contact distance measuring device measures the varying distance to the reference patterns of said two sand mould parts at a position along the path of travel of the compacted sand mould parts during or after positioning of the holding frame around said two sand mould parts, and whereby the non-contact distance measuring device measures the varying distance to said reference patterns through an opening formed in the holding frame. Thereby, the above described features may be obtained.

In an embodiment, a melt pouring device is automatically positioned along the path of travel in the conveying direction, and the computer system controls the position of the melt pouring device on the basis of a calculated position or positions of at least one reference point related to a curve associated with a sand mould part positioned between the sand moulding machine and the melt pouring device. Thereby, the above described features may be obtained.

In an embodiment, a set including a number of non-contact distance measuring devices is arranged adjacent the path of travel of the compacted sand mould parts at one or more of the following positions: just after the sand moulding machine, just before a melt pouring device and after a melt pouring device, preferably before or just after a position where the resulting castings are substantially solidified. Thereby, the above described features may be obtained.

In an embodiment, a computer system calculates positions of at least two reference points related to a curve, whereby said at least two reference points are associated with two respective sand mould parts positioned in mutually abutting configuration, and whereby the computer system controls a melt pouring device to stop the pouring of melt on the basis of calculated positions. Thereby, the above described features may be obtained.

The invention encompasses embodiments in which a set including a number of non-contact distance measuring devices is arranged adjacent the path of travel of the compacted sand mould parts. The location of such non-contact distance measuring devices is selected to detect any misalignments as early as possible so that the produced metal castings are as defect-free as possible and may thus be positioned at additional locations adjacent the path of travel of the compacted sand mould parts. Accordingly, in a more general embodiment, a set including a number of non-contact distance measuring devices is arranged adjacent the path of travel of the compacted sand mould parts and at any position before or after the melt pouring device.

As described above, the invention encompasses embodiments in which a set including a number of non-contact distance measuring devices is arranged adjacent the path of travel of the compacted sand mould parts. In an embodiment, one or more of the following positions may be selected: just after the sand moulding machine, just before a melt pouring device and after a melt pouring device. As used herein, the term "just after the sand moulding machine" means at a distance of 20-100 cm, preferably 30-60 cm such as 40 or 50 cm from the sand moulding machine, measured in the conveyor direction. It would be understood that at this position, compacted sand mould parts have been formed and constitute part of the string of moulds displaceable along the path of travel. As used herein, the term "just before a melt pouring device" means at a distance of 20-300 cm, preferably 100-200 cm, such as 150 cm from the melt pouring device. In other words, in the near vicinity of the melt pouring device. The melt pouring device can move, hence a very exact position is not possible.

In an embodiment, the position before the melt pouring device of a set including a number of non-contact measuring devices is at a point just after forming the compacted sand mould parts. It would be understood that such position corresponds to a location at the dividing surface of the two last half-sand mould parts in the string of sand mould parts. This enables early identification of potential significant defects.

In an embodiment, a first set including a number of non-contact measuring devices is at a point just after forming the compacted sand mould parts, i.e. at the dividing surface of the two last half-sand mould parts in the string of sand mould parts, as described above, a second set including a number of non-contact measuring devices is arranged just before a melt pouring device, and a third set including a number of non-contact measuring devices is arranged after a melt pouring device. This arrangement enables simultaneous detection of either defects occurring early in the manufacturing of the sand mould parts by virtue of the first set measuring at the contact point of the two last half-sand mould parts, i.e. at the dividing surface as described above, while the second set will allow detection of any defects occurring in the string of compacted sand mould parts before reaching the melt pouring device, and the third set will allow detection of any defects occurring in connection with the melt pouring. Therefore, it is possible to locate immediately at which point in e.g. the string of compact sand mould parts any defects take place.

In an embodiment, a set including a number of non-contact distance measuring devices is arranged adjacent the path of travel of the compacted sand mould parts, wherein one or more of the sand mould parts is left unfilled with melt from the melt pouring device. Preferably, 2 to 6 sand mould parts are left unfilled with melt from the melt pouring device, more preferably 3 to 5. Thereby, non-poured sand mould parts, i.e. containing no melt, are purposely provided which are not deformed or degenerated by the extreme heat generated due to the exposure to the hot melt during pouring. The melt pouring may result in undesired increase in size of the sand mould parts with concomitant rupture or splitting. The non-poured sand mould parts are defect-free and accordingly, higher accuracy is achieved when utilizing the non-contact measuring devices. Up to 500-600 sand mould parts per hour may pass and it has been found that 2 to 6 of these may be left unfilled with melt without impairing operation.

In an embodiment, one or more of the non-contact distance measuring devices comprise a shielding element, such shielding element preferably being arranged so that it at least covers the non-contact measuring devices when these are positioned before or after the melt pouring device. Suitably, the surface of the shield is arranged perpendicularly to the light beam of the non-contact measuring device. The shielding element may be displaceable so that the light beam emitted from the non-contact distance measuring device is not blocked. This enables protection and thus longer lifetime of such measuring devices, since exposure to the extreme heat, in particular radiation heat from the sand mould parts being filled with melt, is significantly reduced. Moreover, it has been found that such shielding element protects also against dust and sand particles thereby providing even higher lifetime of the measuring devices.

In an embodiment, one or more the non-contact distance measuring devices are cooled, at least intermittently with a cooling device, such as any device cooperating with an air compressor, e.g. an air pressure line. This also enables protection and thus longer lifetime of the measuring devices, since the risk of heat, in particular radiation heat from the sand mould parts being filled with melt, is significantly reduced.

In an embodiment, the thickness of sand mould parts is adjusted when a non-contact measuring device directs a light beam on the compacted sand mould part at a position which coincides with the dividing surface of the two last half-sand mould parts, i.e. at the boundary of such half-sand mould parts. Such situations may take place when the conveyor is in a standstill and/or due to changes over time of the precise position of the sand moulds conveyed. This results in undesired measuring problems due to small displacements with respect to the non-contacting measuring devices. Such small displacements occur because in practice the mould string cannot be at a total standstill thus causing the problem of registering misalignments or defects that are actually not there. By adjusting the thickness of the sand moulds produced (in the sand mould chamber), it is possible to avoid the light beam coinciding with the dividing surface of the half-sand mould parts. Thereby the problem of recording and correcting defects based on potentially wrong measurements of defects or misalignments is avoided.

In an embodiment, this problem may also be solved by providing at least two sets of non-contacting measuring devices in near proximity of one another corresponding to a distance lower than the thickness of a sand mould part. Accordingly, the one set of non-contacting measuring devices will never be able to direct a light beam on the compacted sand mould part at a position which coincides with the dividing surface of two half-sand mould parts.

In an embodiment, one or more displacing devices, such as pistons, are arranged at either side of the conveyor at a point corresponding to the last produced compacted sand mould part in the string and perpendicularly to the path of travel of the compacted sand mould parts for adjusting the position of the compacted sand mould parts in lateral direction, i.e. in horizontal direction yet perpendicular to the path of travel or conveying direction. This enables the compacted sand mould parts be pushed into the appropriate position by gentle lateral movement of the piston(s), thereby further adding to the accuracy of the sand moulding machine by improving the precision of the mould close up operation.

As described above, the sand moulding machine for the production of sand mould parts, the foundry production line including the sand moulding machine, or the method of producing sand mould parts comprises a control system.

In an embodiment, the control system is adapted to monitor and record in a register relevant sets of process parameter values, including at least one of sand injection time and sand injection pressure, for adjusting the process parameter values in dependency of the measured values in the measuring devices in order to bring deviations between measured and optimal values to zero. Thereby data related to the process parameter values during previous manufacturing steps may be stored, which enables using the best parameters from such previous steps to further improve accuracy by early detection of errors in the formation of the compacted sand mould parts. The above data are dependent on the measurements conducted along the path of travel of the compacted sand mould parts. It has been found that when sand is injected in the sand moulding machine, the sand injection time and sand injection pressure contribute to the shape of the compacted sand mould parts. For instance, low sand injection time may result in sand accumulating much more in the bottom compared to the top of the sand mould part, thus resulting in poor parallel alignment of the side faces of the sand mould parts, i.e. the side faces are not in parallel. By increasing the sand injection time based on data stored from a previous manufacturing step which result from measurements along the path of travel of the compacted sand mould parts, the amount of sand accumulated at the bottom and top of the sand mould part will be similar, thus rendering sand mould parts where the side faces are parallel upon compacting. Nearly totally symmetric compacted mould parts may thus be formed. Thereby, potential significant defects causing misalignments later may be corrected early in the manufacturing process.

Any of the above or below embodiments of the sand moulding machine, foundry production line and method of producing sand mould parts may be combined, for instance embodiments according to the foundry production line may be used together with one or more of the embodiments of the sand moulding machine, in particular with the sand moulding machine in its broadest embodiment.

The invention will now be explained in more detail below by means of examples of embodiments with reference to the very schematic drawing, in which FIG. 1 is a perspective view illustrating a foundry line including a sand moulding machine according to the invention, operating according to the vertical flaskless sand moulding technique;

Figure 2:
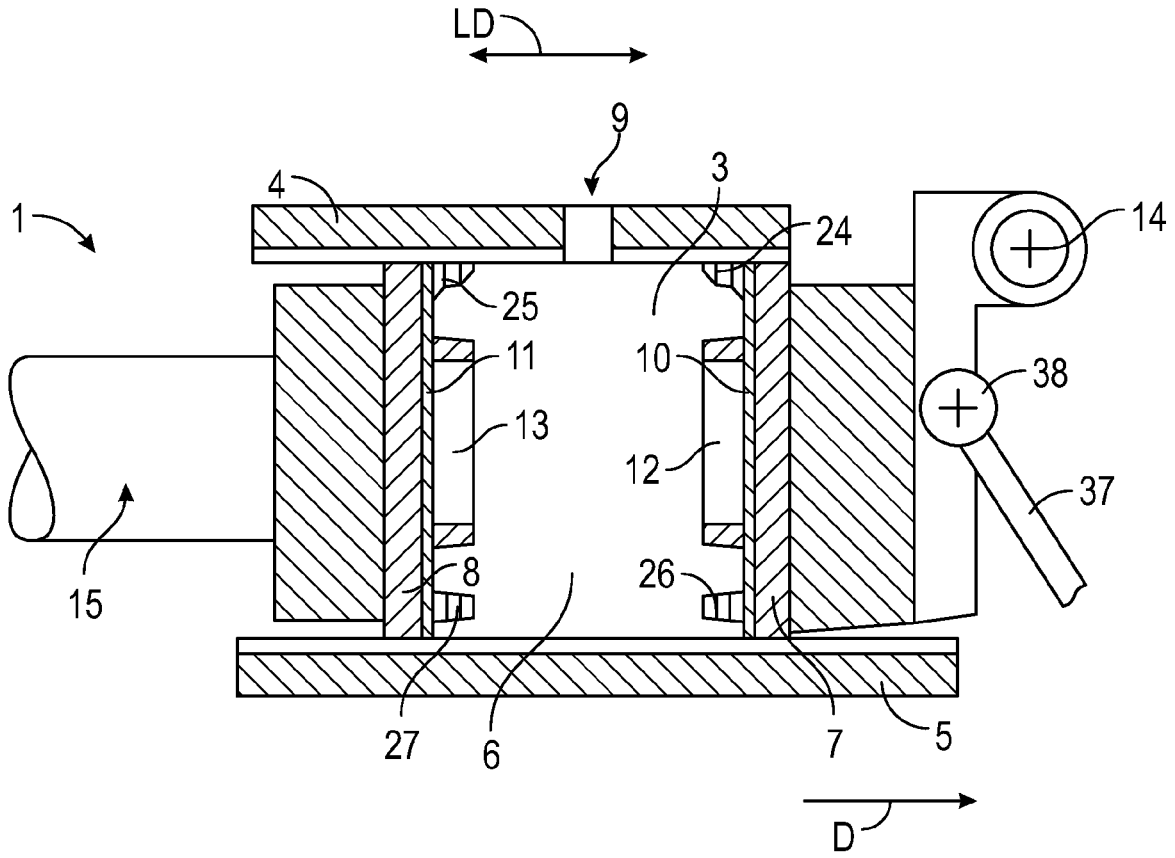
FIG. 2 is a vertical section through a sand moulding machine according to the invention.
Figure 3A:
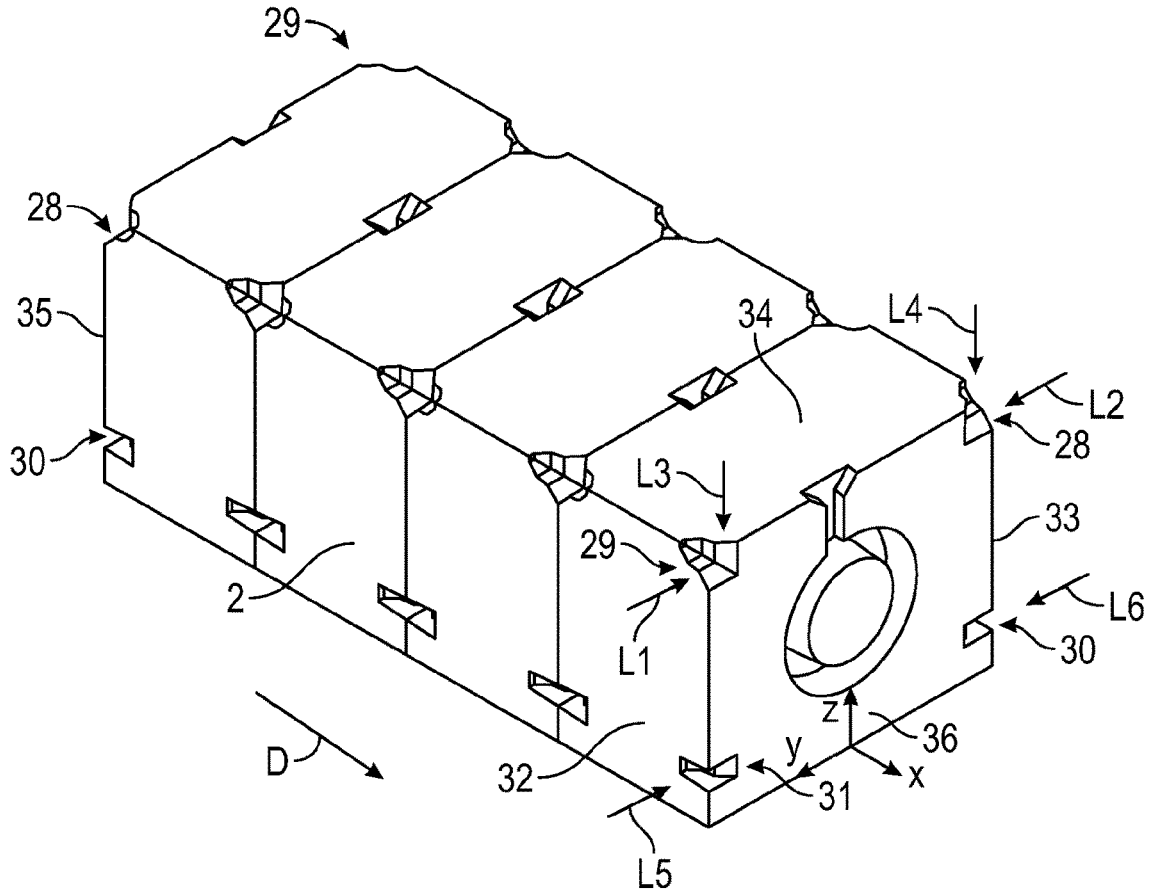
FIG. 3A is a perspective view of a number of compacted sand mould parts in aligned and mutually abutting configuration and provided with reference patterns according to the invention.
Figure 5:
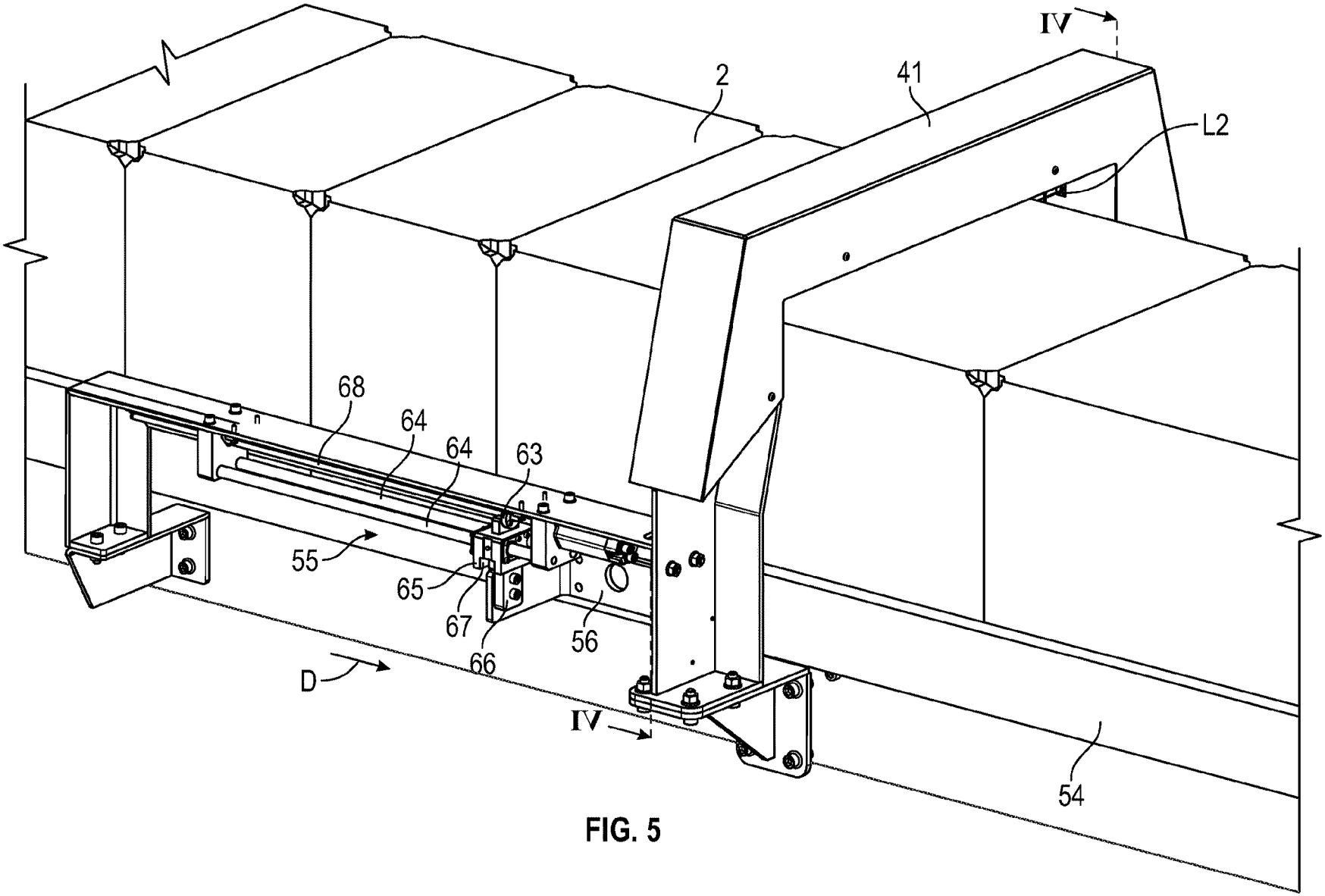
FIG. 5 is a perspective view of the Automatic Mould Conveyor illustrated in FIG. 4 conveying a string of compacted sand mould parts, whereby the Automatic Mould Conveyor is provided with a measuring boom and an associated position sensor.
Figure 8:
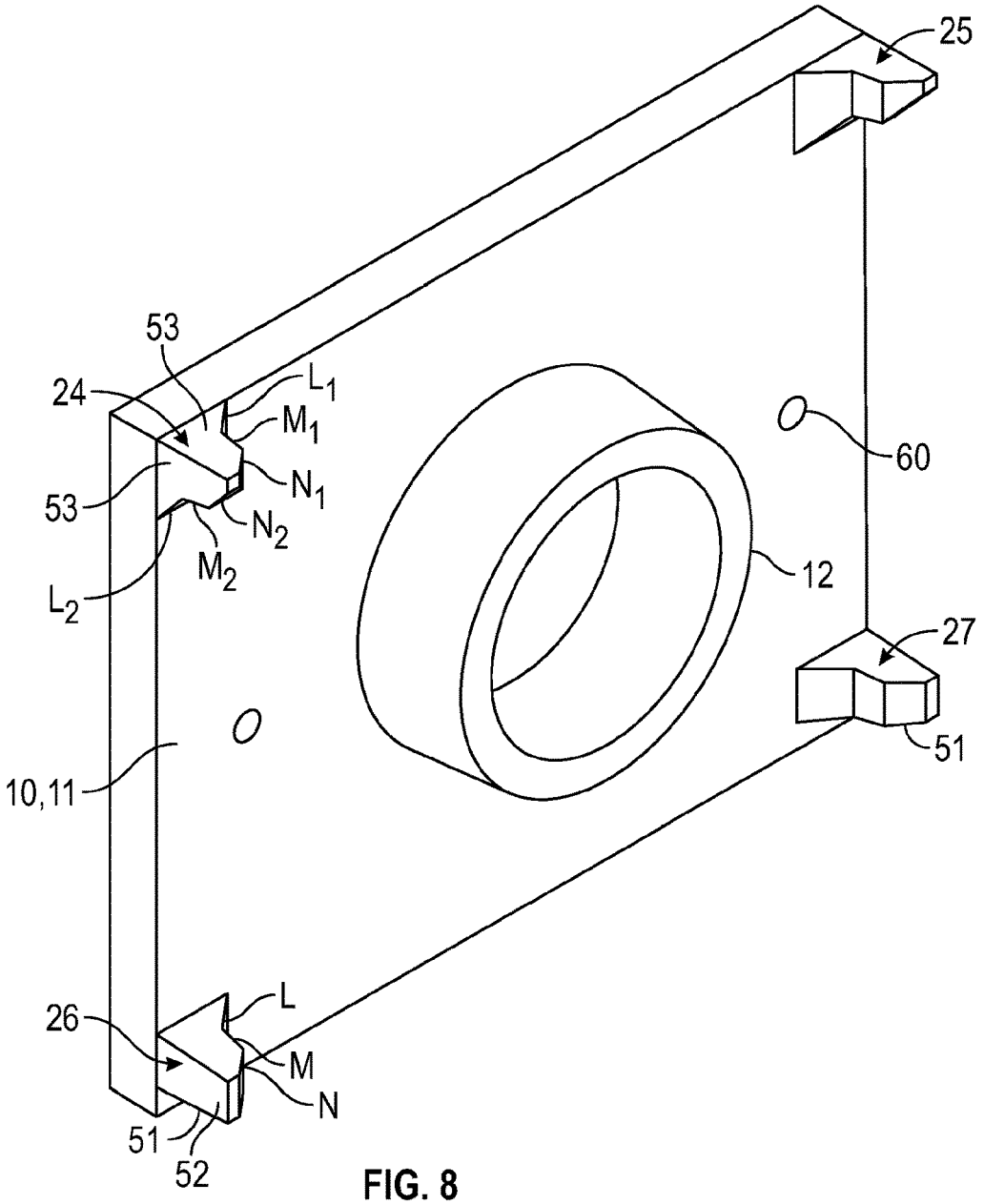
FIG. 8 is a perspective view of a pattern plate provided with corner reference pattern blocks at upper corners and side reference pattern blocks slightly above lower corners.
Figure 25:
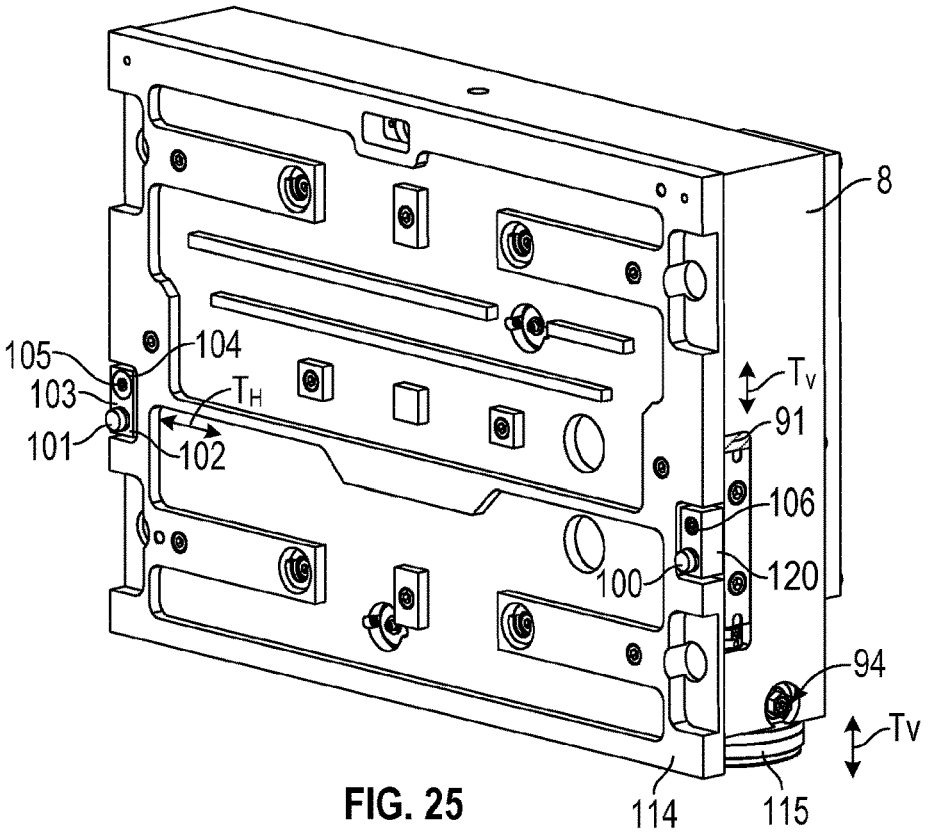
FIG. 25 is a perspective view illustrating a chamber end wall arranged displaceably.
Figure 26:
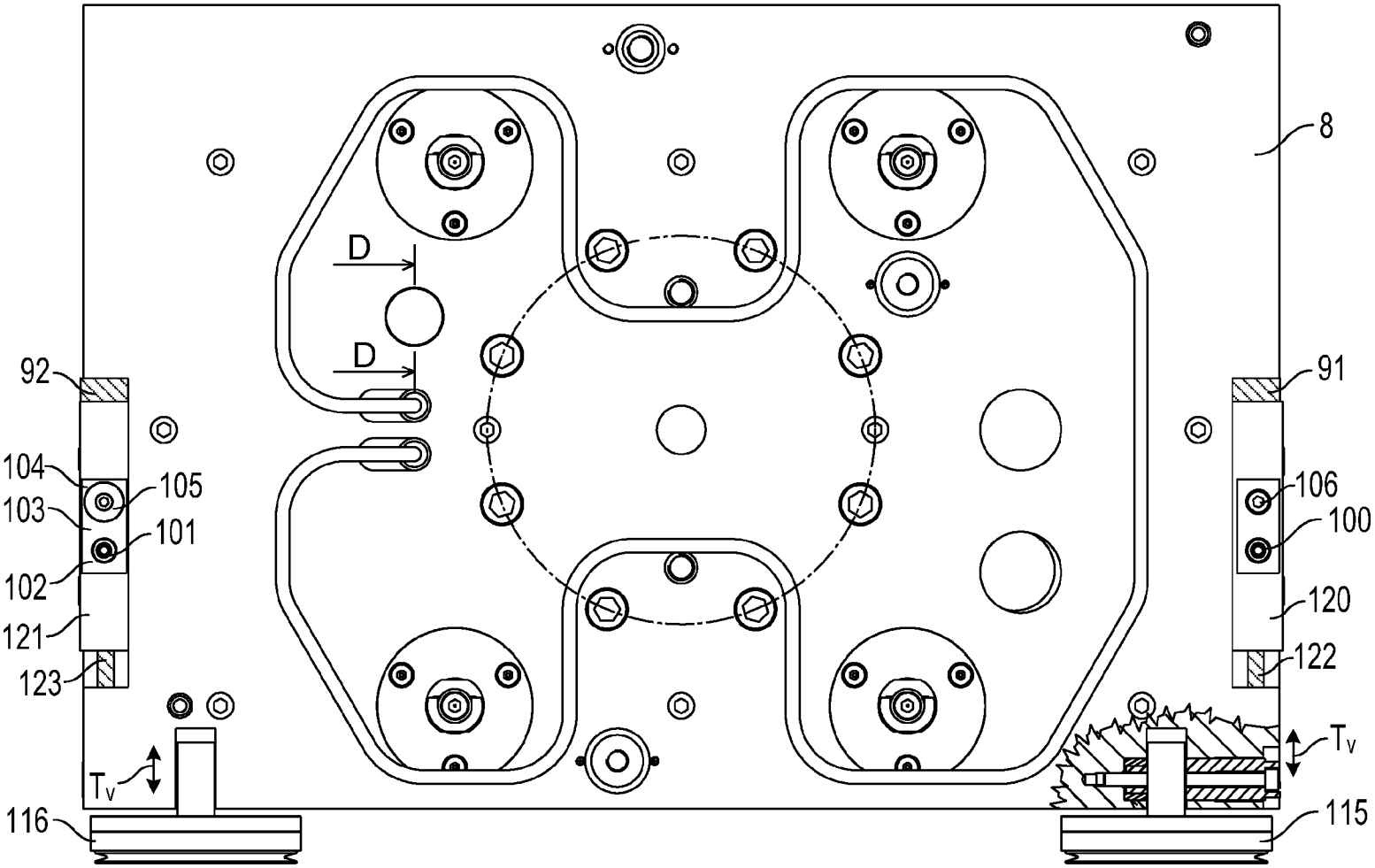
FIG. 26 is a front view of the chamber end wall seen in FIG. 25.
Figure 27:
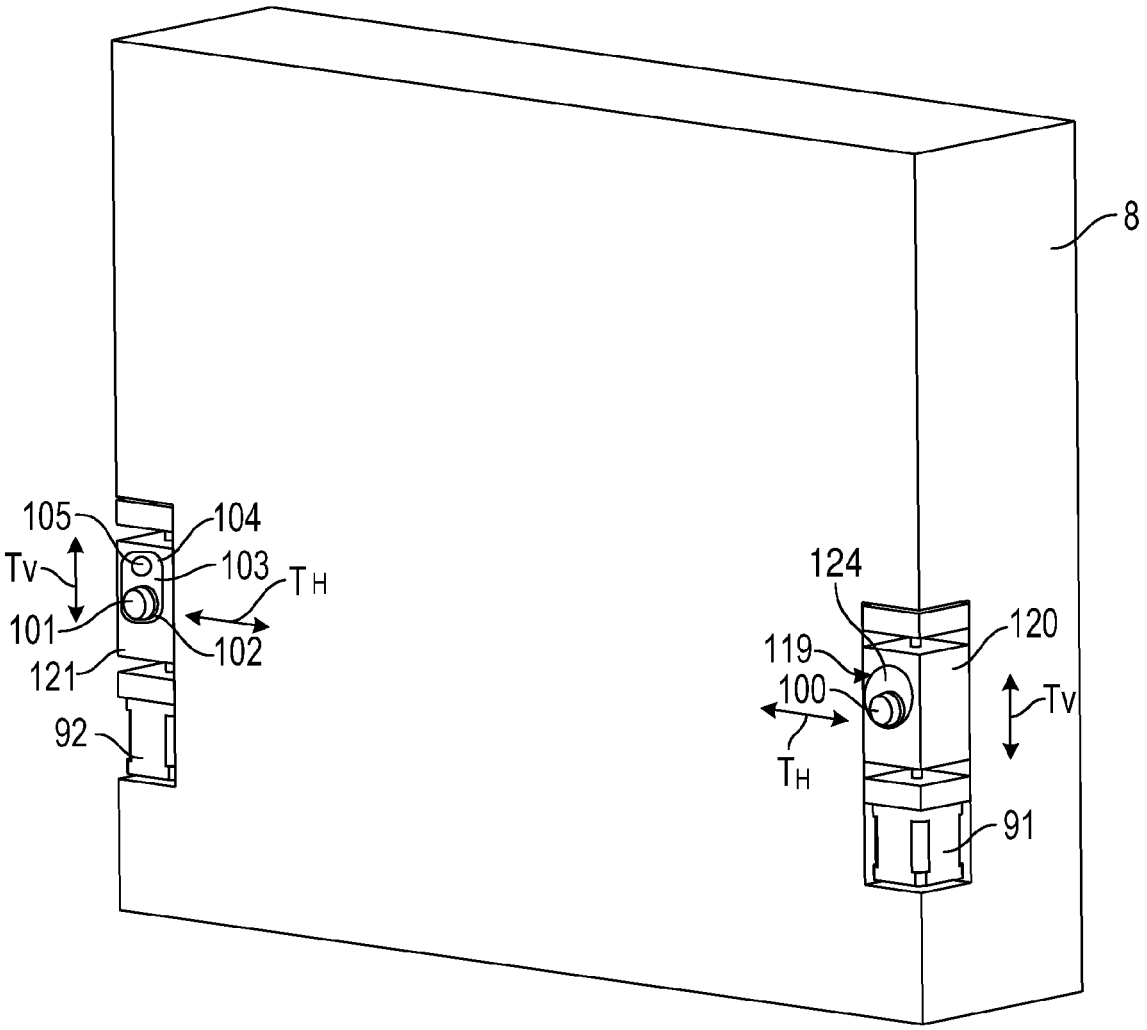
FIG. 27 is a perspective view illustrating in a simplified manner another embodiment of the chamber end wall illustrated in FIG. 25.

FIG. 2 illustrates a sand moulding machine 1 according to the present invention for the production of sand mould parts 2 illustrated for instance in FIG. 3A and FIG. 5, adapted to operate according to the vertical flaskless sand moulding technique such as the DISAMATIC (Registered Trademark) technique. The illustrated sand moulding machine 1 includes a moulding chamber 3 formed by a chamber top wall 4, a chamber bottom wall 5, two opposed chamber side walls 6 of which only one is shown and two opposed chamber end walls 7, 8. The chamber top wall 4 is provided with a sand filling opening 9, typically in the form of an elongated opening or a slot extending in the direction between the two opposed chamber side walls 6. Both chamber end walls 7, 8 are provided with a pattern plate 10, 11 having a pattern 12, 13 adapted to form a pattern in a sand mould part 2. Mounting of the pattern plates 10, 11 on the respective chamber end walls 7, 8 may be ensured by not shown pattern plate locks well-known to the person skilled in the art, and accurate positioning of the pattern plates 10, 11 on the respective chamber end walls 7, 8 may be ensured by means of guide pins 100, 101 as illustrated in FIGS. 25 to 27 and fitting in guide bushings 60 as illustrated in FIG. 8. The use of guide pins for accurate positioning of pattern plates is in itself well-known, however, according to the present invention, in an embodiment, the position of a pattern plate or pattern plates may also be automatically controlled by means of guide pins as it will be explained in more detail below.

One or both of the chamber end walls 7, 8 may in a well-known manner be arranged displaceably in a longitudinal direction of the moulding chamber 3 in the direction against each other in order to compact sand fed into the moulding chamber.

In the embodiment illustrated, the first chamber end wall 7 illustrated to the right in FIG. 2 is arranged swingable about a pivot axis 14 in order to open the moulding chamber 3 when a produced sand mould part 2 has to be expelled from the moulding chamber. The pivot axis 14 is furthermore in a well-known manner arranged displaceably in the longitudinal direction of the moulding chamber 3 so that the first chamber end wall 7 may be displaced to the right in the figure and subsequently tilted about the pivot axis 14 by means of a lifting arm 37 pivotally 38 connected to the end wall 7 so that the end wall 7 is located at a level above a produced sand mould part 2, so that the sand mould part 2 may be expelled from the moulding chamber. The sand mould parts 2 may be compacted and subsequently expelled from the moulding chamber 3 by means of a piston arranged to displace the second chamber end wall 8 illustrated to the left in FIG. 2 in the longitudinal direction of the moulding chamber 3. Thereby, the produced sand mould parts 2 may in a well-known manner be arranged in a row in mutually abutting relationship on a conveyor 16 seen in FIG. 1. In this way, two adjacent sand mould parts 2 may form a complete sand mould for a casting. The conveyor 16 is adapted to advance the compacted sand mould parts 2 in aligned and mutually abutting configuration in the longitudinal direction of the moulding chamber 3 along a path of travel 17 shown in FIG. 1 in a conveying direction D as illustrated in FIG. 1.

Figure 1:
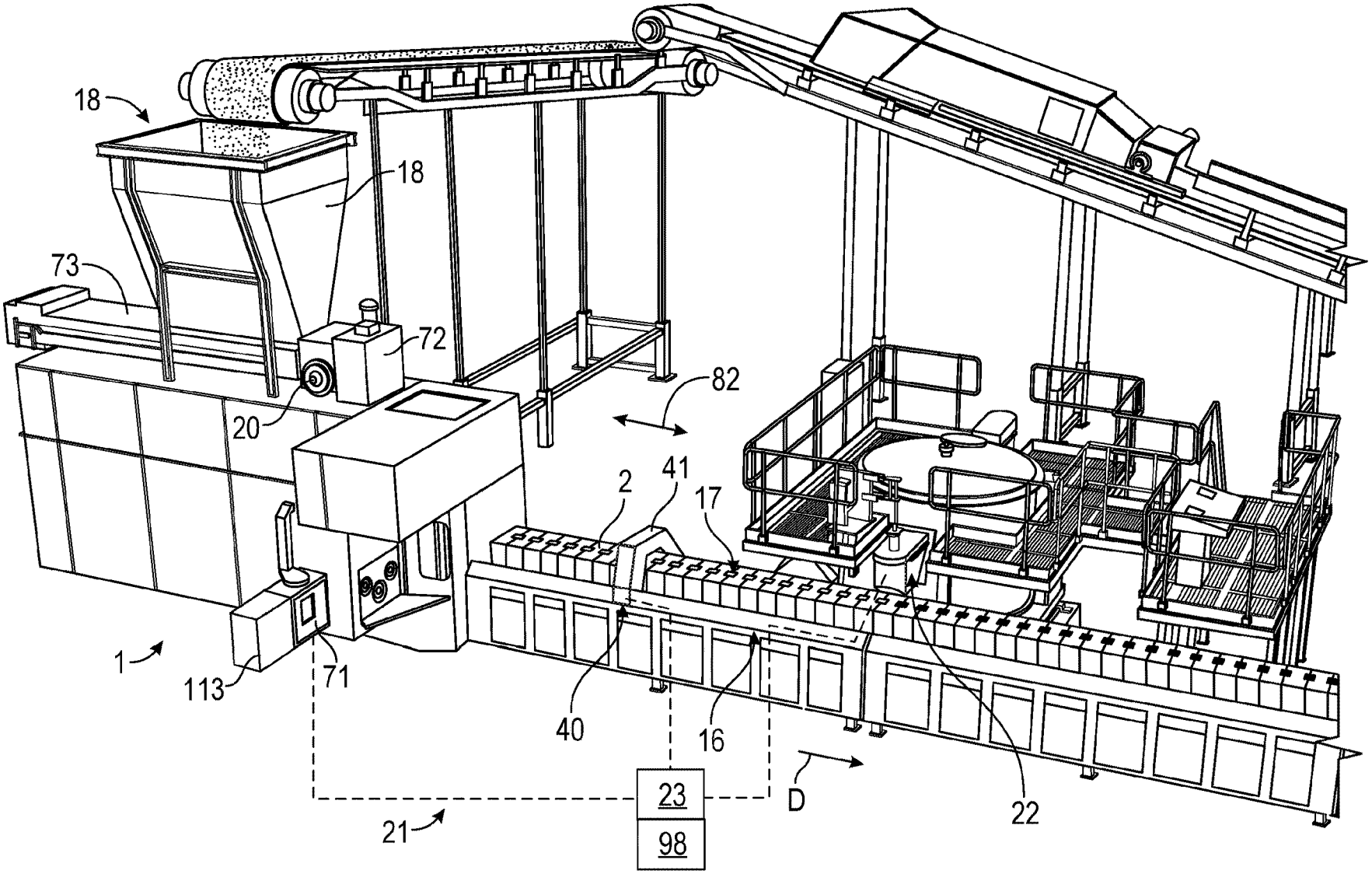

The sand filling opening 9 of the moulding chamber 3 communicates with a sand feed system 18 including a sand container 19 also illustrated in FIG. 1. The lower part of the sand container 19 is via a sand conveyor 73 and a sand feed valve, not shown connected with a sand feed chamber, not shown directly connected to the sand filling opening 9 of the moulding chamber 3. The sand feed chamber 72 is internally funnel-formed and well-known to the person skilled in the art. During the sand filling operation, sand provided in the sand feed chamber 72 is so to say "shot" into the moulding chamber 3 through the sand filling opening 9 by closing the sand feed valve 20 and opening a not shown sand feed control valve so that compressed air enters the sand feed chamber 72 and presses the sand through the sand filling opening 9. When a produced sand mould part is expelled from the moulding chamber 2, an amount of compacted sand is still closing the sand filling opening 9 until the next "shot" of sand enters the moulding chamber through the sand filling opening 9.

FIG. 1 illustrates a foundry production line 21 including the sand moulding machine 1 illustrated in FIG. 2 and described above, the conveyor 16, a measuring boom 41 and a melt pouring device 22 adapted for automatic positioning along the path of travel 17 in the conveying direction D and for automatic pouring. A sand moulding machine control panel 71 is provided for the control of the sand moulding machine 1. Furthermore, a computer system 23 is connected to the measuring boom 41 and the melt pouring device 22 as will be further discussed below.

Figure 10:
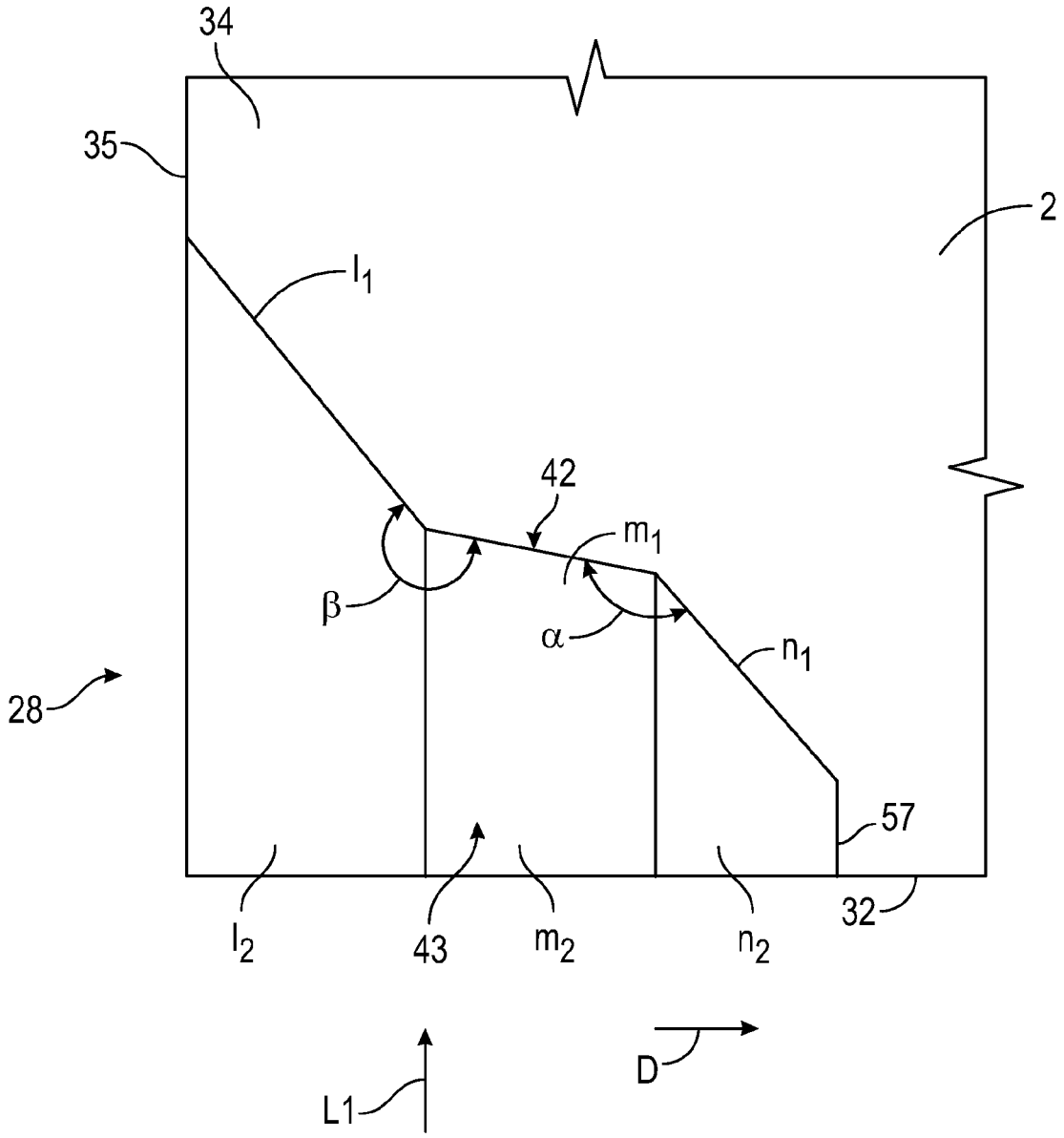
FIG. 10 illustrates a top view of an upper corner of one of the compacted sand mould parts illustrated in FIG. 3A corresponding to the detail indicated in FIG. 3B.

In the embodiment of the present invention illustrated in FIGS. 2 and 8, each pattern plate 10, 11 is associated with four reference pattern blocks 24, 25, 26, 27 being positioned in fixed relationship to the pattern 12, 13 of said pattern plate 10, 11 and being adapted to form a corresponding reference pattern 28, 29, 30, 31 in an external face 32, 33, 34, 35, 36 of a sand mould part 2, which is illustrated in FIG. 3A. The reference pattern blocks 24, 25, 26, 27 may be positioned on a respective pattern plate 10, 11 by means of bolts. Accurate positioning in said fixed relationship may be ensured by means of not shown guide pins fitting in not shown holes formed either in the reference pattern blocks 24, 25, 26, 27 or in the pattern plates 10, 11 and the guide pins may be mounted on the other corresponding part. Each reference pattern block 24, 25, 26, 27 includes at least one set of three flat faces L, M, N following one after the other in the conveying direction D (see FIG. 6) and being adapted to form a corresponding reference pattern 28, 29, 30, 31 including at least one set of three flat surfaces l, m, n following one after the other in the conveying direction D as illustrated in FIG. 10 and as explained in further detail below. According to the present invention, as seen in FIG. 10, each flat surface l, m, n is arranged at an oblique angle to another one of the flat surfaces l, m, n. This means that two of the flat surfaces l, m, n may be parallel, but of course not all of them.

Figure 4:
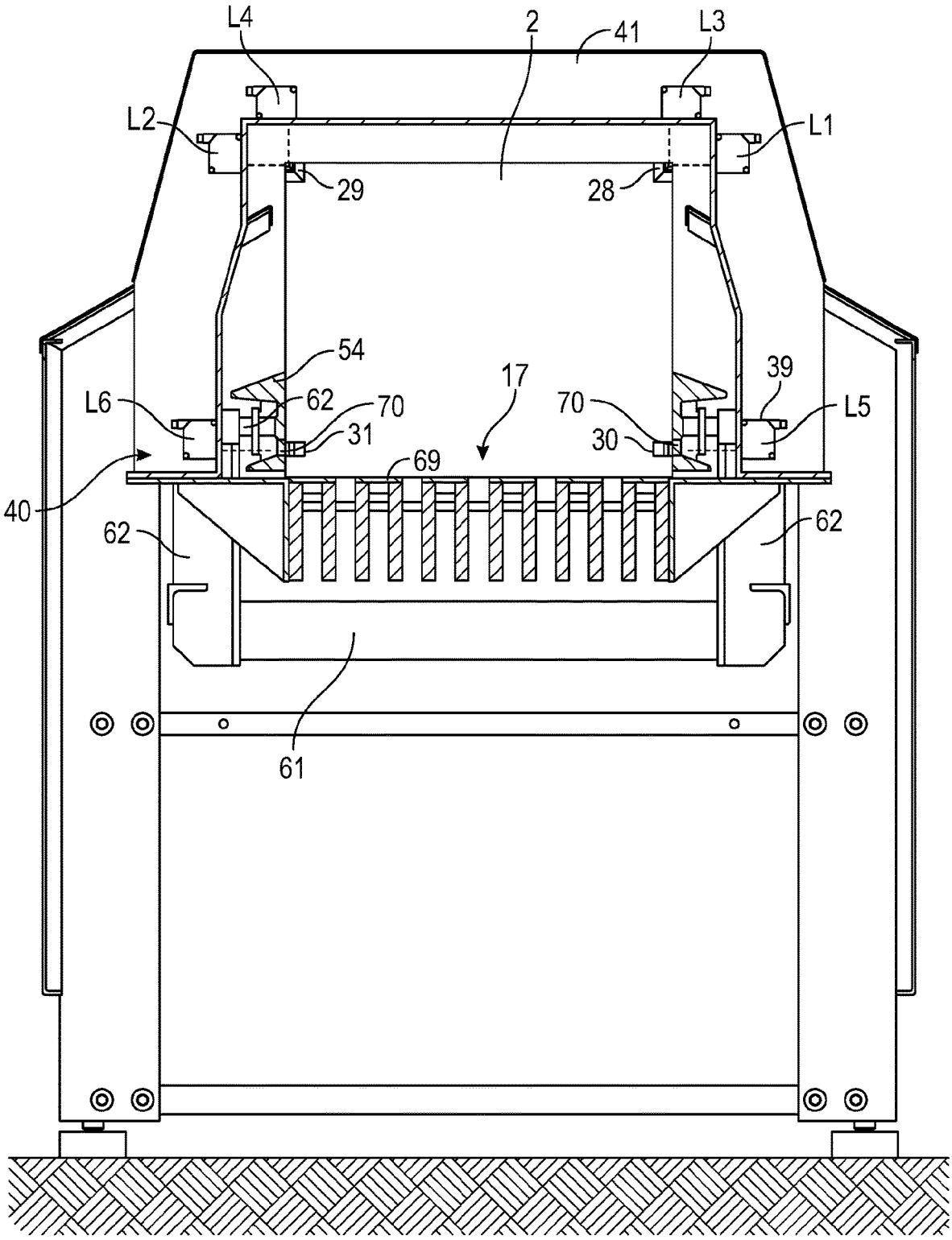
FIG. 4 is a cross-section through an Automatic Mould Conveyor illustrated in FIG. 5, seen in the conveying direction and taken along the line IV-IV in FIG. 5.

In the embodiment illustrated in FIG. 4, six non-contact distance measuring devices 39 in the form of laser-based distance sensors L1, L2, L3, L4, L5, L6 are arranged stationarily on the measuring boom 41 adjacent the path of travel 17 of the compacted sand mould parts 2. The laser-based distance sensors L1, L2, L3, L4, L5, L6 are adapted to measure a varying distance to the reference patterns 28, 29, 30, 31 at a measuring position 40 along the conveying direction D as a result of the flat surfaces l, m, n passing the measuring position 40 in succession during the advancement in the conveying direction D of the compacted sand mould parts 2. Thereby, a relative displacement in a displacement direction 82 corresponding to the conveying direction D between the compacted sand mould parts and the non-contact distance measuring devices 39 is achieved. Alternatively, however, the measuring boom 41 with the non-contact distance measuring devices 39 may be arranged displaceably along the path of travel 17 in the conveying direction D in order to achieve relative displacement in the displacement direction 82 between the compacted sand mould parts 2 and the non-contact distance measuring devices 39. In that case, the compacted sand mould parts 2 do not need to be displaced along the path of travel 17 when distance measurements are performed by means of the non-contact distance measuring devices 39.

Non-contact distance measuring devices are preferred as high accuracy may not be obtained with mechanical measuring probes due to the strength properties of the compressed mould.

It should be noted that in FIG. 4 the laser-based distance sensors L1, L2, L3, L4, L5, L6 are illustrated as boxes, and the laser beams are indicated as broken lines pointing from said boxes in the respective measuring directions.

In accordance with the embodiment illustrated in FIG. 4, on each pattern plate 10, 11, two corner reference pattern blocks 24, 25 are arranged to form corresponding corner reference patterns 28, 29 in the upper corners of a sand mould part 2 as illustrated in FIG. 3A. Each corner reference pattern 28, 29 includes a first set 42 of three flat surfaces $l_1$, $m_1$, $n_1$ following one after the other in the conveying direction D and being arranged at right angles to the chamber top wall 4. This is understood by comparing FIGS. 2, 3 and 10. Each flat surface $l_1$, $m_1$, $n_1$ of the first set 42 is arranged at an oblique angle to another one of the flat surfaces of the first set. Each corner reference pattern 28, 29 furthermore includes a second set 43 of three flat surfaces $l_2$, $m_2$, $n_2$ following one after the other in the conveying direction D and being arranged at right angles to the chamber side walls 6. This is also understood by comparing FIGS. 2, 3 and 10. Each flat surface $l_2$, $m_2$, $n_2$ of the second set 43 is arranged at an oblique angle to another one of the flat surfaces of the second set.

Figure 6:
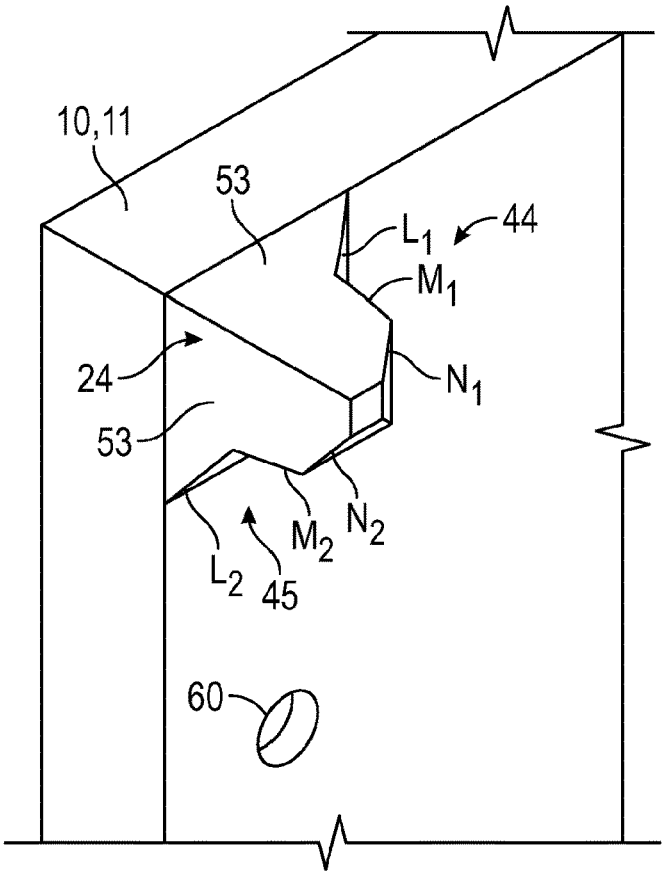
FIG. 6 is a perspective view of a corner reference pattern block arranged at the corner of a pattern plate in order to form a reference pattern in a corner of a sand mould part.

The corner reference pattern block 24 used to form the corner reference pattern 28 is illustrated in FIG. 6. It is seen that the corner reference pattern block 24 has a first set 44 of three flat faces $L_1$, $M_1$, $N_1$ arranged vertically, at right angles to the chamber top wall 4, and adapted to form the corresponding first set 42 of three flat surfaces $l_1$, $m_1$, $n_1$ in the sand mould part 2 as illustrated in FIG. 10. Furthermore, it is seen that the corner reference pattern block 24 has a second set 45 of three flat faces $L_2$, $M_2$, $N_2$ arranged at right angles to the chamber side walls 6 and adapted to form the corresponding second set 43 of three flat surfaces $l_2$, $m_2$, $n_2$ in the sand mould part 2 similar to what is illustrated in FIG. 10. The size of the corner reference pattern block 24 may for instance be 40×40×40 millimetres, 30×30×30 millimetres or 20×20×20 millimetres. A relatively smaller size may be advantageous, but may provide less accuracy than a relatively larger size.

Figure 9:
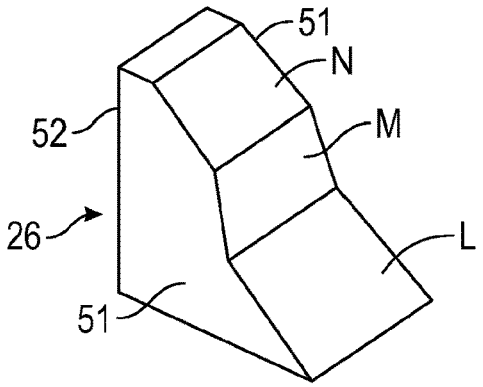
FIG. 9 is a perspective view of a side reference pattern block as illustrated in FIG. 8.

Furthermore, on each pattern plate 10, 11, two side reference pattern blocks 26, 27 are arranged to form corresponding side reference patterns 30, 31 at or above the lower corners of the sand mould part 2 as illustrated in FIG. 3A. Each side reference pattern 30, 31 includes a set of three flat surfaces l, m, n following one after the other in the conveying direction D and being arranged at right angles to the chamber top wall 4. This is understood by comparing FIGS. 2, 3 and 8. Each flat surface l, m, n is arranged at an oblique angle to at least another one of the flat surfaces. The side reference pattern block 26 is illustrated in FIG. 9. As it is seen, the flat surfaces l, m, n of the side reference pattern 30, 31 corresponds to the flat surfaces $l_1$, $m_1$, $n_1$ of the first set 42 of the corner reference patterns 28, 29.

For all embodiments of the reference pattern blocks 24, 25, 26, 27 according to the invention, it should be considered that although it has been illustrated that the three flat faces L, M, N are directly connected to each other, adjacent flat faces L, M, N may alternatively be connected for instance by a rounding or another flat face.

In accordance with the embodiment illustrated in FIG. 4, the laser-based distance sensor L1 is arranged to measure the varying distance in horizontal direction to the corner reference patterns 28, 29 formed in the top right side of the string of compacted sand mould parts 2, seen in the conveying direction D of the compacted sand mould parts 2, as a result of the three flat surfaces $l_1$, $m_1$, $n_1$ of the first set 42 passing the measuring position in succession during the advancement in the conveying direction D. Furthermore, the laser-based distance sensor L3 is arranged to measure the varying distance in vertical direction to the reference patterns 28, 29 formed in the top right side of the string of compacted sand mould parts 2, seen in the conveying direction D of the compacted sand mould parts 2, as a result of the three flat surfaces $l_2$, $m_2$, $n_2$ of the second set 43 passing the measuring position 40 in succession during the advancement in the conveying direction D. Correspondingly, the laser-based distance sensor L2 is arranged to measure the varying distance in horizontal direction to the corner reference patterns 28, 29 formed in the top left side of the string of compacted sand mould parts 2, seen in the conveying direction D of the compacted sand mould parts 2, as a result of the three flat surfaces $l_1$, $m_1$, $n_1$ of the first set 42 passing the measuring position 40. Correspondingly, the laser-based distance sensor L4 is arranged to measure the varying distance in vertical direction to the reference patterns 28, 29 formed in the top left side of the string of compacted sand mould parts 2, seen in the conveying direction D of the compacted sand mould parts 2, as a result of the three flat surfaces $l_2$, $m_2$, $n_2$ of the second set 43 passing the measuring position 40.

Furthermore, the laser-based distance sensor L5 is arranged to measure the varying distance in horizontal direction to the side reference patterns 30, 31 formed in the right side of the string of compacted sand mould parts 2, seen in the conveying direction D of the compacted sand mould parts 2, as a result of the three flat surfaces l, m, n passing the measuring position 40. The laser-based distance sensor L6 is arranged to measure the varying distance in horizontal direction to the side reference patterns 30, 31 formed in the left side of the string of compacted sand mould parts 2, seen in the conveying direction D of the compacted sand mould parts 2, as a result of the three flat surfaces l, m, n passing the measuring position 40.

Although in the illustrated embodiment, the upper reference pattern blocks 24, 25 have been described as corner reference pattern blocks 24, 25 as the one illustrated in FIG. 6, and the lower reference pattern blocks 26, 27 have been described as side reference pattern blocks 26, 27 as the one illustrated in FIG. 9, other embodiments are possible. In fact, only one single reference pattern block on either pattern plate is necessary in order to detect a misalignment between sand mould parts. However, especially, it could be preferred to arrange additionally the lower reference pattern blocks 26, 27 as corner reference pattern blocks as the one illustrated in FIG. 6, but orientated to cooperate with non-contact distance measuring devices arranged below the string of sand mould parts 2 and directed in vertical upward direction, as well as to cooperate with non-contact distance measuring devices arranged sidewards of the string of sand mould parts and directed in horizontal direction. However, this arrangement may require some adaptation of the conveyor 16 in order to allow the non-contact distance measuring devices to detect the reference pattern from below the string of sand mould parts 2. Alternatively, the lower reference pattern blocks 26, 27 could be arranged as corner reference pattern blocks as the one illustrated in FIG. 6, but positioned as lower blocks at a distance from the chamber bottom wall 5, just like the lower reference pattern blocks 26, 27 illustrated in FIG. 8. In that case, depending on whether the second set 45 of three flat faces $L_2$, $M_2$, $N_2$ of the lower corner reference pattern blocks are facing in downwards or upwards direction, a further non-contact distance measuring device 39 could be arranged to measure a distance obliquely in an upward or downward direction to the lower corner reference pattern at or above the lower left corner of the sand mould part 2, and a further non-contact distance measuring device 39 could be arranged to measure a distance obliquely in an upward or downward direction to the lower corner reference pattern at or above the lower right corner of the sand mould part 2.

Suitable non-contact distance measuring devices are available from the company SICK AG, Germany, in the form of short range distance sensors utilizing laser technology. Other suitable non-contact distance measuring devices based on other measuring technologies may also be employed according to the invention.

It is preferred that each of the three flat surfaces l, m, n of the reference patterns 28, 29, 30, 31 forms an oblique angle with the conveying direction. Thereby, the accuracy of the detected parameters may be improved, as the flat surfaces of the reference pattern may be better released from the reference pattern block and may therefore be formed more accurately in the sand mould part. In addition, the reference pattern block may be less worn during use which may also mean better accuracy in the long run. Furthermore, when using a laser-based distance sensor to measure the varying distance to the reference patterns, the distance measurements may be more precise, when the distance is gradually increasing or gradually decreasing as opposed to being constant. Although the applicant does not want to be bound by the following explanations, it is believed that the reason may have to do with the fact that the laser beam has a certain diameter, such as approximately 1 millimetre, and that the surface of the reference pattern has a certain grainy structure formed by sand grains. Furthermore, it may have to do with internal tolerances of the laser-based distance sensor.

It may be preferred that all faces of the reference pattern blocks intended to contact sand mould parts 2 are formed with a draft angle in relation to the longitudinal direction of the moulding chamber 3 in order to better release the reference pattern blocks from the sand mould parts 2.

In an embodiment, the oblique angle between two flat surfaces measured externally of the sand mould part is in the range from 95 to 175 degrees or in the range from 185 to 265 degrees, preferably in the range from 115 to 155 degrees or in the range from 205 to 245 degrees, and most preferred in the range from 125 to 145 degrees or in the range from 215 to 235 degrees. Thereby, according to experiments, the accuracy of the detected parameters may be even further improved. In the embodiment illustrated in FIG. 10, the angle $\alpha$ is approximately 125 degrees, and the angle $\beta$ is approximately 215 degrees.

It is preferred that the non-contact distance measuring devices 39 are arranged to measure a distance in a direction at right angles to the conveying direction D. For instance, the laser-based distance sensor L1 could be arranged to measure a distance in horizontal direction, but at an oblique angle to the conveying direction D, and the measured distance could, for instance in a computer programme, be projected onto a direction at right angles to the conveying direction D. However, this would complicate the calculations in order to detect for instance misalignment of sand mould parts.

Likewise, it is preferred that the non-contact distance measuring devices 39 are arranged to measure a distance in an at least substantially horizontal direction or a distance in an at least substantially vertical direction. It is most practical to calculate and represent distances in a coordinate system having axes corresponding to the faces 32, 34, 35 of the sand mould parts 2 arranged on the conveyor 16. Although distances measured in other directions may be projected onto such axes, this may complicate calculations.

Figure 7:
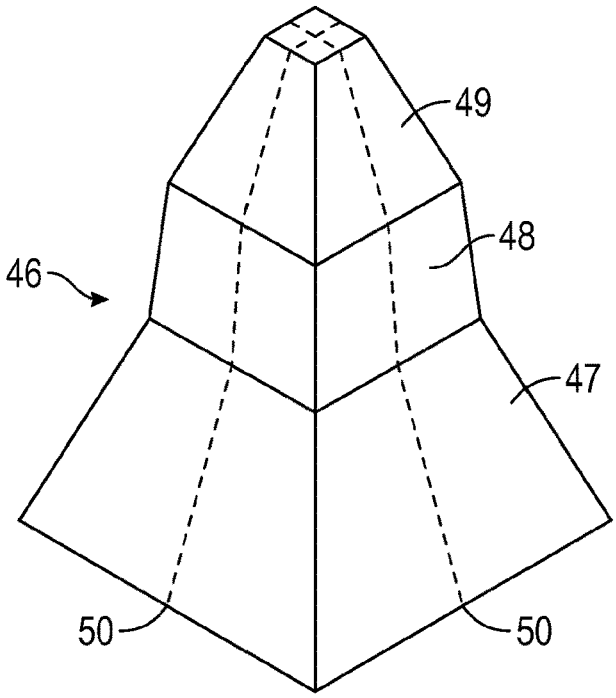
FIG. 7 is a perspective view of an element combined from three truncated square pyramids fitted on top of each other, which element may be parted in four pieces in order to obtain four corner reference pattern blocks as the one illustrated in FIG. 6.

As illustrated in FIGS. 6 and 7, a corner reference pattern block 24, 25 may have the form of a fourth of an element 46 combined from three truncated square pyramids 47, 48, 49 fitted on top of each other. The top of a relatively lower positioned truncated square pyramid 47 matches the base of the relatively higher positioned truncated square pyramid 48, and the top of the relatively lower positioned truncated square pyramid 48 matches the base of the relatively higher positioned truncated square pyramid 49. By parting said element 46 along its centreline and through the symmetry lines 50 of adjacent lateral surfaces of the truncated square pyramids 47, 48, 49, four corner reference pattern blocks 24, 25 may be formed having side faces 53. For the sake of comparison, the corner reference pattern block 24 illustrated in FIG. 6 may be contemplated.

Comparing the corner reference pattern block 24 illustrated in FIG. 6 with the side reference pattern block 26 illustrated in FIG. 9, it may be seen that the latter may simply be regarded as a slice of the element 46 combined from three truncated square pyramids 47, 48, 49 fitted on top of each other as illustrated in FIG. 7. The slice may be formed by performing two parallel cuts forming parallel side faces 51 on either side of a symmetry line 50 of adjacent lateral surfaces of the truncated square pyramids 47, 48, 49 and by performing one cut through the centreline of the element 46 and at right angles to the parallel side faces 51 to form a face 52. However, it may be preferred to form the faces 51 with a draft angle, as discussed above. On the other hand, two side reference pattern blocks 26 as illustrated in FIG. 9, each being differently formed with differently angled flat faces L, M, N, may be combined to one corner reference pattern block 24 as illustrated in FIG. 6.

It may be preferred to position the side faces 53 of the corner reference pattern blocks 24, 25 at a small distance, for instance 1/10 or 1/2 millimetre, from the adjacent chamber top wall 4 and the adjacent chamber side walls 6, respectively, in order to minimize wear. Likewise, it may be preferred to position the side faces 52 of the side reference pattern blocks 26, 27 at a small distance, for instance 1/10 or ½ millimetre, from the adjacent chamber side walls 6 in order to minimize wear. As seen in FIGS. 3 and 8, the lower side face 51 of the side reference pattern blocks 26, 27 may typically be placed at a distance from the chamber bottom wall 5. Said distance may for instance correspond to the width of, or half the width of, a side reference pattern block 26, 27, between its side faces 51. Thereby, it may be avoided that the corresponding side reference pattern 30, 31 formed in a sand mould part 2 interferes with the chamber bottom wall 5 and/or bottom wear faces 69 of the conveyor 16, when the sand mould part is expelled from the moulding chamber 3.

Figure 11:
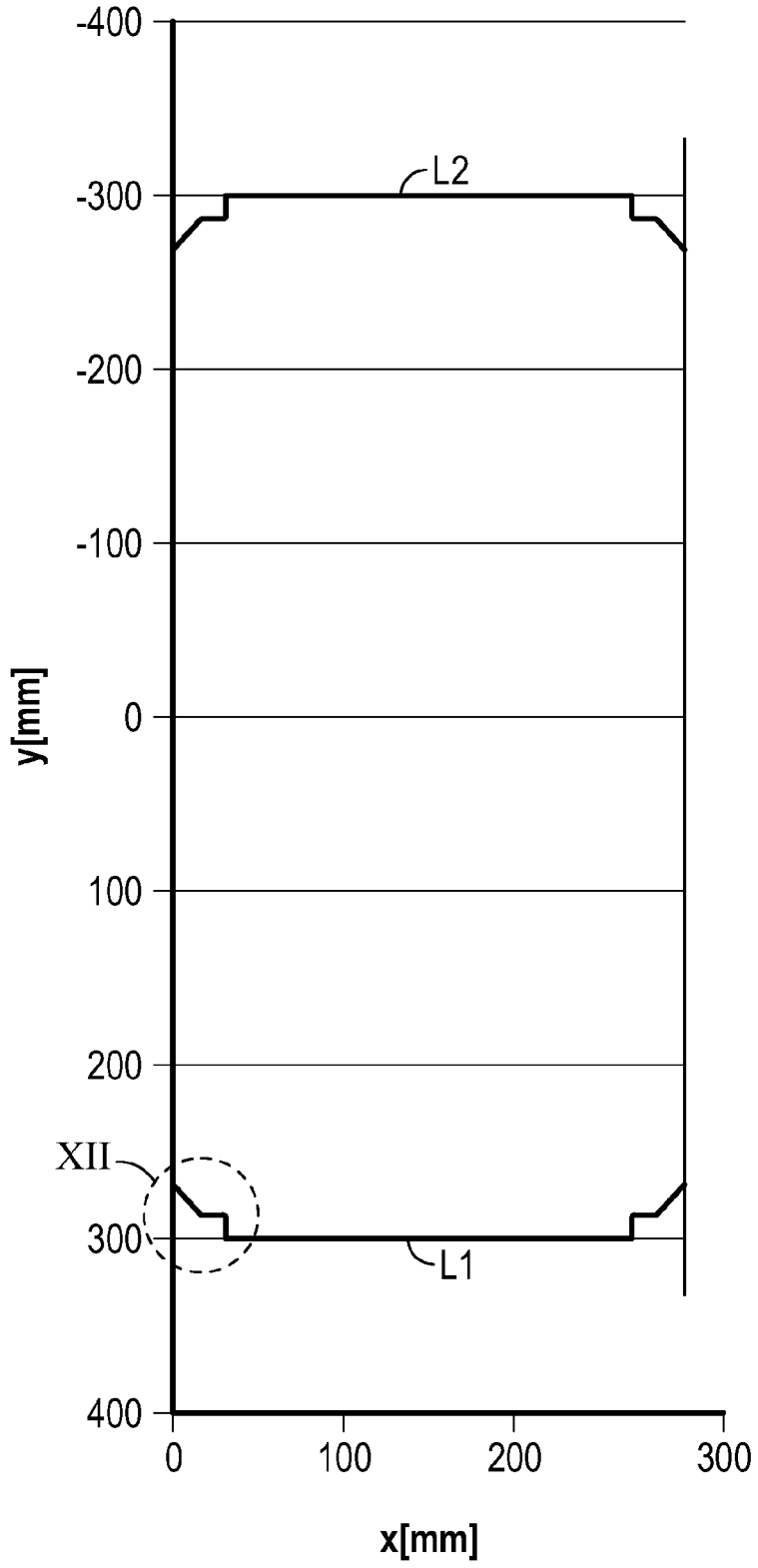
FIG. 11 illustrates in a coordinate system curves representing distance measurements for a single sand mould part by laser-based distance sensor L1 and laser-based distance sensor L2 indicated in FIG. 3B.
Figure 12:
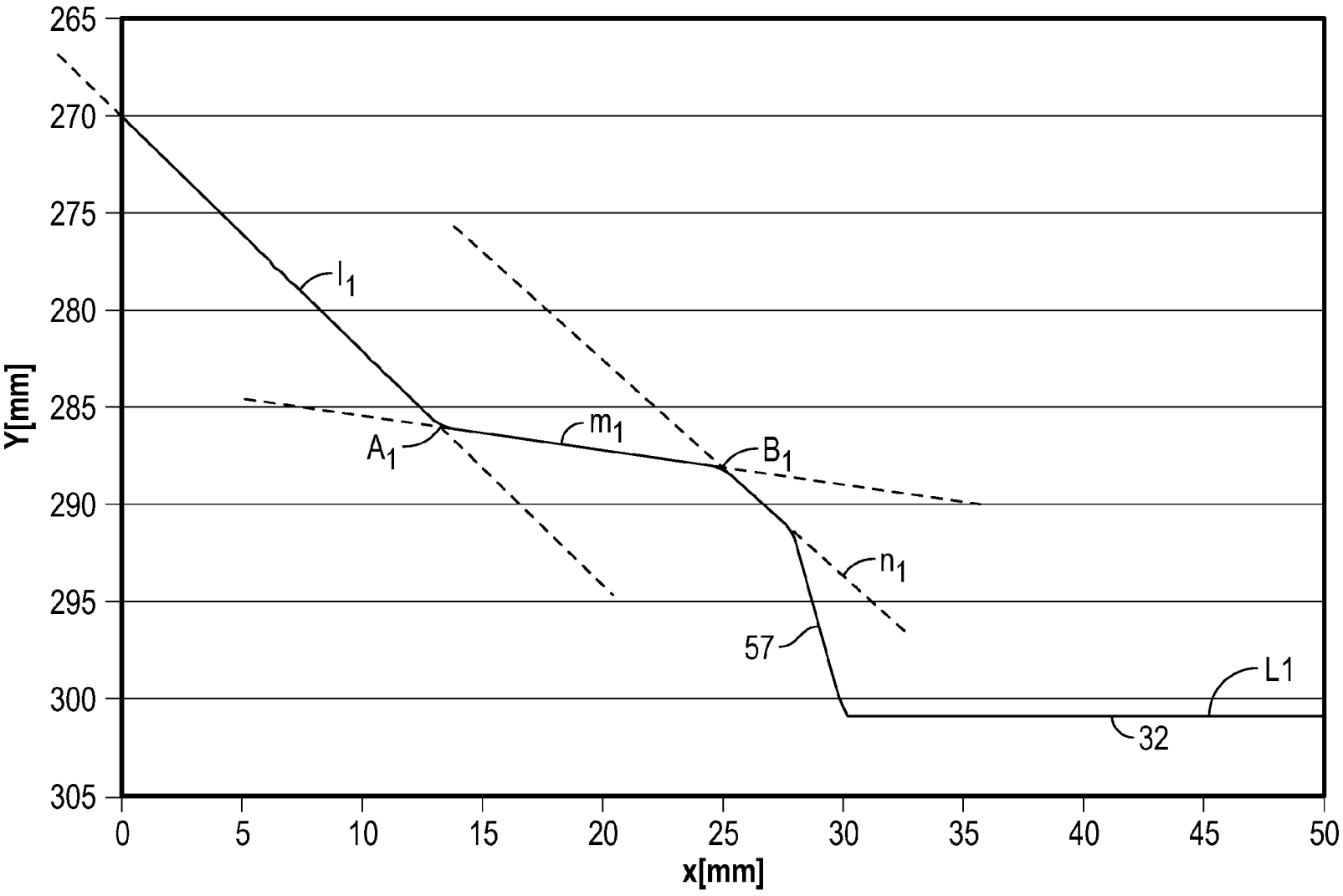
FIG. 12 illustrates the detail XII of FIG. 11 of the curve representing distance measurements by laser-based distance sensor L1.

According to the present invention, the computer system 23 illustrated in FIG. 1 is adapted to receive a number of distance measurements from the non-contact distance measuring devices 39 arranged on the measuring boom 41 during the advancement in the conveying direction D of a compacted sand mould part 2. On the basis of the distance measurements received, the computer system 23 is adapted to perform curve fitting on the basis of said received distance measurements and thereby estimate the respective positions of three straight lines in a coordinate system as illustrated in FIGS. 11 and 12, wherein each straight line represents a respective one of the three flat surfaces l, m, n of the reference pattern 28, 29, 30, 31 seen in cross-section. Furthermore, the computer system 23 is adapted to calculate the positions of two intersection points A, B between the straight lines representing the flat surfaces l, m, n. The position of the intersection points A. B may be compared to the ideal or theoretic position of the intersection points. Thereby, mutual misalignment of adjacent sand mould parts may be detected very accurately. By incorporating distance measurements relating to different reference patterns 28, 29, 30, 31, both vertical, lateral and rotational mutual misalignment of adjacent sand mould parts may be detected. Furthermore, among other parameters, the width of a possible gap between adjacent sand mould parts, mould expansion and mould dimensions may be detected by this arrangement.

Although in the illustrated embodiments, each reference pattern block 24, 25, 26, 27 includes at least one set of three flat faces (L, M, N) following one after the other in the conveying direction D, it should be understood that a set of two flat faces (may be enough, for instance if only sand mould misalignment should be detected. The determination of one intersection point A for each one of two abutting sand mould parts will be sufficient. On the other hand, if for instance a measure for local compaction of the sand mould part 2 should be determined, at least one set of three flat faces (L, M, N) following one after the other in the conveying direction D is necessary. This will be understood more clearly by the explanation further below.

FIG. 11 illustrates the measurements of the laser-based distance sensors L1, L2 as a sand mould part 2 passes the measuring position 40. The directions of the laser-based distance sensors L1, L2 are indicated in relation to the sand mould parts 2 in FIGS. 3A and 3B. The x coordinates on the curves are based on measurements done by a position sensor in displacement direction D illustrated in FIG. 5. The centre of the mould string in the traverse direction is zero point for the sensors L1 and L2 i.e. one is giving positive values and the other negative values. FIG. 12 illustrates a detail XII of FIG. 11 which detail illustrates the measurement of the laser-based distance sensor L1 as a corner reference pattern 28 passes the measuring position 40. Comparing FIG. 10 and FIG. 12, it is seen that each of the flat surfaces $l_1$, $m_1$, $n_1$ of the first set 42 of the corner reference pattern 28 is represented by a straight line in the coordinate system. Furthermore, an end face 57 of the corner reference pattern 28 and an external face 32 of the sand mould part 2 are also represented by corresponding lines in the coordinate system. The straight lines representing the flat surfaces $l_1$, $m_1$, $n_1$ have been positioned correctly in the coordinate system by the computer system 23 by curve fitting of a number of measuring points supplied to the computer system 23 from the laser-based distance sensor L1.

The number of measuring points necessary to position a straight line with suitable accuracy may vary. For instance, the number of measuring points necessary to position one of the straight lines $l_1$, $m_1$, $n_1$ could be between 5 and 50 or may be even more, such as 100. However, it may be preferred to use between 10 and 30 or between 15 and 25 measuring points to position one of the straight lines $l_1$, $m_1$, $n_1$. A relatively large number of measuring points may provide relatively high accuracy; however calculations may then slow down the process of curve fitting.

Having performed the curve fitting operations and calculations necessary to estimate or position the straight lines in the coordinate system, the computer system 23 has calculated the correct position of the intersection point $A_1$ between the straight lines representing the flat surfaces $l_1$, $m_1$ and the correct position of the intersection point $B_1$ between the straight lines representing the flat surfaces $m_1$, $n_1$ in the coordinate system illustrated in FIG. 12. According to the illustrated embodiment of the invention, corresponding curve fitting operations and calculations are performed for the other laser-based distance sensors L2, L3, L4, L5, L6.

Provided that the sand mould part 2 passes the measuring position 40 with a constant velocity, the straight lines representing the flat surfaces may be correctly positioned in a coordinate system by the computer system by adapting the slopes of the straight lines to the known slopes of the corresponding flat surfaces of the reference pattern. Theoretically, the slopes of the corresponding flat surfaces of the reference pattern correspond to the slopes of the corresponding faces of reference pattern block. However, by using this procedure, inaccuracies may occur; for instance the velocity of the sand mould parts 2 may vary slightly, although assumed constant. On the other hand, it may often be preferred that the sand mould parts 2 do not pass the measuring position 40 with a constant velocity. On the contrary, the sand mould parts 2 may for instance accelerate as they are expelled from the moulding chamber 3.

Therefore, it is preferred that the computer system 23 is adapted to, by means of curve fitting, estimate the respective positions of the straight lines based additionally on measurements of the position in the conveying direction D of the compacted sand mould parts 2 during the advancement in the conveying direction of the compacted sand mould parts 2. Thereby, a number of points may be plotted in a coordinate system based on pairs of corresponding measured position in the conveying direction D and measured distance to a reference pattern. By curve fitting, a straight line may be estimated on the basis of these points.

The measurements of the position in the conveying direction D of the compacted sand mould parts 2 may be performed by means of a position sensor 55 coupled to the conveyor 16. The conveyor 16 may have the form of a so-called Automatic Mould Conveyor (AMC) which conveys the compacted sand mould parts 2 by means of pneumatically operated longitudinally extending gripping elements 54 (also called thrust bars) arranged on either side of the string of the aligned and mutually abutting compacted sand mould parts 2 as illustrated in FIGS. 4 and 5. The gripping elements 54 moves back and forth and grip on either side of the compacted sand mould parts 2 as these are advanced. Pairs of gripping elements 54 arranged on either side of the path of travel 17, respectively, are mutually connected by means a traverse 61. The traverse 61 is connected to each gripping element 54 by means of a connecting arrangement 62. At one side of the path of travel 17, a not shown pneumatic expansion element is arranged between the connecting arrangement 62 and the respective gripping element 54 in order to press the gripping elements at either side of the path of travel 17 against the compacted sand mould parts 2. Neighbouring gripping elements 54 in the conveying direction D are connected by means of a not shown flexible coupling. Each gripping element 54 may have a length of for instance 1 metre. The foremost gripping elements 54, seen in the conveying direction D, are actuated back and forth by means of an actuator, such as a hydraulic actuator. The conveyor 16 may alternatively have the form of a so-called Precision Mould Conveyor (PMC) which conveys the compacted sand mould parts 2 by means of sets of so-called walking beams moving back and forth below the compacted sand mould parts 2 or by means of any other suitable device for transporting the mould string.

The position sensor 55 may preferably be an absolute, non-contact position sensor working according to the magnetostrictive principle. Suitable position sensors of this type are marketed by the company MTS (registered trademark) under the trade name Temposonics (registered trademark). Other suitable position sensors may also be employed according to the invention. As illustrated in FIG. 5, the position sensor 55 may have a measuring bracket 56 adapted to be mounted on a longitudinally extending gripping element 54 of the conveyor 16. Because the gripping elements 54 are flexibly mounted in relation to the position sensor 55, a magnetic position giving element 63 is by means of a slide 65 arranged slidably on two adjacent fixed rods 64 so that it is fixed in transverse directions in relation to the sliding direction, and the slide 65 is flexibly connected with the gripping element 54 in order to allow transverse movements in relation to the conveying direction D. Said flexibly connection is achieved in that the measuring bracket 56 has a sliding element 66 slidably arranged in a downward open groove 67 formed in the slide 65 and extending in a transverse direction in relation to the sliding direction. The position of the magnetic position giving element 63 is detected by a measuring rod 68.

In FIG. 4 it is seen that a gripping element 54 on either side of the path of travel 17 at the measuring position 40 is provided with a through going groove 70 in order to allow the lowermost laser-based distance sensors L5, L6 to measure a distance to the respective side reference patterns 30, 31 of the compacted sand mould parts 2. The through going groove 70 has a length in the longitudinal direction of the gripping elements 54 of at least the stroke of the back and forth going movement of the gripping elements 54. The arrangement of the through going grooves 70 has been done in order to allow a relatively low positioning of the lowermost laser-based distance sensors L5, L6 which may allow for a more accurate detection of for instance misalignments. Alternatively, the lowermost laser-based distance sensors L5, L6 and the respective side reference patterns 30, 31 could be arranged above the upper edge of the gripping element 54 (or possibly below the lower edge of the gripper element 54 in the case it was mounted higher).

Alternatively, the position sensor 55 may be a laser-based distance sensor measuring the distance to an external end face 35 of the lastly expelled sand mould part 2.

When the correct positions of the respective intersection points A, B for the different reference patterns 28, 29, 30, 31 have been determined by the computer system 23, a number of important variables may be calculated on the basis thereof. For instance, by comparing the respective positions along the y axis as indicated in FIGS. 3 and 12 of two intersection points $A_1$ for two respective mutually abutting compacted sand mould parts 2, a possible mutual horizontal misalignment of these adjacent sand mould parts 2 may be detected very accurately. On the other hand, by comparing the respective positions along the x axis as indicated in FIGS. 3 and 12 of the same two intersection points $A_1$ for two respective mutually abutting compacted sand mould parts 2, a measure for the possible mould gap between external end faces 35, 36 of these adjacent sand mould parts 2 may be detected very accurately. In doing so, the distance in the direction of the x axis between the two intersection points $A_1$ is calculated, and twice the nominal distance from an intersection point $A_1$ to a corresponding external end face 35 is subtracted.

Figure 3B:
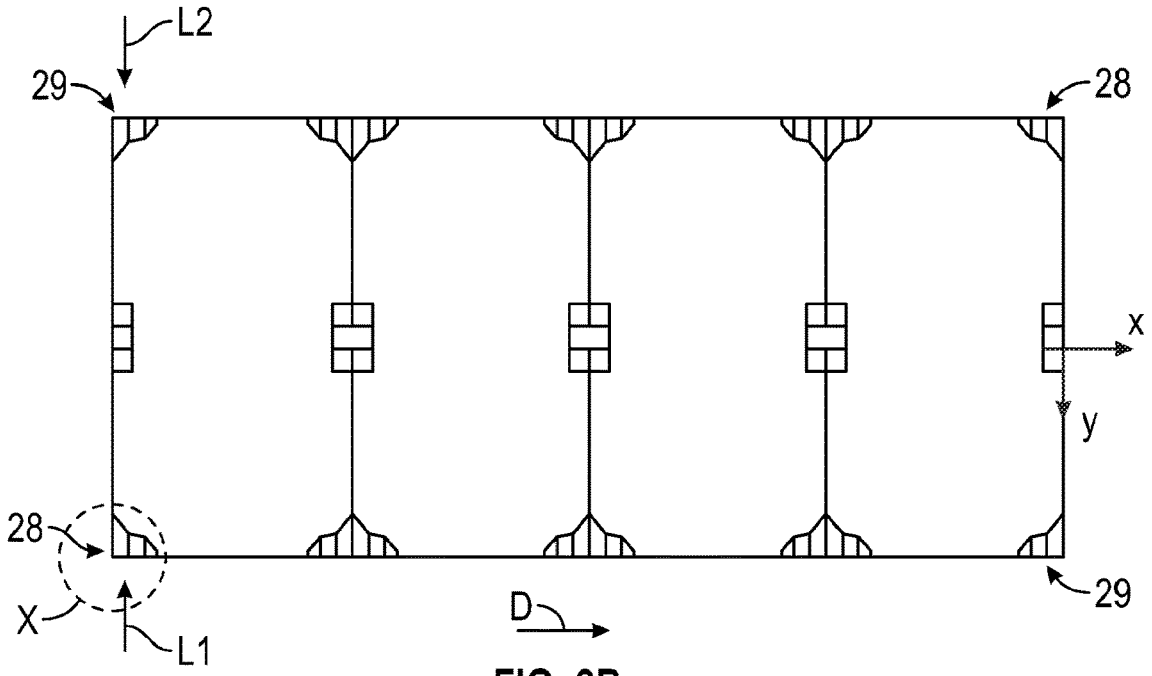
FIG. 3B is a top view of the compacted sand mould parts illustrated in FIG. 3A.
Figure 15:
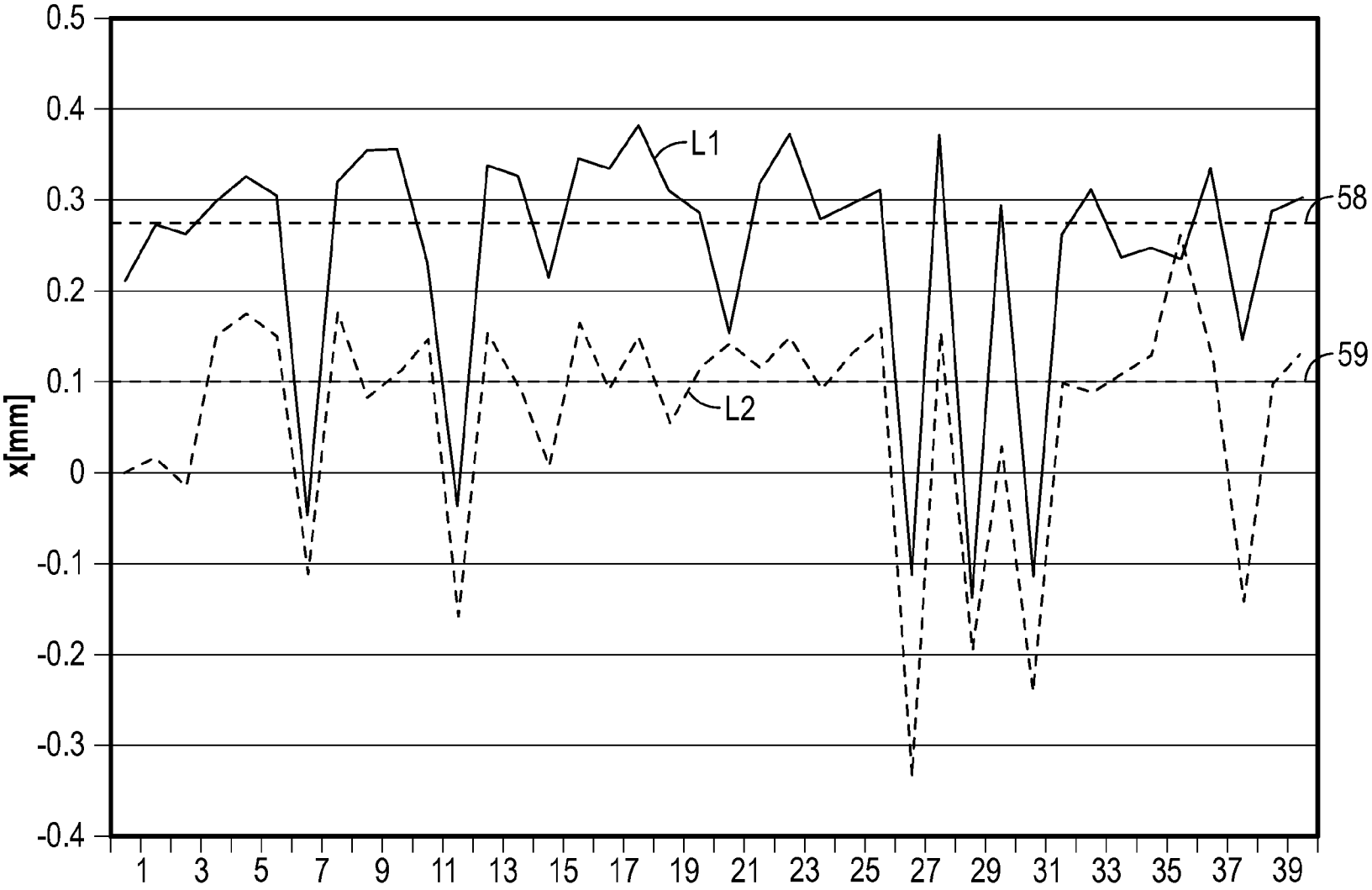
FIG. 15 illustrates in a coordinate system curves representing calculated sand mould part openings between neighbouring sand mould parts in a string based on distance measurements for a number of sand mould parts by laser-based distance sensor L1 and laser-based distance sensor L2 indicated in FIGS. 3A and 3B.

FIG. 15 shows an experimental result of calculations of mould gap based on respective measurements performed by the two laser-based distance sensors L1, L2 as indicated in FIGS. 3A and 3B for 43 different sand mould parts. The lines 58, 59 indicate calculated respective mean values for the mould gap based on measurements performed by the two laser-based distance sensors L1, L2. However, it is seen that among the respective calculated mould gap values are both positive and negative values. A positive value indicate an opening between external end faces 35, 36, whereas a negative value indicate that the external end faces 35, 36 may have been pressed too forcefully against each other. On the basis of this information, the close up force used when bringing the last produced sand mould part in contact with the mould string and during mould transport may be adjusted. As seen, the calculated values for the mould gap for the two laser-based distance sensors L1, L2 generally follow each other. However, for some sand mould parts, the values differ. This may be the result of noise during measurements, but it may also be the result of a misalignment of the pattern plates 10, 11 so that they are not parallel. The measurements may therefore be used to indicate that an adjustment of the alignment of the pattern plates 10, 11 may be necessary.

Furthermore, by calculating the distance along the x axis as indicated in FIGS. 3 and 12 between the different intersection points $A_1$ and $B_1$ for the same sand mould part 2 and comparing this distance with a nominal value, an accurate measure for the local compaction of the sand mould part 2 may be obtained.

Furthermore, by calculating the distance along the x axis as indicated in FIGS. 3 and 12 between for instance the intersection point $A_1$ for the corner reference pattern 28 on the external face 35 and the intersection point $A_1$ for the corner reference pattern 29 on the external face 36 for the same sand mould part 2 as indicated in FIG. 3A and adding twice a nominal distance from an intersection point $A_1$ to a corresponding external end face 35, 36, an accurate measure for the sand mould part thickness may be obtained.

Figure 13:
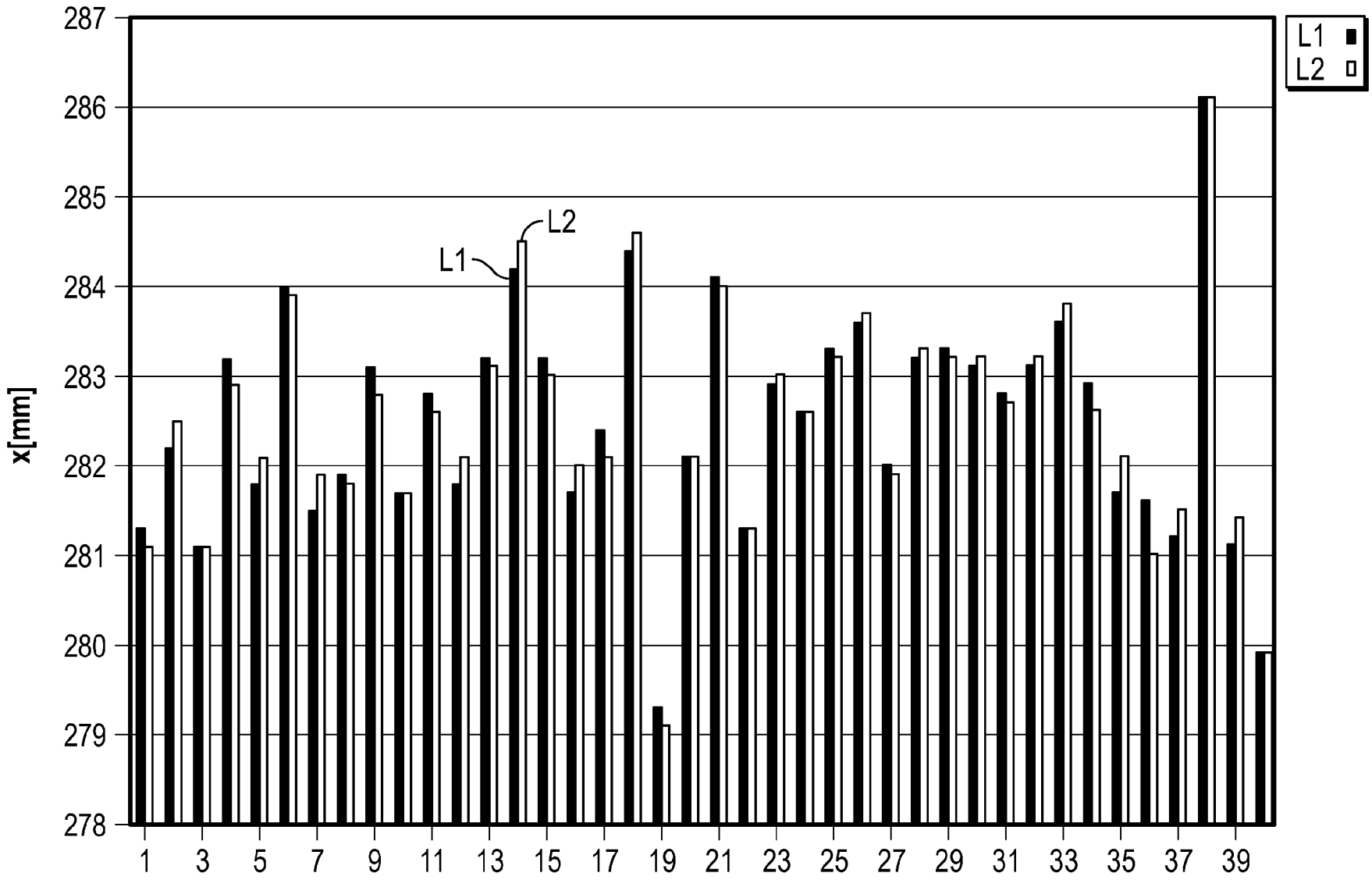
FIG. 13 illustrates in a bar chart mould thicknesses for 15 different sand mould parts measured by laser-based distance sensors L1-L2 indicated in FIG. 3A.

FIG. 13 shows an experimental result of calculations of sand mould thickness based on measurements by the respective laser-based distance sensors L1. L2 for a number of different sand mould parts. The results document that good accuracy may be obtained by the sand moulding machine according to the invention, because as expected sand mould thickness is varying between different sand mould parts, but on the other hand, calculations of sand mould thickness based on measurements by the different laser-based distance sensors L1, L2 generally vary only little.

Figure 14:
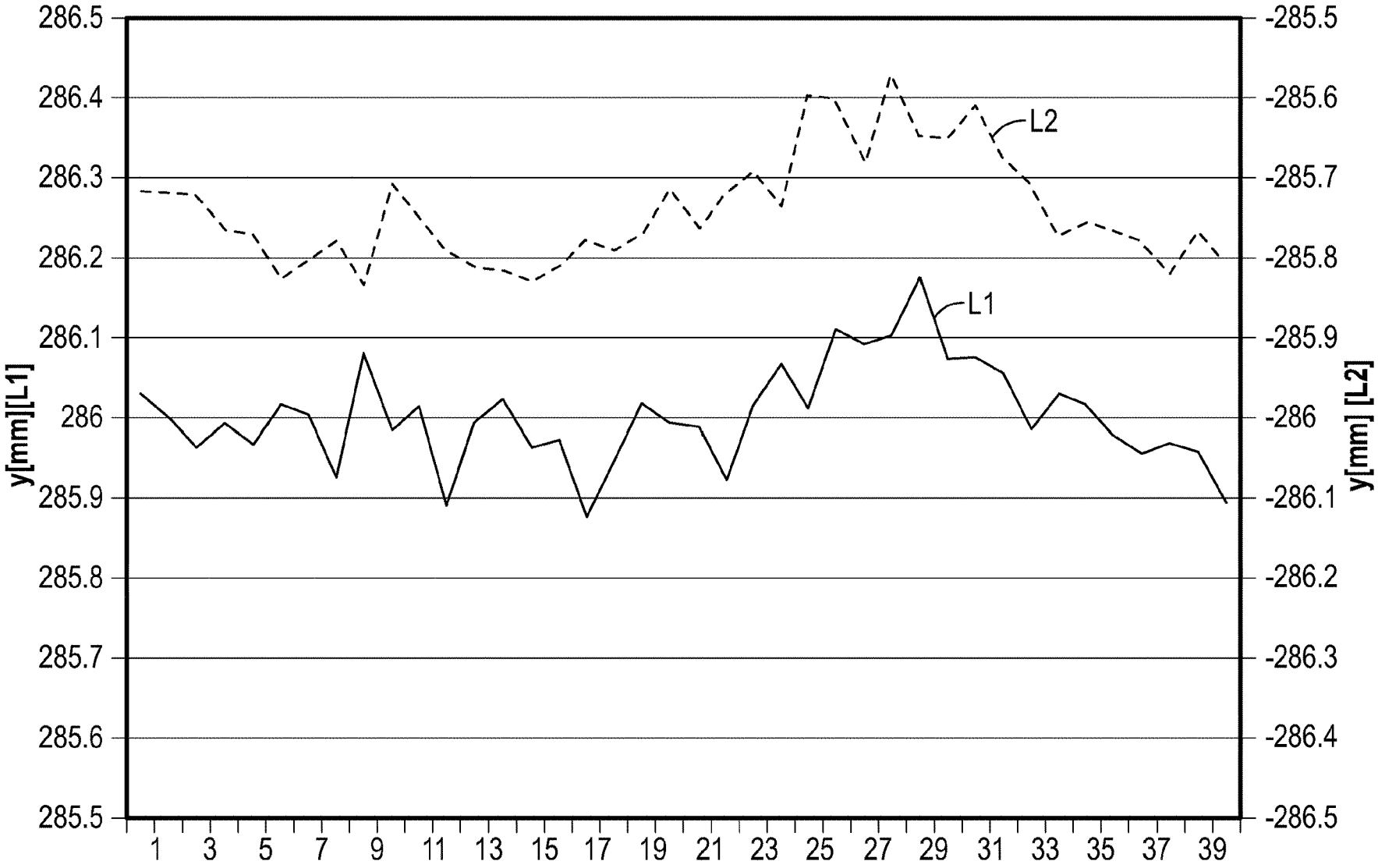
FIG. 14 illustrates in a coordinate system curves representing distance measurements for a number of sand mould parts by laser-based distance sensor L1 and laser-based distance sensor L2 indicated in FIGS. 3A and 3B.

FIG. 14 shows an experimental result of calculations of positions along the y axis as indicated in FIGS. 3 and 12 of two respective intersection points $A_1$ for respective corner reference patterns 28, 29 based on measurements performed by laser-based distance sensors L1, L2, respectively. As seen, the calculated values for the positions along the y axis based on measurements by the two laser-based distance sensors L1, L2 generally follow each other which is expected as the width of the sand mould parts should be close to constant and variations come basically only from the mould string moving a little forth and back in the sidewise direction on the transport system during a production run. Where said two values vary along the string of sand mould parts, but generally follow each other, this may indicate accumulations of minor misalignments between the individual sand mould parts. However, for some sand mould parts, said two values differ. This may be the result of noise during measurements or it could indicate other conditions that could be investigated.

In the embodiment illustrated in FIG. 1, a set including six non-contact distance measuring devices 39 in the form of laser-based distance sensors L1, L2, L3, L4, L5, L6 is arranged on the measuring boom 41 adjacent the path of travel 17 of the compacted sand mould parts 2 as illustrated in FIG. 4. The boom 41 with the set of non-contact distance measuring devices 39 may be arranged at different positions along the path of travel 17, and one or more such booms may be arranged at different positions along the path of travel 17. In the embodiment illustrated in FIG. 1, the boom 41 is arranged between the sand moulding machine 1 and the melt pouring device 22. It may be advantageous arranging the boom 41 just before, and possibly relatively near or next to, the melt pouring device 22. In this way, the melt pouring device 22 may be controlled by the computer system 23 to not pour melt into a mould cavity between sand mould parts being misaligned or in any other way not correctly produced. Thereby, it may be avoided that faulty castings are made.

However, as inaccuracies in the sand mould part alignment as well as in other parameters may also result from the pouring process itself, that is during the melt pouring process, it may furthermore be advantageous arranging the boom 41 or an additional boom 41 after or just after, and possibly relatively near or next to, the melt pouring device 22. Thereby, said inaccuracies may be taken into consideration immediately. Although melt may have been poured into a mould cavity, the detection of a faulty casting at this stage may be advantageous in that the method of producing sand mould parts may be corrected immediately, for instance by adjusting the pattern plates 10, 11. Furthermore, a faulty casting may in this way be identified and be separated out at an earlier stage before it would otherwise be mixed up with acceptable castings, which would lead to larger effort needed for locating the faulty casting. In an embodiment, a boom 41 or an additional boom 41 is arranged after the melt pouring device 22, and the sand moulding machine is controlled so that, on a regular basis, or occasionally, one or more sand moulds formed by two abutting sand mould parts pass the melt pouring device 22 without that melt is poured into the mould cavity or cavities of said sand mould or sand moulds, but so a detection system arranged on said boom 41 or additional boom 41 detects a position of a pattern face of the reference patterns of said sand mould or sand moulds. Thereby, it may be possible to take into account, for instance for an automatic control of pattern plate position and/or orientation, inaccuracies of alignment resulting from for instance the conveying system, such as solidified splashes of melted metal, but not resulting from the actual pouring process itself. Said boom 41 or additional boom 41 may be arranged preferably before or just after a position where the resulting castings are substantially solidified. After solidification, measurements of form positions would be of less value, because changes in the position of the sand mould parts do not influence the solidified castings.

Naturally, it may furthermore be advantageous arranging the boom 41 or an additional boom 41 just after, and possibly relatively near or next to, the sand moulding machine 1 in order to be able to take inaccuracies into consideration as early as possible.

In any way, it may be very advantageous to accurately detect any inaccuracies at or before the melt pouring device 22. If such inaccuracies are not detected according to the invention, these may not be detected before the castings have cooled down and are removed from the sand moulds. As there may be a string of for instance 300 or more sand moulds located downstream, that is after, the melt pouring device 22, it could take a long time before any inaccuracies would be detected by inspection of the cooled down castings at the end of such string. Therefore, in that case, more than 300 castings would have to be scrapped or reworked if there were only one casting in each mould. Often patterns for sand moulds with several casting cavities are used; meaning for instance a pattern with four cavities would result in 1200 defective castings having to be scrapped or reworked. Of course, this means a considerable waste of time and money.

In an embodiment, the foundry production line 21 illustrated in FIG. 1 including the sand moulding machine 1, the melt pouring device 22 is adapted for automatic positioning along the path of travel 17 in the conveying direction D. The computer system 23 is adapted to control the position of the melt pouring device 22 on the basis of calculated positions of at least one intersection point A, B between straight lines l, m, n associated with a sand mould part 2 positioned between the sand moulding machine 1 and the melt pouring device 22. If for instance a boom 41 is arranged just before the melt pouring device 22, the position of the melt pouring device 22 may be calculated on the basis of calculated positions of a single or two intersection points A, B relating to the sand mould part 2 positioned immediately before or just before the melt pouring device 22. If, however, a boom 41 is arranged for instance just after the sand moulding machine 1, the position of the melt pouring device 22 may be calculated and controlled on the basis of accumulated calculated mould thicknesses for the several produced sand mould parts 2 positioned on the conveyor 16 between the sand moulding machine 1 and the melt pouring device 22. For instance, a number of 10, 20 or even more produced sand mould parts 2 may be positioned between the sand moulding machine 1 and the melt pouring device 22.

It should be mentioned that although in the above, it has been mentioned that the foundry production line 21 illustrated in FIG. 1 includes the sand moulding machine 1, the conveyor 16, a measuring boom 41, a melt pouring device 22 and the computer system 23, for the sake of definitions used in the claims, it may also be considered so that the sand moulding machine 1 includes one or all of the conveyor 16, the measuring boom 41, the melt pouring device 22 and the computer system 23.

Figure 16:
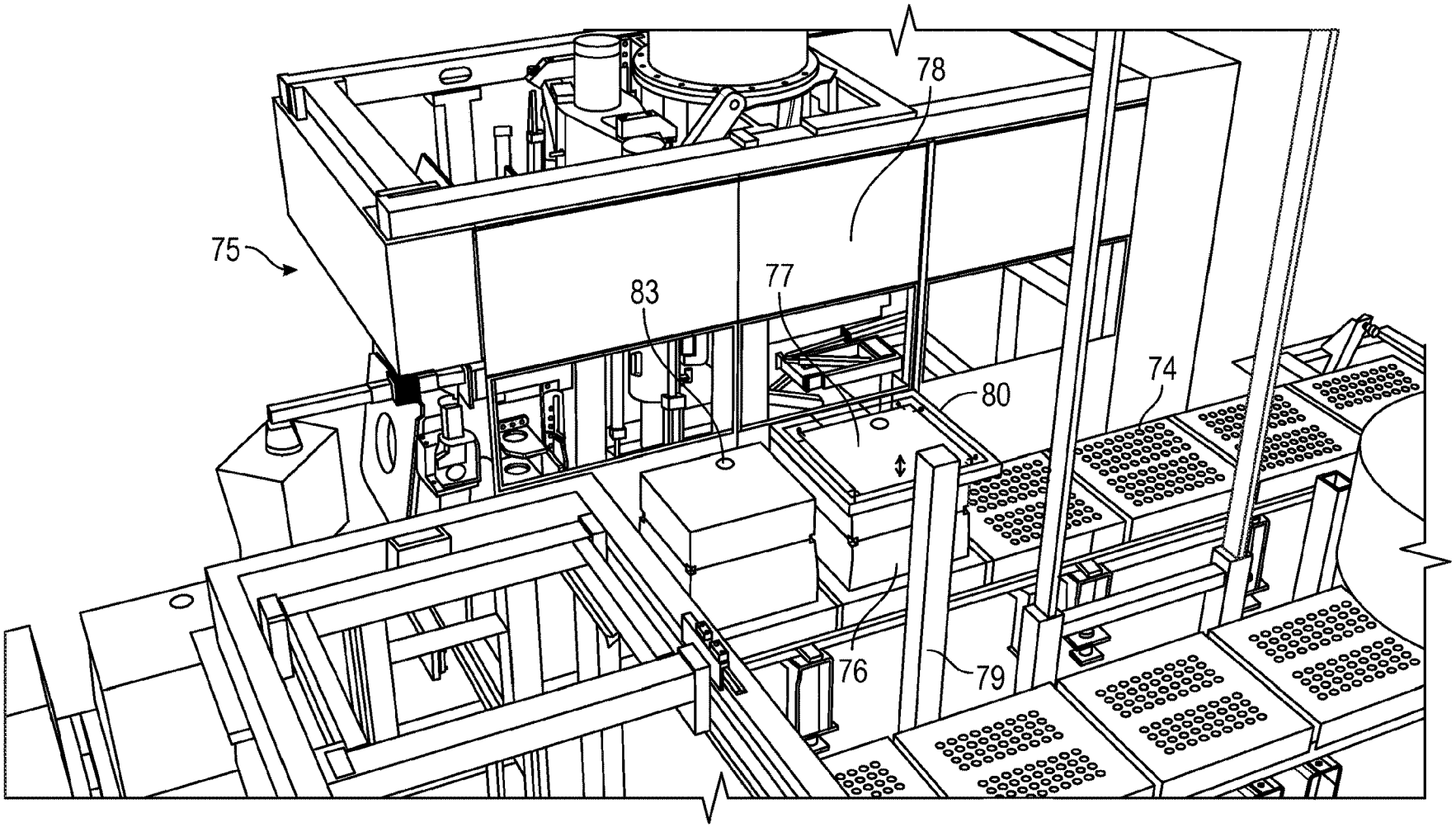
FIG. 16 is a perspective view illustrating part of a foundry line including a sand moulding machine according to the invention, operating according to match plate technique.
Figure 17:
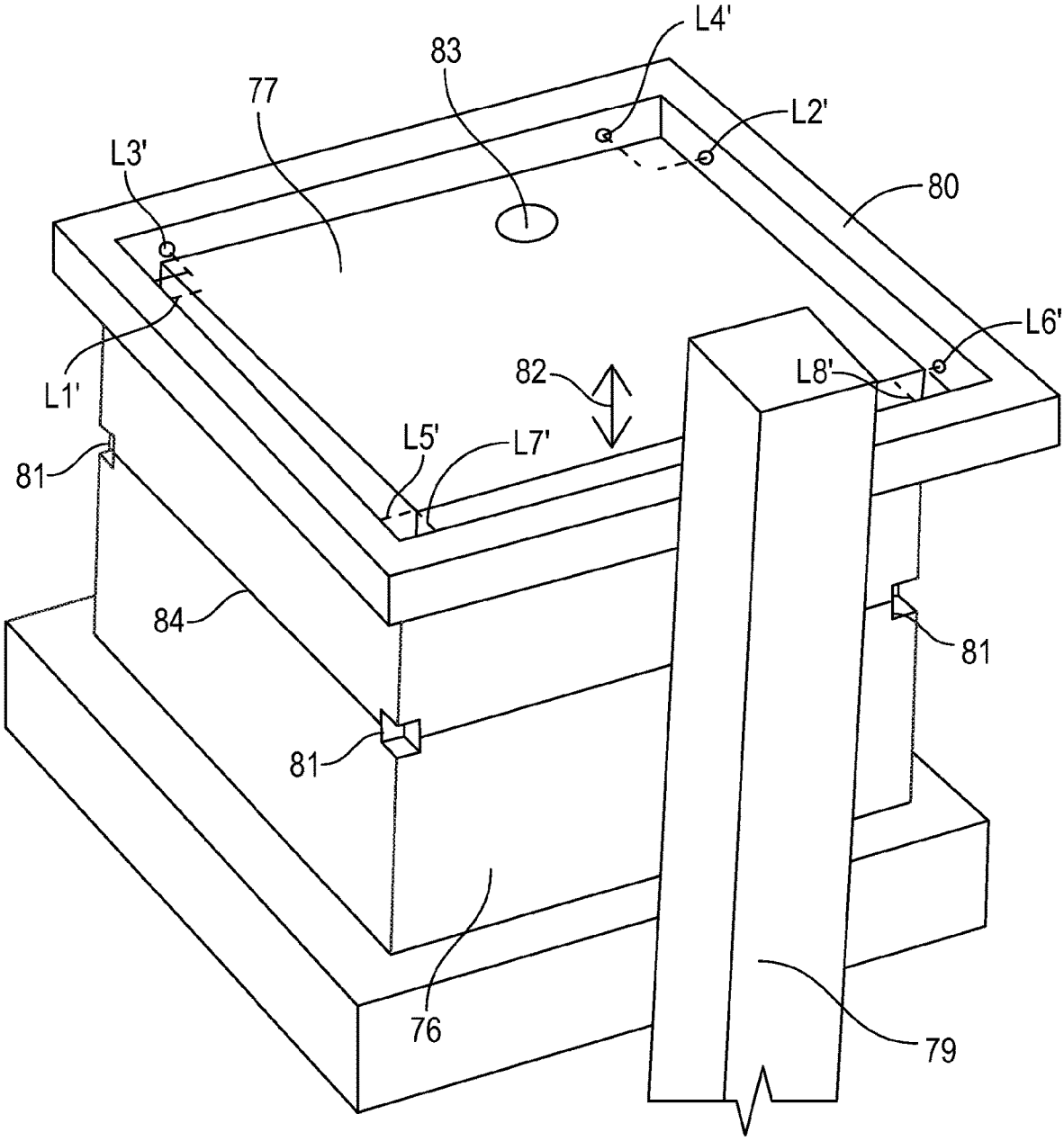
FIG. 17 illustrates an isolated detail of FIG. 16 on a larger scale.

FIGS. 16 and 17 illustrate another embodiment of the sand moulding machine 75 according to the invention. According to this embodiment, the sand moulding machine 75 operates according to the horizontal flaskless match plate technique. The sand moulding machine 75 includes two not shown moulding chambers separated by means of a not shown match plate, and the sand moulding machine is adapted to simultaneously compress two sand mould parts 76, 77 in the respective two moulding chambers and subsequently remove the match plate and position said two sand mould parts 76, 77 on top of each other to form a complete sand mould as best seen in FIG. 17. The person skilled in the art will understand that the moulding chambers are so positioned that the match plate is oriented vertically when the moulding chambers are filled with sand and the sand is mechanically compacted by displacement of chamber end walls. Subsequently, the moulding chambers are rotated 90 degrees, the match plate is removed and the two sand mould parts 76, 77 are placed on top of each other. A sand moulding machine door 78 is opened, and the two sand mould parts 76, 77 are placed on a conveyor 74. Therefore, when the two sand mould parts 76, 77 are placed on the conveyor 74, they abut each other along a horizontal parting line 84. Later, when a casting is to be produced, melt may be poured into the complete sand mould through a mould inlet 83 in the upper sand mould part 77. For the sake of comparison, in the embodiment illustrated in FIG. 1, the sand mould parts 2 abut each other along vertical parting lines.

As illustrated in FIG. 17, non-contact distance measuring devices 39 in the form of laser-based distance sensors L1', L2', L3', L4'. L5', L6', L7', L8' are arranged on a measuring boom 80 to measure the varying distance to reference patterns 81 of said two sand mould parts 76, 77 positioned on top of each other. In order to perform distance measurements when the two sand mould parts 76, 77 have been placed on the conveyor 74, the measuring boom 80 with the non-contact distance measuring devices 39 is displaced up or down in the displacement direction 82 which in this case is the vertical direction, as illustrated with an arrow in the figure. The measuring boom 80 is arranged vertically displaceable on a measuring pole 79.

As explained above, in the embodiment illustrated in FIGS. 16 and 17, distance measurement is performed by vertical displacement of the measuring boom 80, when the two sand mould parts 76, 77 have been placed on the conveyor 74. Thereby, a relative displacement in the displacement direction 82 between the compacted sand mould parts 76, 77 and the non-contact distance measuring devices 39 is achieved. However, in a not shown embodiment, the relative displacement in the displacement direction 82 between the compacted sand mould parts 76, 77 and the non-contact distance measuring devices 39 is achieved by displacement of the compacted sand mould parts 76, 77 vertically in relation to the measuring boom 80. This may be achieved before the compacted sand mould parts 76, 77 are positioned on the conveyor 74 in that the sand moulding machine 75 is adapted to position said two sand mould parts 76, 77 on top of each other and subsequently press the upper one of said two sand mould parts out from its respective moulding chamber. The measuring boom 80 with the non-contact distance measuring devices 39 is arranged to measure the varying distance to the reference patterns 81 of said two sand mould parts 76, 77 subsequently to pressing the upper one 77 of said two sand mould parts out from its respective moulding chamber, but before placing said two sand mould parts 2 on a conveying surface of the conveyor 74. The relative displacement in the displacement direction 82 between the compacted sand mould parts 76, 77 and the non-contact distance measuring devices 39 may thereby be achieved by displacement of the compacted sand mould parts 76, 77 vertically in relation to the measuring boom 80. Of course, the measuring boom 80 could in this case also be arranged vertically displaceable in order to provide at least part of the relative displacement.

In an embodiment, the sand moulding machine 75 includes a not shown frame positioning device for positioning a not shown holding frame, a so called jacket, around said two sand mould parts 76, 77 positioned on top of each other on a conveying surface of the conveyor 74. The positioning of said holding frame around said two sand mould parts 76, 77 is well-known to the person skilled in the art and is done in order to maintain the two sand mould parts 76, 77 in correct mutual position during casting. The measuring boom 80 with the non-contact distance measuring devices 39 is arranged to measure the varying distance to the reference patterns 81 of said two sand mould parts 76, 77 at a position along the path of travel 17 of the compacted sand mould parts 76, 77 before and/or after the frame positioning device. It may be of interest detecting whether the action of positioning a holding frame around said two sand mould parts positioned on top of each other may displace the sand mould parts mutually. In a slightly alternative embodiment, the holding frame has an opening through which the non-contact distance measuring device 39 is adapted to measure the varying distance to the reference patterns 81 of said two sand mould parts 76, 77. Thereby, it may be possible to perform distance measurement during or after positioning the holding frame around said two sand mould parts. If the distance measurement is performed during said positioning of the holding frame, the non-contact distance measuring device may even be mounted on and displaced by the frame positioning device.

Although in the illustrated embodiments, the non-contact distance measuring devices 39 are arranged on a measuring boom 41, 80, the arrangement of the non-contact distance measuring devices 39 may be in any suitable way, for instance each non-contact distance measuring device 39 may be arranged on a separate holding pole.

In an embodiment, a computer system 23 is adapted to control a melt pouring device 22 to stop the pouring of melt on the basis of calculated positions of at least two intersection points A, B between straight lines, and wherein said at least two intersection points A, B are associated with two respective sand mould parts 2, 76, 77 positioned in mutually abutting configuration. Thereby, it may be avoided that faulty castings are produced for instance as a result of mismatch between sand mould parts.

Figure 18:
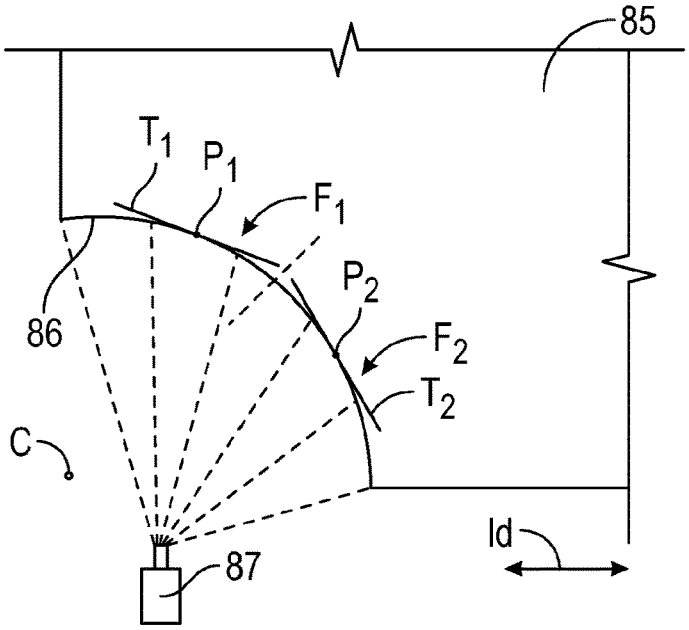
FIG. 18 illustrates a top view of an upper corner of another embodiment of a compacted sand mould part and a corresponding non-contact detection system.

FIG. 18 illustrates a different embodiment, seen in a view corresponding to that of FIG. 10. In the embodiment illustrated in FIG. 18, a non-contact detection system 39 includes a camera 87 and is arranged adjacent a path of travel of the compacted sand mould parts 85. The camera 87 is adapted to detect a position of a pattern face of the reference pattern 86 of the sand mould parts 85. A not shown reference pattern block includes a face having a tangent varying in the longitudinal direction LD of the moulding chamber 3 and is adapted to form a corresponding reference pattern 86 including a pattern face having a tangent $T_1$, $T_2$ varying in a corresponding longitudinal direction Id of the sand mould part 85. The non-contact detection system 39 is adapted to detect the position of a number of different points $P_1$, $P_2$ distributed over the pattern face of the reference pattern 86 in the longitudinal direction Id of the sand mould part 85. As illustrated in FIG. 18, the tangent $T_1$, $T_2$ in the longitudinal direction Id of the sand mould part 85 is different between at least two of said points $P_1$, $P_2$. In this way, based on the detection of the position of a number of different points distributed over the pattern face of the reference pattern 86, the position and orientation of a known curve representing the pattern face may be determined or estimated, and on the basis thereof, the position or positions of one or more reference points for said known curve may be determined or estimated. In the embodiment illustrated in FIG. 18, said known curve is a circle corresponding to the pattern face of the reference pattern 86 in the illustrated horizontal cross-section of the reference pattern 86. The reference point for said known curve is the centre C of the circle formed by the cross-section of the reference pattern 86.

The position of such reference points may be compared to the ideal or theoretic position of the reference points. Thereby, mutual misalignment of adjacent sand mould parts may be detected very accurately. Furthermore, among other parameters, the width of a possible gap between adjacent sand mould parts, mould expansion and mould dimensions may be detected by this arrangement. It may thereby be assessed whether the actual situation is acceptable or not. The ideal or theoretic position of the reference points may depend on the parameter that is to be assessed and may be determined by calculations based on theory or empirically. For instance, if the parameter to be assessed is mutual misalignment of adjacent sand mould parts, and the known curve corresponding to the pattern face is a circle, then the theoretic and ideal position of the reference point, the centre of the circle, of either sand mould part is the same position in a coordinate system, i.e. the centres of the two circles coincide.

As in the embodiment illustrated in FIG. 1, a computer system 23 may be adapted to receive the detected positions of a number of points $P_1$, $P_2$ located on the pattern face of the reference pattern 86 of the sand mould part 85. The computer system may be adapted to perform curve fitting on the basis of said received detected positions and thereby estimate the respective position of a curve in a coordinate system, whereby the curve represents the pattern face of the reference pattern 85 seen in cross-section, and whereby the computer system is adapted to calculate the position or positions of one or more reference points related to the curve. Thereby, the position or positions of one or more reference points related to the curve may be automatically determined. The position of such reference points may be automatically compared to the ideal or theoretic position of the reference points.

Although in the embodiment illustrated in FIG. 18, said known curve corresponding to the pattern face of the reference pattern 86 in the illustrated horizontal cross-section of the reference pattern 86 is a circle, said known curve may be any kind of curve having a tangent varying in a corresponding longitudinal direction Id of the sand mould part 85. For instance, in the embodiment illustrated in FIG. 10, said known curve is composed of flat surfaces ($l_1$, $m_1$, $n_1$) following one after the other in the longitudinal direction of the moulding chamber 3. Said known curve may have any suitable form as long as the non-contact detection system 39 is able to suitably detect the pattern face of the reference pattern 86. The computer system may perform curve fitting on the basis of said received detected positions and thereby estimate the respective position of any such curve in a coordinate system, and the computer system may calculate the position or positions of one or more reference points related to such curve.

In the embodiment illustrated in FIG. 18, the at least one (not shown) reference pattern block may include a face having also a tangent varying in a height direction of the moulding chamber 3 and being adapted to form a corresponding reference pattern 86 including a pattern face having a tangent varying in a corresponding height direction of the sand mould part 85. The non-contact detection system 39 may be adapted to detect the position of a number of different points distributed over the pattern face of the reference pattern in the height direction of the sand mould parts 85. The tangent in the height direction of the sand mould parts 85 is different between at least two of said points. Thereby, by means of a single reference pattern block 85, the actual three-dimensional position of a point C in a corner of a sand mould part 85 may be determined.

Furthermore, in the embodiment illustrated in FIG. 18, the at least one (not shown) reference pattern block includes a first face part having a first tangent at a first position in the longitudinal direction LD of the moulding chamber 3 and a second face part having a second tangent at a second position in the longitudinal direction of the moulding chamber 3. The second tangent is different from the first tangent. The first and second face parts are adapted to form a corresponding reference pattern 86 including a first pattern face part $F_1$ having a first pattern tangent $T_1$ in a first point $P_1$ at a first position in the longitudinal direction Id of the sand mould part 85 and a second pattern face part $F_2$ having a second pattern tangent $T_2$ in a second point $P_2$ at a second position in the longitudinal direction Id of the sand mould part 85. The second pattern tangent $T_2$ is different from the first pattern tangent $T_1$. The non-contact detection system 39 is adapted to detect the position of a number of different points distributed at least substantially evenly over both the first and the second pattern face part $F_1$, $F_2$ of the reference pattern 85 in the longitudinal direction Id of the sand mould part 85.

Furthermore, in the embodiment illustrated in FIG. 18, the at least one (not shown) reference pattern block includes a third face part having a third tangent at a third position in the longitudinal direction LD of the moulding chamber 3 and a fourth face part having a fourth tangent at a fourth position in the longitudinal direction of the moulding chamber 3. The fourth tangent is different from the third tangent. The third and fourth face parts are adapted to form a corresponding reference pattern 86 including a (not illustrated) third pattern face part having a third pattern tangent in a third point at a third position in the longitudinal direction Id of the sand mould part 85 and a (not illustrated) fourth pattern face part having a fourth pattern tangent in a fourth point at a fourth position in the longitudinal direction Id of the sand mould part 85. The fourth pattern tangent is different from the third pattern tangent. The non-contact detection system 39 is adapted to detect the position of a number of different points distributed at least substantially evenly over both the third and the fourth pattern face part of the reference pattern 85 in the longitudinal direction Id of the sand mould part 85. The first, second, third and fourth face parts may of course be at least partly coinciding or at least partly overlap each other.

Figure 19:
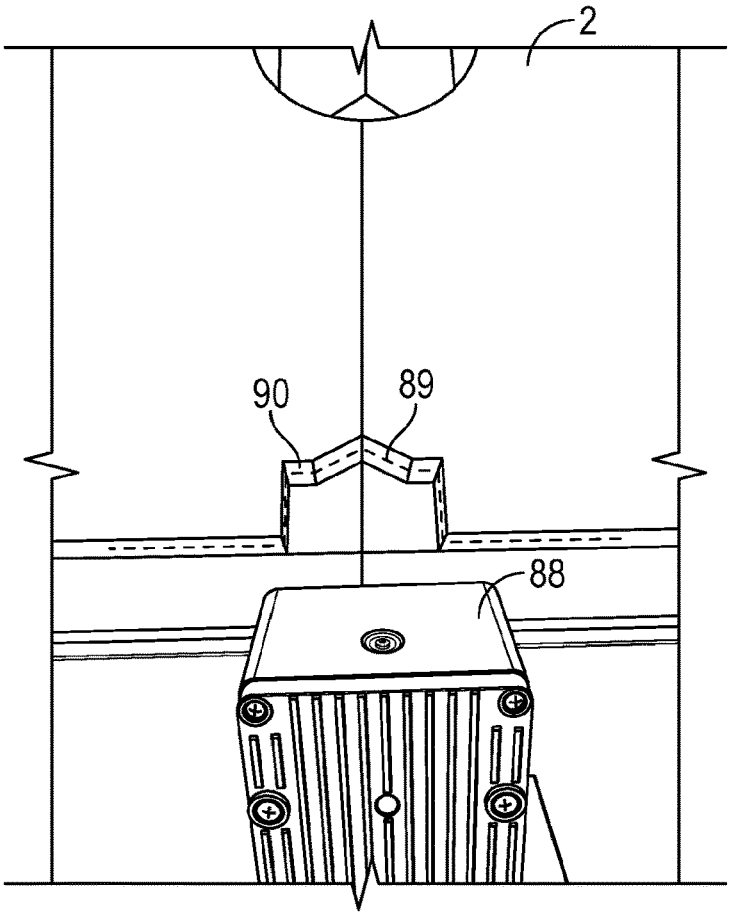
FIG. 19 illustrates an embodiment of a non-contact detection system including an electro-optical sensor unit.

In the embodiment illustrated in FIG. 19, the non-contact detection system 39 includes a not shown laser-based illumination system adapted to form an elongated light beam forming an illuminated line 89 on a pattern face of a reference pattern 90. The laser-based illumination system may be adapted to form the elongated light beam by means of a prism. The laser-based illumination system is arranged below a camera 88 also included by the non-contact detection system 39, and therefore the laser-based illumination system is not visible in the figure. As the camera 88 is arranged above the laser-based illumination system, the camera 88 may capture a photo in which the illuminated line 89 formed on the pattern face of the reference pattern 90 is not linear as seen in FIG. 19. On the basis of such a photo, a computer system 23 may perform curve fitting and thereby estimate the position of the illuminated line 89 in a coordinate system, and the computer system may calculate the position or positions of one or more reference points related to the curve in a two-dimensional coordinate system. In the illustrated embodiment in FIG. 19, said two-dimensional coordinate system extends in a horizontal plane.

Furthermore, in the embodiment illustrated in FIG. 19, the non-contact detection system may include a first laser-based illumination system adapted to form a first elongated light beam forming a first illuminated line on the pattern face of the reference pattern 90, and the non-contact detection system may include a second laser-based illumination system adapted to form a second elongated light beam forming a second illuminated line on the pattern face of the reference pattern 90, wherein said first and second lines extend in the longitudinal direction of the sand mould part 2, and wherein the second elongated light beam forms an angle of preferably 90 degrees with the first elongated light beam. Thereby, on the basis of a photo taken by the camera 88, a computer system 23 may perform curve fitting and thereby estimate the position of the illuminated lines in a three-dimensional coordinate system, and the computer system may calculate the position or positions of one or more reference points in a three-dimensional coordinate system.

Furthermore, in the embodiment illustrated in FIG. 19, alternatively, the non-contact detection system 39 may include a laser-based illumination system adapted to sweep a light beam along a line on the pattern face of the reference pattern 90. Thereby, the above-mentioned advantages of an elongated light beam forming an illuminated line on the pattern face of the reference pattern may be obtained without a prism.

Preferably, in the respective embodiments illustrated in FIGS. 18 and 19, the camera 87, 88 takes a photo when the sand mould parts 2, 85 are standing still, however the sand mould parts may also move, if the non-contact detection system 39 including the camera 87, 88 is sufficiently fast-acting.

Preferably, in the respective embodiments illustrated in FIGS. 18 and 19, a number of cameras 87, 88 or other suitable electro-optical sensor units are arranged in mutually fixed positions, preferably by means of a boom 41 or frame, corresponding to the mounting of the electro-optical sensor units in the form of laser-based distance sensors in the embodiment illustrated in FIG. 1. Thereby, an even higher accuracy may be obtained, because each electro-optical sensor unit may be accurately positioned in relation to the other electro-optical sensor units.

It should be noted that according to the present invention, a non-contact detection system 39 is any system that is able to detect the position of a number of different points distributed over the pattern face of the reference pattern without direct mechanical contact between the non-contact detection system and the pattern face. A non-contact detection system could for instance be a 3D scanner.

According to the present invention, the non-contact detection system 39 may include an electro-optical sensor unit, such as for instance a digital camera. Information delivered by electro-optical sensors are essentially of two types: either images or radiation levels (flux). Furthermore, the non-contact detection system 39 may include video, laser, radar, ultrasonic or infrared camera or the like.

A 3D scanner is an imaging device that collects distance point measurements from a real-world object and translates them into a virtual 3D object. Many different technologies can be used to build 3D-scanning devices; each technology comes with its own limitations, advantages and costs. Optical 3D scanners use photographic, stereoscopic cameras, lasers or structured or modulated light. Optical scanning often requires many angles or sweeps. Laser-based methods use a low-power, eye-safe pulsing laser working in conjunction with a camera. The laser illuminates a target, and associated software calculates the time it takes for the laser to reflect back from the target to yield a 3D image of the scanned item. Non-laser light-based scanners use either light that is structured into a pattern or a constantly modulated light and then record the formation the scanned object makes.

Figure 23:
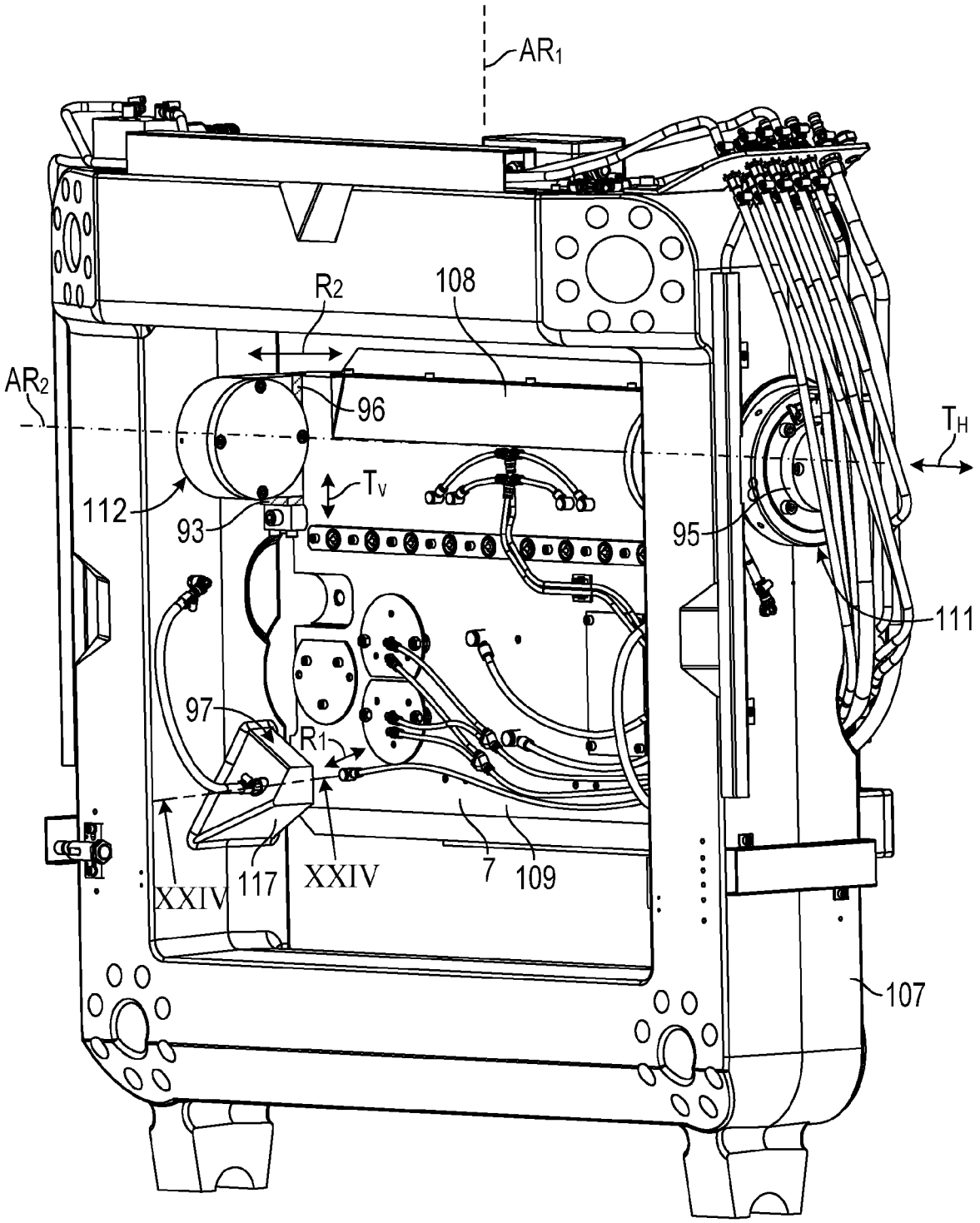
FIG. 23 is a perspective view illustrating a chamber end wall arranged swingable on a swing plate frame.

The embodiment of the present invention illustrated in FIG. 23 shows the first chamber end wall 7 arranged swingable by means of bearings 111, 112 on a swing plate frame 107 about an axis, $AR_2$, of rotation, corresponding to the pivot axis 14 illustrated in FIG. 2. FIG. 23 is a perspective view illustrating the back of the first chamber end wall 7, as seen in FIG. 2 from the right and obliquely from behind. Comparing FIGS. 2 and 23, it is realised that the front of the first chamber end wall 7 is provided with the first pattern plate 10. In the embodiment described here, accurate positioning of the first pattern plate on the chamber end wall 7 is ensured by means of guide pins 100, 101 fitting in guide bushings 60 of the first pattern plate 10 as illustrated in FIG. 8, and in a way which will be further described below under reference to FIGS. 25 to 27 illustrating how the second pattern plate 11 is mounted on the second chamber end wall 8. According to the embodiment illustrated in FIG. 23, a transverse compaction position in which the first pattern plate 10 is positioned during compaction of sand fed into the moulding chamber 3 is therefore adjustable by means of actuators 91, 92, 93, 95, 119 by means of which said first pattern plate 10 is adjustable by displacement relative to a nominal position in two different transverse directions, horizontal, $T_H$, and vertical, $T_V$, of the longitudinal direction LD of the moulding chamber 3. Furthermore, according to this embodiment, a rotational compaction position in which said first pattern plate 10 is positioned during compaction of sand fed into the moulding chamber 3 is adjustable by means of actuators 91, 92, 93, 96, 97 by means of which said first pattern plate 10 is adjustable by rotation relative to a nominal rotational position about a first axis, $AR_1$, of rotation, a second axis, $AR_2$, of rotation, and a third axis of rotation parallel to the longitudinal direction LD of the moulding chamber 3. Thereby, inaccuracies of alignment in transverse directions and/or of rotational alignment of patterns formed in compacted sand mould parts may be adjusted or corrected.

According to the embodiments of the present invention illustrated in FIGS. 25, 26 and 27 showing the second chamber end wall 8 arranged displaceably by means of the piston as seen in FIG. 2, a transverse compaction position in which a second pattern plate 11 is positioned during compaction of sand fed into the moulding chamber 3 is adjustable by means of actuators 91, 92, 94, 119 by means of which said second pattern plate 11 is adjustable by displacement relative to a nominal position in the two different transverse directions, horizontal, $T_H$, and vertical, $T_V$, of the longitudinal direction LD of the moulding chamber 3. In FIG. 27, the actuator 94 is not illustrated. Furthermore, according to this embodiment, a rotational compaction position in which said second pattern plate 11 is positioned during compaction of sand fed into the moulding chamber 3 is adjustable by means of actuators 91, 92, 94 by means of which said second pattern plate 11 is adjustable by rotation relative to a nominal rotational position about a third axis of rotation parallel to the longitudinal direction LD of the moulding chamber 3. Thereby, inaccuracies of alignment in transverse directions and/or of rotational alignment of patterns formed in compacted sand mould parts may be adjusted or corrected.

As mentioned above, both chamber end walls 7, 8 are provided with respective pattern plates 10, 11 each being provided with a pattern 12, 13 adapted to form a pattern in a sand mould part 2. Accurate positioning of the pattern plates 10, 11 on the respective chamber end walls 7, 8 is ensured by means of guide pins 100, 101 fitting in guide bushings 60 as illustrated in FIG. 8. It is noted that the actuators 91, 92, 119 for the guide pins 100, 101 illustrated in FIG. 27 are also present in the embodiment illustrated in FIG. 23, although not being visible. It is noted, however, that in order to adjust inaccuracies of alignment in transverse directions, it would be sufficient if only one of the pattern plates 10, 11 is adjustably arranged on its respective chamber end wall 7, 8 by means of actuators 91, 92, 119 for the guide pins 100, 101.

In the illustrated embodiments, said transverse directions are directions at right angles to the longitudinal direction LD of the moulding chamber 3.

Figure 20:
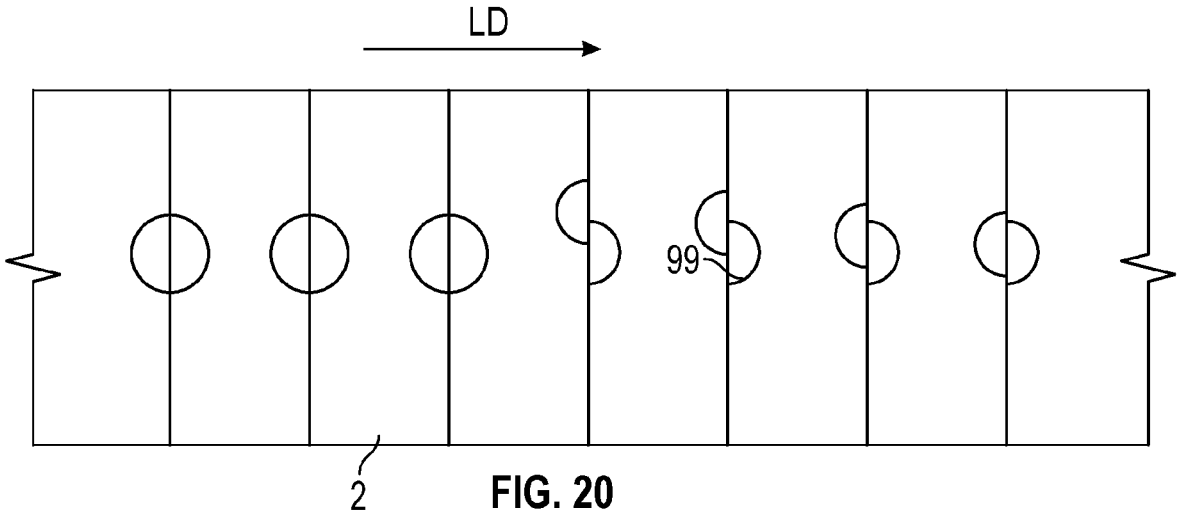
FIG. 20 illustrates a longitudinal cross-section through a row of sand mould parts in mutually abutting relationship on a conveyor.
Figure 21:
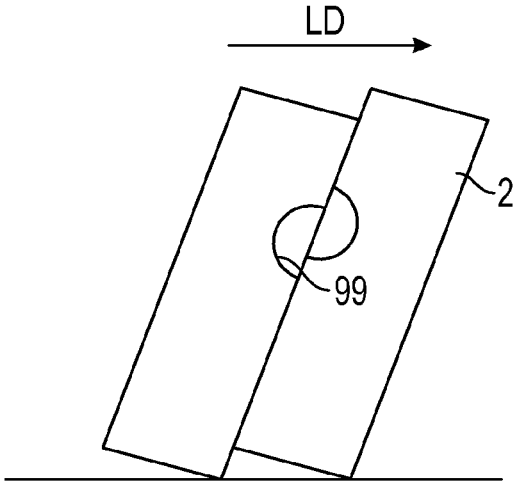
FIG. 21 illustrates a longitudinal cross-section through two sand mould parts in mutually abutting relationship on a conveyor.
Figure 22:
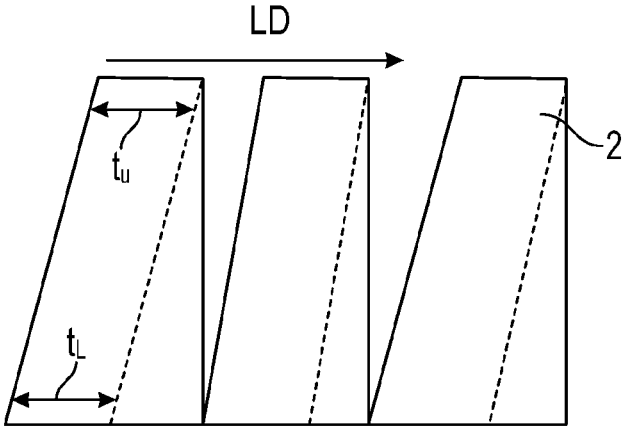
FIG. 22 illustrates a longitudinal cross-section through three sand mould parts in mutually abutting relationship on a conveyor.

According to the present invention, said actuators 91-97, 119 are controlled by means of a control system 98 on the basis of successive position detections performed by a detection system of pattern faces of reference patterns 28, 29, 30, 31, 81, 86, 90 of compacted sand mould parts 2, 76, 77, 85 traveling along the path of travel 17 in order to adaptively control the alignment of patterns 99 formed in produced sand mould parts 2 along the longitudinal direction LD of the moulding chamber 3 as illustrated in FIGS. 20 and 21 and the rotational position of patterns 99 formed in produced sand mould parts 2 about corresponding axes of rotation as illustrated in FIG. 22. The control system 98 may be part of the computer system 23, and the detection system of pattern faces may be any detection system suitable of detecting a position of a pattern face of the reference patterns 28, 29, 30, 31, 81, 86, 90 of the sand mould parts 2, 76, 77, 85, such as any one of the detection systems described above. Preferably, the detection system is a non-contact detection system and preferably it includes non-contact distance measuring devices 39. Preferably, the detection system includes at least a first distance measuring device arranged to measure a distance in said first direction $T_V$ and at least a second distance measuring device arranged to measure a distance in said second direction $T_H$. Thereby, because the respective directions of distance measurements correspond to the respective directions of correction of compaction position of the pattern plates 10, 11, accumulated inaccuracies in the control system 98 due to measurements and operation of actuators may be reduced.

In the embodiments illustrated in FIGS. 23 to 27, accurate positioning of the pattern plates 10, 11 on the respective chamber end walls 7, 8 is ensured by means of guide pins 100, 101 engaging the respective pattern plates 10, 11 and being arranged displaceably on the respective chamber end walls 7, 8 by means actuators 91, 92, 119 as explained in the following. This facilitates integration of the invention in existing designs of sand moulding machines.

According to the embodiments illustrated in FIGS. 23 to 27, each pattern plate 10, 11 is positioned relatively to its respective chamber end wall 7, 8 by means of a first and a second guide pin 100, 101, each arranged in opposed side areas of said chamber end wall 7, 8. The first guide pin 100 is arranged displaceably on said chamber end wall 7, 8 by means of a first linear actuator 91 in vertical direction, and the second guide pin 101 is arranged displaceably on said chamber end wall 7, 8 independently of the first guide pin 100 by means of a second linear actuator 92 in vertical direction. Thereby, a transverse compaction position in which a pattern plate 10, 11 is positioned during compaction of sand fed into the moulding chamber 3 is adjustable by displacement of said pattern plate 10, 11 in an at least substantially vertical direction $T_V$ by displacement of the first and the second guide pin 100, 101 in the same direction. On the other hand, a rotational compaction position in which said pattern plate 10, 11 is positioned during compaction is adjustable by means of said first and second linear actuators 91, 92 by rotation of said at least one pattern plate 10, 11 about an axis extending in the longitudinal direction LD of the moulding chamber 3 by a different displacement distance of the first and the second guide pin 100, 101 in the same direction or by displacement of the first and the second guide pin 100, 101 in opposed directions. Thereby, by means of the first and the second guide pins 100, 101, any inaccuracies of alignment in vertical direction of patterns formed in produced and abutting sand mould parts may be adjusted or corrected and at the same time, inaccuracies of rotational alignment of patterns formed in compacted sand mould parts about any axis extending in the longitudinal direction of the moulding chamber may be adjusted or corrected.

Furthermore, according to the embodiments illustrated in FIGS. 23 to 27, the second guide pin 101 is arranged freely displaceably within a certain limit on its respective chamber end wall 7, 8 in an at least substantially horizontal direction. Thereby, the second guide pin 101 being arranged freely displaceably may compensate for small variations in the distance between the guide pins 100, 101 that would otherwise occur when these are positioned at different vertical positions by different vertical displacement of the guide pins. This is advantageous, because the respective pattern plates 10, 11 are positioned relatively to their respective chamber end walls 7, 8 by means of engagement of the guide pins 100, 101 in corresponding holes in the pattern plates 10, 11. Furthermore, said at least one guide pin 101 being arranged freely displaceably may follow displacements of the pattern plate resulting from displacements of another one of said guide pins on said chamber end wall by means of an actuator in an at least substantially horizontal direction. Furthermore, the second guide pin 101 being arranged freely displaceably may compensate for small variations in the distance between the corresponding holes 60 in the pattern plates 10, 11 or in the distance between the guide pins, said variations in distance resulting from temperature expansions of the materials forming the pattern plates and/or the chamber end walls.

As it is seen in in FIGS. 25 to 27, the second guide pin 101 is arranged freely displaceably within a certain limit on the chamber end wall 7, 8 in an at least substantially horizontal direction by being mounted on a lower end 102 of an at least substantially vertically arranged lever 103, and an upper end 104 of the lever 103 is pivotally 105 arranged on the chamber end wall 7, 8. Furthermore it is seen that the upper end 104 of the lever 103 is pivotally arranged on a slide 121 which is arranged displaceably on the chamber end wall 7, 8 by means of the linear actuator 92 in vertical direction. Of course, the arrangement of the second guide pin 101 being arranged freely displaceably within a certain limit could be different than illustrated. For instance, the second guide pin 101 could be arranged in a hole being elongated in horizontal direction.

Furthermore, according to the embodiment illustrated in FIG. 27, the first guide pin 100 is arranged displaceably on the chamber end wall 8 by means of the rotary actuator 119 in an at least substantially horizontal direction $T_H$, in that first guide pin 100 is arranged eccentrically on a disc 124 driven rotationally by said rotary actuator 119 so that the centre axis of the first guide pin 100 is parallel to, but displaced in relation to the central rotational axis of the disc 124. Thereby, by rotation of the disc 124 by means of the rotary actuator 119, the first guide pin 100 may be displaced in said at least substantially horizontal direction $T_H$. If the angle of rotation is relatively small compared to the displacement between the centre axis of the first guide pin 100 and the central rotational axis of the disc 124, the first guide pin may be displaced at least substantially along a horizontal straight line. As seen, the rotary actuator 119 is arranged in a slide 120, which is arranged vertically displaceable by means of the above-described linear actuator 91. Therefore, in order to ensure that the first guide pin 100 is displaced along a horizontal straight line by rotation of the disc 124 by means of the rotary actuator 119, the linear actuator 91 may be used by the control system 98 to compensate for the vertical component of displacement of the first guide pin 100 resulting from the rotation of the disc 124. Of course, instead of using the rotary actuator 119 and the disc 124, the first guide pin 100 could alternatively be displaced in an at least substantially horizontal direction $T_H$ by means of a linear actuator.

Figure 24:
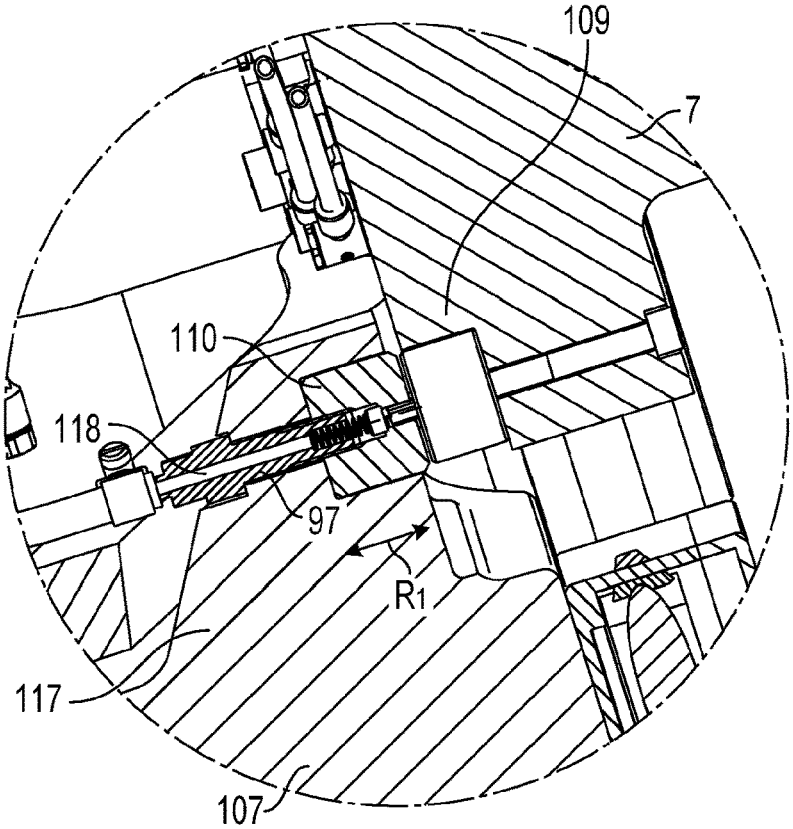
FIG. 24 illustrates a cross-section along the line XXIV-XXIV of FIG. 23 on a larger scale.

Furthermore, in the embodiment illustrated in FIGS. 23 and 24, as mentioned, the first chamber end wall 7 is arranged swingable on a swing plate frame 107 in relation to the moulding chamber 3 about an at least substantially horizontal pivot axis $AR_2$ extending at an upper part 108 of said swingable chamber end wall 7. When said swingable chamber end wall 7 is extending in an at least substantially vertical direction defining a rotational compaction position, as illustrated in FIG. 23, a lower part 109 of the swingable chamber end wall 7 is adapted to abut two pressure pads 110 engaging between the swingable chamber end wall 7 and the swing plate frame 107 at the respective left and right sides of the swing plate frame 107. The pressure pad 110 positioned to the left in FIG. 23 is illustrated in FIG. 24. Each pressure pad 110 is arranged displaceably relative to the swing plate frame 107 by means of a respective actuator 97 as seen in FIG. 24 in order to adjust said rotational compaction position about the substantially horizontal pivot axis $AR_2$. Thereby, inaccuracies of parallelism of opposed end faces and patterns of compacted sand mould parts may be adjusted or corrected. This embodiment may facilitate integration of the actuators in existing designs of sand moulding machines. To obtain stability, typically, the position of the two pressure pads 110 will be adjusted so that the swingable chamber end wall 7 abuts both pressure pads 110 firmly.

As illustrated in FIG. 22 by means of broken lines, opposed end faces of compacted sand mould parts may be parallel seen from a side if an upper thickness $t_U$ corresponds to a lower thickness $t_L$, although said faces may not be vertically arranged. As further seen in FIG. 22, if said opposed end faces of compacted sand mould parts are not parallel seen from a side, end faces of neighbouring sand mould parts may not abut each other appropriately as openings may occur. Of course, in FIGS. 20 to 22, the illustrated inaccuracies are exaggerated greatly for the sake of illustration.

Furthermore, in the embodiment illustrated in FIGS. 23 and 24, as mentioned above, the first chamber end wall 7 is arranged swingable on the swing plate frame 107 by means of the left and the right bearing 111, 112, and the respective bearings 111, 112 are arranged displaceably at least substantially in the longitudinal direction LD of the moulding chamber 3 relative to the swing plate frame 107 by means of two respective linear actuators 96, of which only the one positioned to the left in FIG. 23 is visible in that it is illustrated purely schematic by a hatched block. By actuating the two respective linear actuators 96 to perform an equal displacement of each of the left and the right bearings 111, 112 at least substantially in the longitudinal direction LD, a rotational compaction position of the first chamber end wall 7 may be adjusted about an axis parallel to the axis $AR_2$ of rotation, that is a horizontal axis, illustrated in FIG. 23. However, by actuating the two respective linear actuators 96 to perform different displacements of each of the left and the right bearings 111, 112 at least substantially in the longitudinal direction LD, a rotational compaction position of the first chamber end wall 7 may be adjusted about an axis parallel to the axis $AR_1$ of rotation, that is a vertical axis, as illustrated in FIG. 23. To obtain this, the position of the two pressure pads 110 should accordingly adjusted so that the swingable chamber end wall 7 abuts both pressure pads 110 firmly. It is noted that, for instance, by actuating the linear actuator 96 seen to the left in FIG. 23 and at the same time actuating the pressure pad 110 positioned to the right in FIG. 23, a rotational compaction position of the first chamber end wall 7 may be adjusted about an axis at 45 degrees to the axis $AR_1$ of rotation. By means of the features mentioned above, inaccuracies of parallelism of opposed end faces and patterns of compacted sand mould parts may be adjusted or corrected about both a vertical and a horizontal axis and any combination thereof. This embodiment may facilitate integration of the actuators in existing designs of sand moulding machines.

Furthermore, as illustrated in FIGS. 23 and 24, both bearings 111, 112 are arranged displaceably in an at least substantially vertical direction relative to the swing plate frame 107 by means of respective left and right linear actuators 93, of which only the left one is visible in that it is illustrated purely schematic by a hatched block. By actuating the two respective linear actuators 93 to perform an equal displacement of each of the left and the right bearings 111, 112 at least substantially in the vertical direction, a traverse compaction position of the first chamber end wall 7 may be adjusted in the vertical direction. Thereby, any inaccuracies of alignment in vertical direction of patterns formed in produced and abutting sand mould parts may be adjusted or corrected. However, by actuating the two respective linear actuators 93 to perform different displacements of each of the left and the right bearings 111, 112 in the vertical direction, a rotational compaction position of the first chamber end wall 7 may be adjusted about an axis parallel to the longitudinal direction LD of the moulding chamber 3. Thereby inaccuracies of rotational alignment of patterns formed in compacted sand mould parts about an axis extending in the longitudinal direction of the moulding chamber may be adjusted or corrected. This embodiment may facilitate integration of the actuators in existing designs of sand moulding machines.

Furthermore, in the embodiment illustrated in FIGS. 23 and 24, the relative position of the swingable chamber end wall 7 in relation to the swing plate frame 107 is adjustable in the direction $T_H$ of the pivot axis 14 by means the actuator 95 arranged at the right bearing 111. By actuating the actuator 95, a traverse compaction position of the first chamber end wall 7 may be adjusted in the horizontal direction. Thereby, any inaccuracies of alignment in horizontal direction of patterns formed in produced and abutting sand mould parts may be adjusted or corrected. This embodiment may facilitate integration of the actuators in existing designs of sand moulding machines.

Furthermore, in the embodiment illustrated in FIGS. 25 and 26, by means of the left and right linear actuator 94, respective left and right glide shoes 115, 116 are adjustable independently in vertical direction in relation to the second chamber end wall 8. The glide shoes 115, 116 support in a known manner the second chamber end wall 8 on the chamber bottom wall 5 when the piston 15 displaces the second chamber end wall 8 in the longitudinal direction LD of the moulding chamber. The glide shoes 115, 116 are supplied with compressed air in order for the second chamber end wall 8 to smoothly slide on the chamber bottom wall 5. By actuating the two respective linear actuators 94 to perform an equal displacement of each of the left and the right glide shoes 115, 116 at least substantially in the vertical direction, a traverse compaction position of the second chamber end wall 8 may be adjusted in the vertical direction. Thereby, any inaccuracies of alignment in vertical direction of patterns formed in produced and abutting sand mould parts may be adjusted or corrected. However, by actuating the two respective linear actuators 94 to perform different displacements of each of the left and the right glide shoes 115, 116 in the at least substantially vertical direction, a rotational compaction position of the second chamber end wall 8 may be adjusted about an axis parallel to the longitudinal direction LD of the moulding chamber 3. Thereby inaccuracies of rotational alignment of patterns formed in compacted sand mould parts about an axis extending in the longitudinal direction LD of the moulding chamber may be adjusted or corrected. This embodiment may facilitate integration of the actuators in existing designs of sand moulding machines.

As exemplified by means of the embodiments illustrated in FIGS. 23 to 27, one or more transverse and/or a rotational compaction positions of the respective pattern plates 10, 11 are adjustable by means of the different actuators 91-97, 119. However, as it will be understood, some of these actuators 91-97, 119 may be redundant or perform redundant adjustments. Therefore, of course, only some of the actuators 91-97, 119 may be required in order to perform adjustments of transverse and/or rotational compaction positions. Nevertheless, it may be advantageous if the control system is able to correct or adjust many different parameters, because a better flexibility in the control processes may be achieved.

In an embodiment, a transverse and/or rotational compaction position in which a pattern plate 10, 11 is positioned during compaction of sand fed into the moulding chamber 3 and which is adjustable by means of one of the actuators 91-97, 119 is additionally adjustable independently of said actuator by means of a manual adjusting mechanism. For instance, the actuator may be arranged on a block which is manually adjustable in relation to the chamber end wall 7, 8. Thereby, it may be possible to manually preadjust a transverse and/or rotational compaction position. For instance, the manual adjusting mechanism may allow a relatively larger adjustment interval in order to zero the adjustment, whereas it may be sufficient that the at least one actuator operates within a relatively smaller adjustment interval. However, alternatively, in order to preadjust and/or zero the adjustment, it may also be possible to use the actuators 91-97, 119 by adapting the control system 98 to receive from an input device 113 instructions regarding adjustments for the transverse and/or rotational compaction position in which the pattern plates 10, 11 should be positioned by means of at least one actuator 91-97, 119 in the zero position.

In order to zero the adjustment, typically a dial gauge is used to position the guide pins 100, 101 in a zero position in relation to a known position of the moulding chamber, such as the upper face of the top wall 4 of the moulding chamber 3 in the vertical direction and an outer side of one of the side walls 6 of the moulding chamber in the horizontal direction.

In an embodiment, the control system 98 is adapted to receive from an input device 113 instructions regarding at least one initial value for the transverse and/or rotational compaction position in which a pattern plate 10, 11 is to be positioned by means of an actuator 91-97, 119 as a starting point for subsequent control of said actuator by means of the control system. Thereby, an operator may input a suitable initial value for the transverse and/or rotational compaction position for a specific pattern plate. Such a suitable initial value may for instance be based on experience and/or empirical data. For instance, a specific pattern plate may have a pattern that is rather asymmetric so that a relatively large impression is made in a first side of the sand mould part and so that a relatively small impression is made in a second side of the sand mould part. In such a case, experience and/or empirical data may indicate that an initial value in a certain range for the transverse and/or rotational compaction position may result in that the desired result is achieved in a relatively faster and/or a relatively simpler way, i.e. that one or more set points for a desired alignment of patterns formed in the produced sand mould parts along the longitudinal direction of the moulding chamber and/or one or more set points for a desired rotational position of patterns formed in produced sand mould parts about at least one axis of rotation is/are achieved in a relatively faster and/or relatively simpler way.

In an embodiment, the sand moulding machine includes a register of suitable initial values for transverse and/or rotational compaction positions of a number of different pattern plates 10, 11, and the input device 113 is adapted to receive identification corresponding to a specific pattern plate 10, 11. Thereby, the control system 98 may more or less automatically receive a suitable initial value for the transverse and/or rotational compaction position for a specific pattern plate from the register. For instance, an operator may input a serial number of the pattern plate, or the sand moulding machine may be provided with for instance a bar code scanner in order to identify the specific pattern plate.

In an embodiment, the control system 98 is adapted to receive from an input device 113 instructions regarding one or more set points for a desired alignment of patterns 99 formed in the produced sand mould parts 2 along the longitudinal direction LD of the moulding chamber 3 and/or one or more set points for a desired rotational position of patterns formed in produced sand mould parts about at least one axis of rotation. Thereby, an operator may input one or more set points which are suitable in a specific situation or which are suitable for a specific pattern plate. Such one or more suitable set points may for instance be based on inspection of the final castings or may be based on experience and/or empirical data relating to a specific pattern. For instance, if no particular relevant information is available in this regard, it may normally be assumed that the best set point for a transverse compaction position is zero which corresponds to a theoretically exact alignment of patterns formed and located internally in subsequently produced and abutting sand mould parts. However, although the achieved alignment of the produced and abutting sand mould parts may in fact be very exact, inspection of the final castings may nevertheless indicate a small misalignment of for instance 1/10 millimetre in a certain direction. This misalignment may occur during or after the pouring process as a result of the hot melted metal being poured into the sand moulds composed by sand mould parts. In such a case, a set point of 1/10 millimetre in the opposite direction of said certain direction may be set in order to compensate for the actual misalignment. However, it is also possible that a small misalignment is a result of tolerances of the pattern plate, the detection system, or something else. In the case that a small misalignment relates to a specific pattern plate, a register may be kept with suitable set points for specific pattern plates.

In an embodiment, the sand moulding machine includes a register of suitable set points for a desired alignment of patterns 99 formed in produced sand mould parts 2 and/or of suitable set points for a desired rotational position of patterns formed in produced sand mould parts corresponding to a number of different pattern plates 10, 11, and the input device 113 is adapted to receive identification corresponding to a specific pattern plate 10, 11. Thereby, the control system may more or less automatically receive a suitable setpoint a specific pattern plate from the register. For instance, an operator may input a serial number of the pattern plate, or the sand moulding machine may be provided with for instance a bar code scanner in order to identify the specific pattern plate.

In an embodiment, the control system 98 is adapted to monitor and record in a register relevant sets of corresponding control values such as detected values relating to alignment and rotational position of patterns 99 formed in produced sand mould parts 2 and/or controlled values relating to transverse and/or rotational compaction positions for said at least one pattern plate 10, 11 and/or a maximum deviation for the alignment of the patterns formed in the produced sand mould parts along the longitudinal direction LD of the moulding chamber and/or a maximum deviation for the difference in rotational position of two opposed patterns formed in the same produced sand mould part. Thereby, a register of data suitable for improvement of the control system and for the tracking of errors may be maintained. Some data may directly be used by the control system at a later stage.

In an embodiment, the control system 98 is adapted to read from said register control values related to a specific pattern plate 10, 11 such as suitable initial values for transverse and/or rotational compaction positions and/or such as a maximum deviation for the alignment of the patterns formed in the produced sand mould parts along the longitudinal direction LD of the moulding chamber and/or such as a maximum deviation for the difference in rotational position of two opposed patterns 99 formed in the same produced sand mould part 2. Thereby, suitable and useful data relating to specific pattern plates may be retrieved from said register by the control system in order to optimise the control procedure. Said suitable and useful data may have been recorded manually in the register or may have been recorded by the control system during a previous manufacturing process in which the same pattern plate or plates was or were used.

In an embodiment, the detection system is arranged at a certain distance in the longitudinal direction LD of the moulding chamber 3 from a discharge end of the moulding chamber 3, the sand moulding machine is adapted to produce sand mould parts 2, 76, 77, 85 having a certain length, so that a maximum number of compacted sand mould parts 2 may be arranged in aligned and mutually abutting configuration along the path of travel 17 between the discharge end of the moulding chamber 3 and the detection system, the control system 98 is adapted to control said actuator or actuators 91-97 in such a way that when a specific transverse compaction position or a specific rotational compaction position has been adjusted by means of an actuator, that specific transverse compaction position or that specific rotational compaction position is maintained until at least a number of compacted sand mould parts 2 corresponding at least substantially to said maximum number have been produced, before that compaction position is adjusted again. Thereby, it may be ensured that a compaction position is not adjusted before relevant control data have been detected and thereby a more robust control may be ensured.

In an embodiment, the control system 98 is adapted to adaptively control said alignment and said rotational position of patterns 99 formed in produced sand mould parts 2 by, in a control cycle, firstly performing the following step:

controlling at least one actuator 96, 97 arranged to adjust a rotational compaction position by rotation of said at least one pattern plate 10, 11 about at least one axis $AR_1$, $AR_2$ of rotation extending transversely in relation to the longitudinal direction LD of the moulding chamber 3 until a certain measure for the difference in rotational position of two opposed patterns 99 formed in the same produced sand mould part 2 about corresponding axes of rotation has been obtained, and secondly performing at least one of the following two steps:

controlling at least one actuator 91-95, 119 arranged to adjust a transverse compaction position by displacement of said at least one pattern late 10, 11 in at least one transverse direction of the longitudinal direction LD of the moulding chamber until a certain measure for the alignment of the patterns 99 formed in the produced sand mould parts 2 along the longitudinal direction LD of the moulding chamber 3 has been obtained, controlling at least one actuator 91-94 arranged to adjust a rotational compaction position by rotation of said at least one pattern plate 10, 11 about the longitudinal direction LD of the moulding chamber 3 until a certain measure for the rotational position of the patterns 99 formed in the produced sand mould parts 2 in relation to a corresponding nominal rotational position has been obtained.

Thereby, by firstly adjusting a rotational compaction position of the pattern plate or plates 10, 11 about an axis extending transversely of the longitudinal direction of the moulding chamber, the parallelism of opposed end faces of each compacted sand mould part 2 may be adjusted before any transverse or rotational misalignment of the patterns formed in the produced sand mould parts is adjusted. Thereby, a more effective control procedure may be achieved, because an adjustment of the parallelism of opposed end faces may often result in further transverse or rotational misalignment of the patterns formed in the produced sand mould parts, and such misalignment must subsequently be compensated for by adjustment of a transverse compaction position of the pattern plate or plates and/or a rotational compaction position of the pattern plate or plates about the longitudinal direction of the moulding chamber. Said further transverse or rotational misalignment of the patterns may be the result of mutually abutting produced sand mould parts accumulating inaccuracies of parallelism and therefore arranging themselves in oblique configuration on a conveyor as illustrated in FIGS. 21 and 22.

In an embodiment, the control system 98 is adapted to initiate and complete said control cycle, in the case that during operation of the sand moulding machine it is detected that a maximum deviation for the alignment of the patterns 99 formed in the produced sand mould parts 2 along the longitudinal direction LD of the moulding chamber is exceeded, and/or in the case that during operation of the sand moulding machine it is detected that a maximum deviation for the difference in rotational position of two opposed patterns 99 formed in the same produced sand mould part 2 about said corresponding axes of rotation is exceeded. Thereby, the number of adjustment operations performed by the actuators 91-97, 119 may be reduced and a steadier control procedure may be achieved. By setting said maximum deviations for the alignment and for the difference in rotational position higher than the respective resolutions of the control system resulting from the combination of the resolution of the detection system and the resolution of the actuators, the control system may initiate and complete said control cycles in such a way that any inaccuracies of parallelism are always corrected before transverse or rotational misalignment of the patterns is corrected. For instance, purely as an example, a maximum deviation for the alignment of the patterns 99 formed in the produced sand mould parts 2 could be set to 1 millimetre, and the respective resolution of the control system resulting from the combination of the resolution of the detection system and the resolution of the actuators could be 0.02 millimetres.

In an alternative embodiment, the control system 98 is adapted to initiate and complete said control cycle every time a certain number of sand mould parts 2 have been produced. Alternatively it may be possible to manually initiate said control cycle when convenient.

LIST OF REFERENCE NUMBERS

A, B intersection points between straight lines
$AR_1$ first axis of rotation
$AR_2$ second axis of rotation
D conveying direction
C centre of circle
$F_1$, $F_2$ face
LD longitudinal direction of moulding chamber
LN laser-based distance sensor N
LN' laser-based distance sensor N'
l, m, n flat surfaces of reference pattern
L, M, N faces of reference pattern block
$P_1$, $P_2$ points
$R_1$, $R_2$ rotational direction
$T_1$, $T_2$ tangents
$T_V$ transverse direction (vertical)
$T_H$ transverse direction (horizontal)
$t_U$ upper thickness of compressed sand mould part
$t_I$ lower thickness of compressed sand mould part
1 sand moulding machine (vertical flaskless sand moulding type)
2 sand mould part
3 moulding chamber
4 chamber top wall
5 chamber bottom wall
6 chamber side wall
7, 8 chamber end wall
9 sand filling opening
10, 11 pattern plate
12, 13 pattern
14 pivot axis
15 piston
16 conveyor
17 path of travel
18 sand feed system
19 sand container
21 foundry production line
22 melt pouring device
23 computer system
24, 25 corner reference pattern block
26, 27 side reference pattern block
28, 29 corner reference pattern
30, 31 side reference pattern
32, 33, 34, 35, 36 external face of sand mould part
37 lifting arm
38 pivotal connection
39 non-contact distance measuring device
40 measuring position
41 measuring boom
42 first set of three flat surfaces
43 second set of three flat surfaces
44 first set of flat faces
45 second set of flat faces
46 element combined from three truncated square pyramids
47, 48, 49 truncated square pyramid
50 symmetry line
51 side face
52 side face
53 side face
54 longitudinally extending gripping element
55 position sensor
56 measuring bracket
57 end face
58, 59 estimated mean value
60 guide bushing
61 traverse
62 connecting arrangement
63 magnetic position giving element
64 fixed rod
65 slide
66 sliding element
67 downward open groove
68 measuring rod
69 bottom wear face of the conveyor
70 through going groove
71 sand moulding machine control panel
73 sand conveyor
74 conveyor
75 sand moulding machine (horizontal flaskless match plate)
76 lower sand mould part
77 upper sand mould part
78 sand moulding machine door
79 measuring pole
80 measuring boom
81 corner reference pattern
82 displacement direction
83 melt pouring opening
84 parting line
85 sand mould part
86 reference pattern
87 camera
88 camera
89 illuminated line
90 reference pattern
91-97 actuator
98 control system
99 pattern formed in produced sand mould part
100, 101 guide pin
102 lower end of lever
103 lever

104 upper end of lever
105 pivot axis
106 bolt
107 swing plate frame
108 upper part of swingable chamber end wall
109 lower part of said swingable chamber end wall
110 pressure pad
111 left bearing
112 right bearing
113 input device
114 heating plate
115, 116 glide shoes
117 support bracket on swing plate frame
118 compressed air supply channel
119 actuator
120, 121 slide
122, 123 spindle
124 rotatable disc of actuator

The invention claimed is:

1. A method of producing sand mould parts, whereby a moulding chamber during a filling operation is filled with sand, and whereby the sand is subsequently compacted, the moulding chamber being formed by a chamber top wall, a chamber bottom wall, two opposed chamber side walls and two opposed chamber end walls, whereby the moulding chamber is filled with sand through at least one sand filling opening provided in a chamber wall, whereby a mould or mould part is provided with a pattern by means of at least one of the chamber end walls being provided with a pattern plate having a pattern, and whereby sand is compacted inside the moulding chamber by displacing at least one of the chamber end walls in a longitudinal direction of the moulding chamber, whereby a reference pattern is formed in an external face of a sand mould part by means of at least one reference pattern block associated with and positioned in fixed relationship to at least one of the pattern plates, and whereby a position of a pattern face of the reference patterns of the sand mould parts is detected by means of a detection system arranged adjacent a path of travel of the compacted sand mould parts, wherein a transverse compaction position in which said at least one pattern plate is positioned during compaction of sand fed into the moulding chamber is adjusted by actuation of at least one actuator by means of which said at least one pattern plate is adjustable by displacement relative to a nominal position in at least one transverse direction of the longitudinal direction of the moulding chamber and/or in that a rotational compaction position in which said at least one pattern plate is positioned during compaction of sand fed into the moulding chamber is adjusted by actuation of at least one actuator by means of which said at least one pattern plate is adjustable by rotation relative to a nominal rotational position about at least one axis of rotation, and by controlling said actuator or actuators by means of a control system on the basis of successive position detections performed by the detection system of pattern faces of reference patterns of compacted sand mould parts traveling along said path of travel, thereby adaptively controlling the alignment of patterns formed in produced sand mould parts along the longitudinal direction of the moulding chamber and/or the rotational position of patterns formed in produced sand mould parts about corresponding axes of rotation.

2. A method of producing sand mould parts according to claim 1, whereby the control system adaptively controls said alignment and said rotational position of patterns formed in produced sand mould parts by, in a control cycle, firstly performing the following step:

controlling at least one actuator arranged to adjust a rotational compaction position by rotation of said at least one pattern plate about at least one axis of rotation extending transversely in relation to the longitudinal direction of the moulding chamber until a certain measure for the difference in rotational position of two opposed patterns formed in the same produced sand mould part about corresponding axes of rotation has been obtained, and secondly performing at least one of the following two steps:

controlling at least one actuator arranged to adjust a transverse compaction position by displacement of said at least one pattern plate in at least one transverse direction of the longitudinal direction of the moulding chamber until a certain measure for the alignment of the patterns formed in the produced sand mould parts along the longitudinal direction of the moulding chamber has been obtained, controlling at least one actuator arranged to adjust a rotational compaction position by rotation of said at least one pattern plate about the longitudinal direction of the moulding chamber until a certain measure for the rotational position of the patterns formed in the produced sand mould parts in relation to a corresponding nominal rotational position has been obtained.

3. A method of producing sand mould parts according to claim 2, whereby the control system initiates and completes said control cycle, in the case that during operation of the sand moulding machine it is detected that a maximum deviation for the alignment of the patterns formed in the produced sand mould parts along the longitudinal direction of the moulding chamber is exceeded, and/or in the case that during operation of the sand moulding machine it is detected that a maximum deviation for the difference in rotational position of two opposed patterns formed in the same produced sand mould part about said corresponding axes of rotation is exceeded.

4. A method of producing sand mould parts according to claim 1, whereby a rotational compaction position in which said at least one pattern plate is positioned during compaction is adjusted by actuation of at least one actuator by means of which said at least one pattern plate is adjustable by rotation relative to a nominal rotational position about at least one axis of rotation extending transversely in relation to the longitudinal direction of the moulding chamber, and whereby said actuator or actuators is/are controlled by means of a control system on the basis of successive position detections performed by the detection system of pattern faces of reference patterns of compacted sand mould parts traveling along said path of travel, thereby adaptively controlling the rotational position of patterns formed in produced sand mould parts about an axis parallel to said at least one axis extending transversely in relation to the longitudinal direction of the moulding chamber.

5. A method of producing sand mould parts according to claim 1, whereby a rotational compaction position in which said at least one pattern plate is positioned during compaction is adjusted by actuation of at least one actuator by means of which said at least one pattern plate is adjustable by rotation relative to a nominal rotational position about an axis extending in the longitudinal direction of the moulding chamber, and whereby said actuator or actuators is/are controlled by means of a control system on the basis of successive position detections performed by the detection system of pattern faces of reference patterns of compacted sand mould parts traveling along said path of travel, thereby adaptively controlling the rotational position of patterns formed in produced sand mould parts about an axis extending in the longitudinal direction of the moulding chamber.

6. A method of producing sand mould parts according to claim 1, whereby a transverse compaction position in which said at least one pattern plate is positioned during compaction of sand fed into the moulding chamber is adjusted by displacement of said at least one pattern plate relative to a nominal position in a first transverse direction of the longitudinal direction of the moulding chamber and by displacement of said at least one pattern plate relative to a nominal position in a second transverse direction of the longitudinal direction of the moulding chamber, said second transverse direction being different from said first transverse direction.

7. A method of producing sand mould parts according to claim 1, whereby each of the chamber end walls is provided with a respective pattern plate having a pattern adapted to form a pattern in a sand mould part, whereby a transverse compaction position in which a first one of said pattern plates is positioned during compaction of sand fed into the moulding chamber is adjusted by displacement of said first pattern plate relative to a nominal position in a first transverse direction of the longitudinal direction of the moulding chamber, and whereby a transverse compaction position in which a second one of said pattern plates is positioned during compaction of sand fed into the moulding chamber is adjusted by displacement of said second pattern plate relative to a nominal position in a second transverse direction of the longitudinal direction of the moulding chamber, said second transverse direction being different from said first transverse direction.

8. A method of producing sand mould parts according to claim 1, whereby a transverse direction of the longitudinal direction of the moulding chamber is a direction at least substantially at right angles to the longitudinal direction of the moulding chamber.

9. A method of producing sand mould parts according to claim 1, whereby said at least one pattern plate is positioned relatively to the at least one of the chamber end walls by means of at least one guide pin engaging the at least one pattern plate and being displaced on said chamber end wall by means of at least one actuator.

10. A method of producing sand mould parts according to claim 1, whereby said at least one pattern plate is positioned relatively to the at least one of the chamber end walls by means of a first and a second guide pin each arranged in opposed side areas of said chamber end wall, whereby the first guide pin is displaced on said chamber end wall by actuation of at least one first actuator in an at least substantially vertical direction, whereby the second guide pin is displaced on said chamber end wall independently of the first guide pin by actuation of at least one second actuator in an at least substantially vertical direction, whereby a transverse compaction position in which said at least one pattern plate is positioned during compaction of sand fed into the moulding chamber is adjusted by displacement of said at least one pattern plate in an at least substantially vertical direction by displacement of the first and the second guide pin in the same direction, and whereby a rotational compaction position in which said at least one pattern plate is positioned during compaction is adjusted by actuation of said at least one first and second actuators by rotation of said at least one pattern plate about an axis extending in the longitudinal direction of the moulding chamber by a different displacement distance of the first and the second guide pin in the same direction or by displacement of the first and the second guide pin in opposed directions.

11. A method of producing sand mould parts according to claim 1, whereby said at least one pattern plate is positioned relatively to the at least one of the chamber end walls by means of two guide pins each arranged in opposed side areas of said chamber end wall, whereby each of said guide pins is displaced on said chamber end wall by actuation of at least one actuator in an at least substantially vertical direction, whereby a first one of said guide pins is displaced on said chamber end wall by actuation of at least one actuator in an at least substantially horizontal direction, and whereby a second one of said guide pins is arranged freely displaceably within a certain limit on said chamber end wall in an at least substantially horizontal direction.

12. A method of producing sand mould parts according to claim 1, whereby at least one of the chamber end walls is arranged swingable on a swing plate frame in relation to the moulding chamber about an at least substantially horizontal pivot axis extending at the upper part of said swingable chamber end wall, whereby, when said swingable chamber end wall is extending in an at least substantially vertical direction defining a rotational compaction position, a lower part of said swingable chamber end wall is abutting at least one pressure pad engaging between said swingable chamber end wall and the swing plate frame, and whereby the at least one pressure pad is displaced relative to said swingable chamber end wall or the swing plate frame by actuation of at least one actuator in order to adjust said rotational compaction position.

13. A method of producing sand mould parts according to claim 1, whereby at least one of the chamber end walls is arranged swingable on a swing plate frame in relation to the moulding chamber about an at least substantially horizontal pivot axis extending at the upper part of said swingable chamber end wall by means of a left and a right bearing, whereby at least one of said bearings is displaced at least substantially in the longitudinal direction of the moulding chamber relative to the swing plate frame or at least substantially in a direction at right angles to the plane of extension of the swingable chamber end wall relative to the swingable chamber end wall by actuation of at least one actuator, and whereby, when said swingable chamber end wall is extending in an at least substantially vertical direction defining a rotational compaction position, a lower part of said swingable chamber end wall is abutting at least one pressure pad arranged on the swing plate frame.

14. A method of producing sand mould parts according to claim 1, whereby at least one of the chamber end walls is arranged swingable on a swing plate frame in relation to the moulding chamber about an at least substantially horizontal pivot axis extending at the upper part of said swingable chamber end wall by means of a left and a right bearing, whereby at least one of said bearings is displaced in an at least substantially vertical direction relative to the swing plate frame or relative said swingable chamber end wall by actuation of at least one actuator.

15. A method of producing sand mould parts according to claim 1, whereby at least one of the chamber end walls is arranged swingable on a swing plate frame in relation to the moulding chamber about an at least substantially horizontal pivot axis extending at the upper part of said swingable chamber end wall by means of a left and a right bearing, and whereby the relative position of said swingable chamber end wall in relation to the swing plate frame is adjusted at least substantially in the direction of said pivot axis by actuation of at least one actuator.

16. A method of producing sand mould parts according to claim 1, whereby a transverse and/or rotational compaction position in which said at least one pattern plate is positioned during compaction of sand fed into the moulding chamber and which is adjustable by means of at least one actuator is additionally adjusted independently of said actuator by means of a manual adjusting mechanism.

17. A method of producing sand mould parts according to claim 1, whereby the control system receives from an input device instructions regarding at least one initial value for the transverse and/or rotational compaction position in which said at least one pattern plate is to be positioned by means of at least one actuator as a starting point for subsequent control of said actuator by means of the control system.

18. A method of producing sand mould parts according to claim 1, whereby the control system receives from an input device instructions regarding one or more set points for a desired alignment of patterns formed in the produced sand mould parts along the longitudinal direction of the moulding chamber and/or one or more set points for a desired rotational position of patterns formed in produced sand mould parts about at least one axis of rotation.

19. A method of producing sand mould parts according to claim 1, whereby the control system monitors and records in a register relevant sets of corresponding control values such as detected values relating to alignment and rotational position of patterns formed in produced sand mould parts and/or controlled values relating to transverse and/or rotational compaction positions for said at least one pattern plate and/or a maximum deviation for the alignment of the patterns formed in the produced sand mould parts along the longitudinal direction of the moulding chamber and/or a maximum deviation for the difference in rotational position of two opposed patterns formed in the same produced sand mould part.

20. A method of producing sand mould parts according to claim 1, whereby the detection system is arranged at a certain distance in the longitudinal direction of the moulding chamber from a discharge end of the moulding chamber, whereby the sand moulding machine is producing sand mould parts having a certain length, so that a maximum number of compacted sand mould parts are arranged in aligned and mutually abutting configuration along the path of travel between the discharge end of the moulding chamber and the detection system, whereby the control system controls said actuator or actuators in such a way that when a specific transverse compaction position or a specific rotational compaction position has been adjusted by means of an actuator, that specific transverse compaction position or that specific rotational compaction position is maintained until at least a number of compacted sand mould parts corresponding at least substantially to said maximum number have been produced, before that compaction position is adjusted again.

21. A method of producing sand mould parts according to claim 1, whereby the at least one reference pattern block forms a corresponding reference pattern including a pattern face having a tangent varying in a longitudinal direction of the sand mould part corresponding to the longitudinal direction of the moulding chamber, by that the detection system is a non-contact detection system which detects the position of a number of different points distributed over the pattern face of the reference pattern in the longitudinal direction of the sand mould part, and by that the tangent in the longitudinal direction of the sand mould part is different between at least two of said points.

* * * * *